US011131523B2

(12) United States Patent
Otten

(10) Patent No.: US 11,131,523 B2
(45) Date of Patent: Sep. 28, 2021

(54) ARCHERY RELEASE AID MOUNT

(71) Applicant: Paul D. Otten, San Jose, CA (US)

(72) Inventor: Paul D. Otten, San Jose, CA (US)

( * ) Notice: Subject to any disclaimer, the term of this patent is extended or adjusted under 35 U.S.C. 154(b) by 0 days.

(21) Appl. No.: 16/805,603

(22) Filed: Feb. 28, 2020

(65) Prior Publication Data

US 2020/0363156 A1 Nov. 19, 2020

Related U.S. Application Data

(60) Provisional application No. 62/847,200, filed on May 13, 2019.

(51) Int. Cl.
*F41B 5/14* (2006.01)

(52) U.S. Cl.
CPC ..... *F41B 5/1469* (2013.01); *F41B 5/14* (2013.01)

(58) Field of Classification Search
CPC ..... F41B 5/1469; F41B 5/148
See application file for complete search history.

(56) References Cited

U.S. PATENT DOCUMENTS

| | | | | |
|---|---|---|---|---|
| 3,895,621 | A | 7/1975 | Kellogg | |
| 4,919,107 | A | 4/1990 | Bunts | |
| 6,612,299 | B2 * | 9/2003 | Martin | F41B 5/14 124/86 |
| 6,889,683 | B1 * | 5/2005 | Smith | F41B 5/14 124/86 |
| 7,100,591 | B2 | 9/2006 | Terry | |
| 7,299,795 | B2 | 11/2007 | Brannen | |
| 7,775,201 | B2 * | 8/2010 | Cooper | F41B 5/14 124/86 |
| 8,065,994 | B2 * | 11/2011 | Holmberg | F41G 1/467 124/86 |
| 8,596,256 | B2 * | 12/2013 | McPherson | F41B 5/14 124/86 |
| 8,622,050 | B2 | 1/2014 | Goff et al. | |
| 8,839,776 | B2 * | 9/2014 | Kingsbury | F41B 5/1426 124/89 |
| 8,893,701 | B1 * | 11/2014 | Entrup | F41G 1/467 124/89 |
| 9,915,491 | B2 | 3/2018 | Perry | |
| 2010/0018512 | A1 | 1/2010 | Sandel | |
| 2013/0288743 | A1 * | 10/2013 | Hunt | F16M 11/2014 455/556.1 |

FOREIGN PATENT DOCUMENTS

WO 2017213628 A1 12/2017

* cited by examiner

*Primary Examiner* — John A Ricci
(74) *Attorney, Agent, or Firm* — Douglas L. Weller

(57) ABSTRACT

An archery release aid mount includes an attachment mechanism configured to rigidly attach the archery release aid to a bow. A securing device is configured to receive an archery release aid. The securing device includes a securing device that upon the archery release aid mount receiving the archery release aid, holds the archery release aid securely, and that is configured to allow a user to without tools remove the archery release aid from the archery release aid mount when the user wants to use the archery release aid during archery.

20 Claims, 83 Drawing Sheets

SECTION D-D
SCALE 1 : 1

DETAIL D
SCALE 2 : 1

SECTION E-E
SCALE 2 : 1

DETAIL F
SCALE 8 : 1

SECTION C-C
SCALE 2 : 1

SECTION J-J

SECTION M-M

SECTION N-N

ARCHERY RELEASE AID MOUNT

BACKGROUND OF THE INVENTION

In archery, an archery release aid typically uses a trigger mechanism to release the bow string resulting in more precise firing of arrows. The archery release aid allows a quick release of the bowstring while reducing the amount of torque placed upon the bow string.

Archers may store an archery release aid in a pouch or holster clipped on to a belt or a piece of clothing. A binocular harness can also be used to carry an archery release aid.

DETAILED DESCRIPTION

Figure 1:
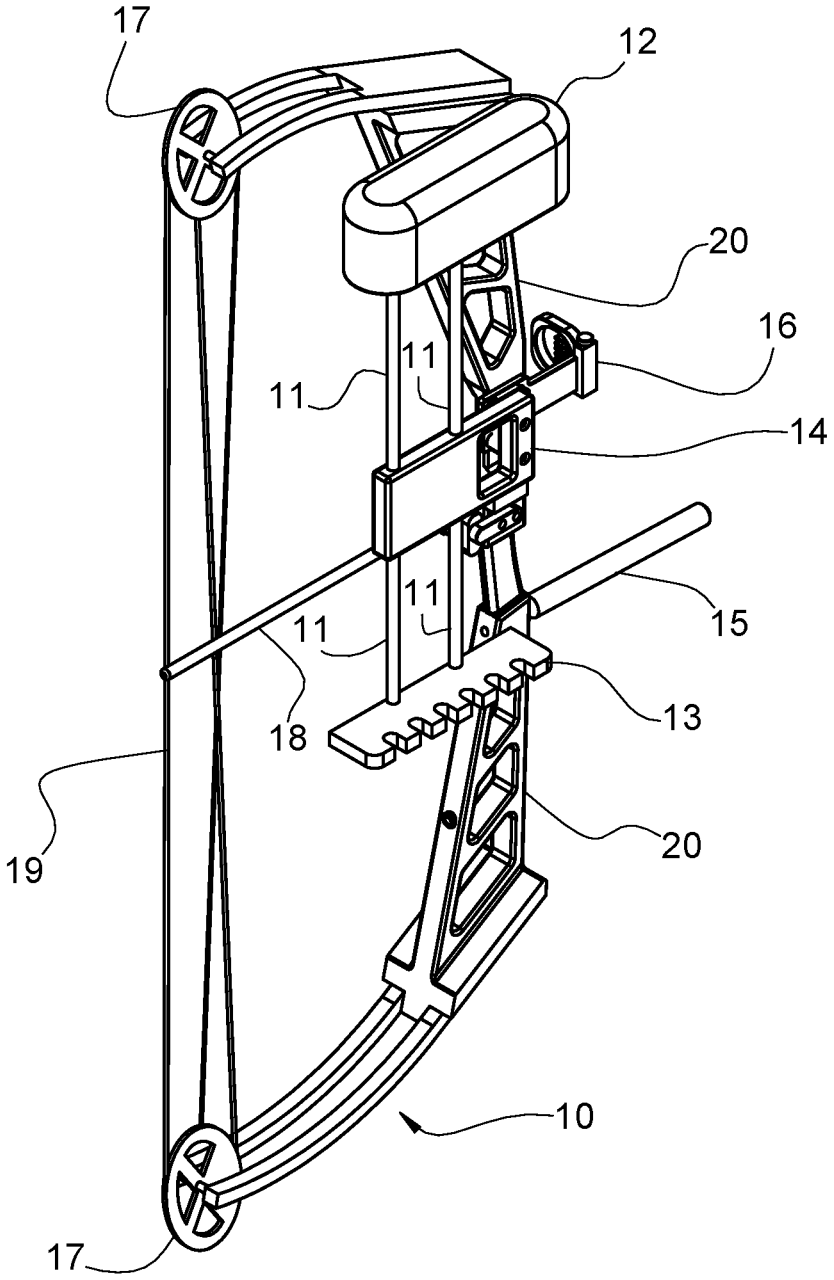
FIGURE 1 (PRIOR ART)
FIG. 1, FIG. 2 and FIG. 3 show a bow that includes various accessories in accordance with the prior art.
Figure 2:
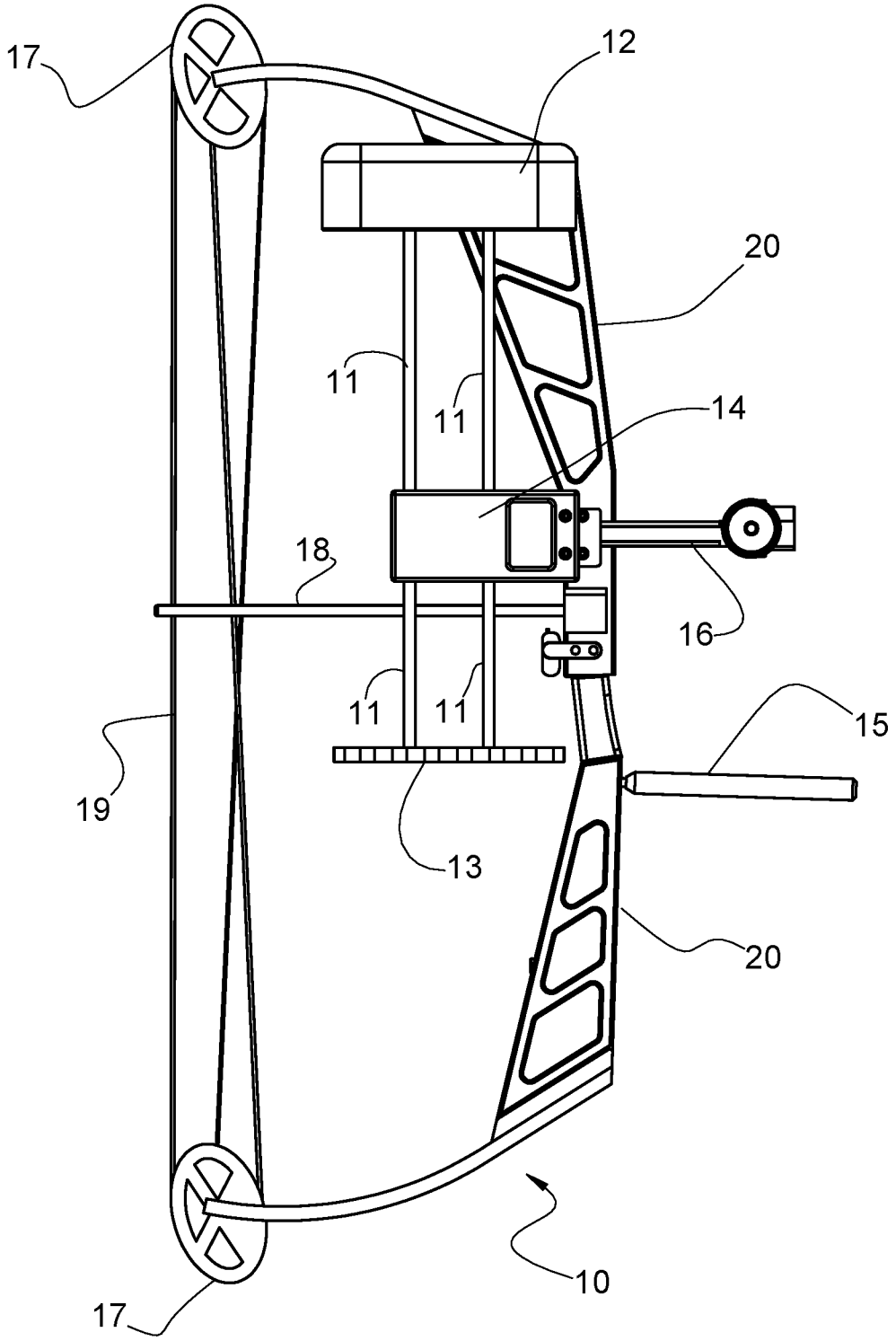
FIGURE 2 (PRIOR ART)

FIG. 1 and FIG. 2 show a bow 10 that is a bow assembly that includes a bow frame and various incorporated or attached parts and accessories. For example, a quiver includes a top structure 12, quiver support shafts 11, a quiver midsection 14 and quiver arrow retainer structure 13. For example, quiver arrow retainer structure 13 includes quiver retainers implemented using clips. A fixed pin sight 16 is attached to the bow frame. A stabilizer 15 is attached to a bow riser 20. Bow riser 20 forms the bow frame for the bow.

Cams 17 store energy in the limbs of the bow. Bow 10 include a bowstring 19. A cable guide 18 keeps the cables out of the path of the arrow. A stabilizer 15 is attached to one of bow riser 20.

Figure 3:
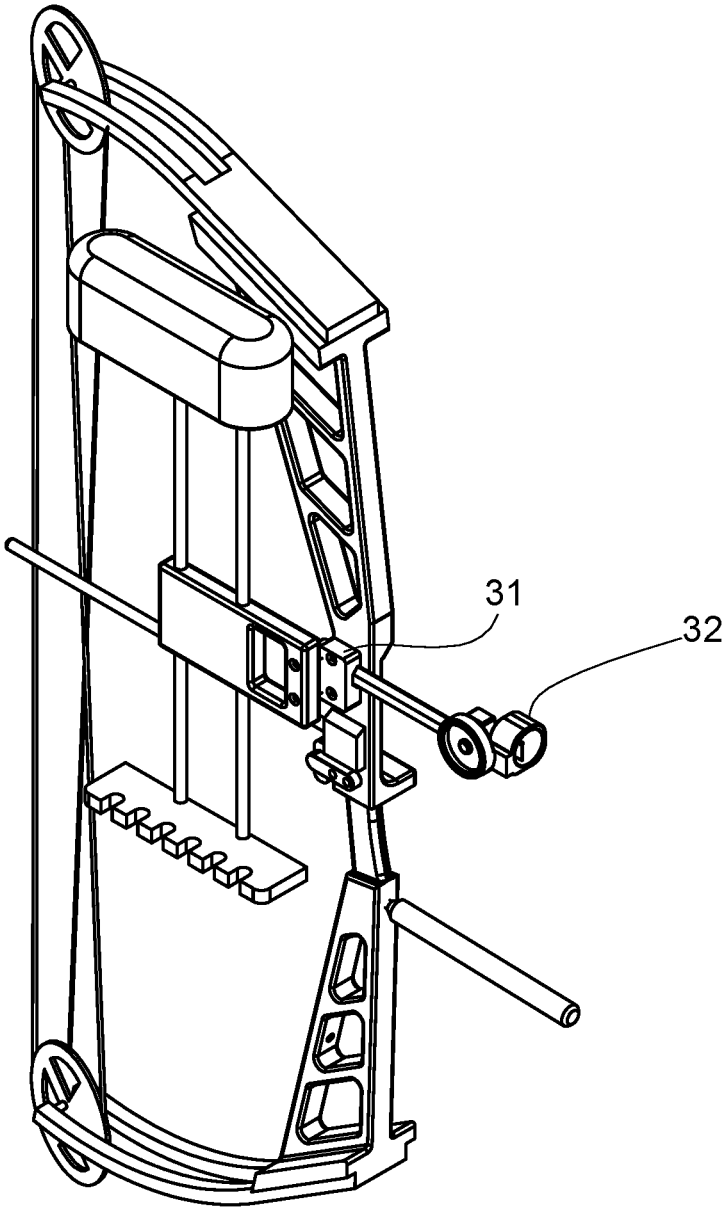
FIGURE 3 (PRIOR ART)

FIG. 3 shows a slightly different configuration of bow 10 where a fixed pin sight 16 has been replaced with an adjustable sight 32 attached to bow 10 using a dove tail sight mount 31.

Figure 4:
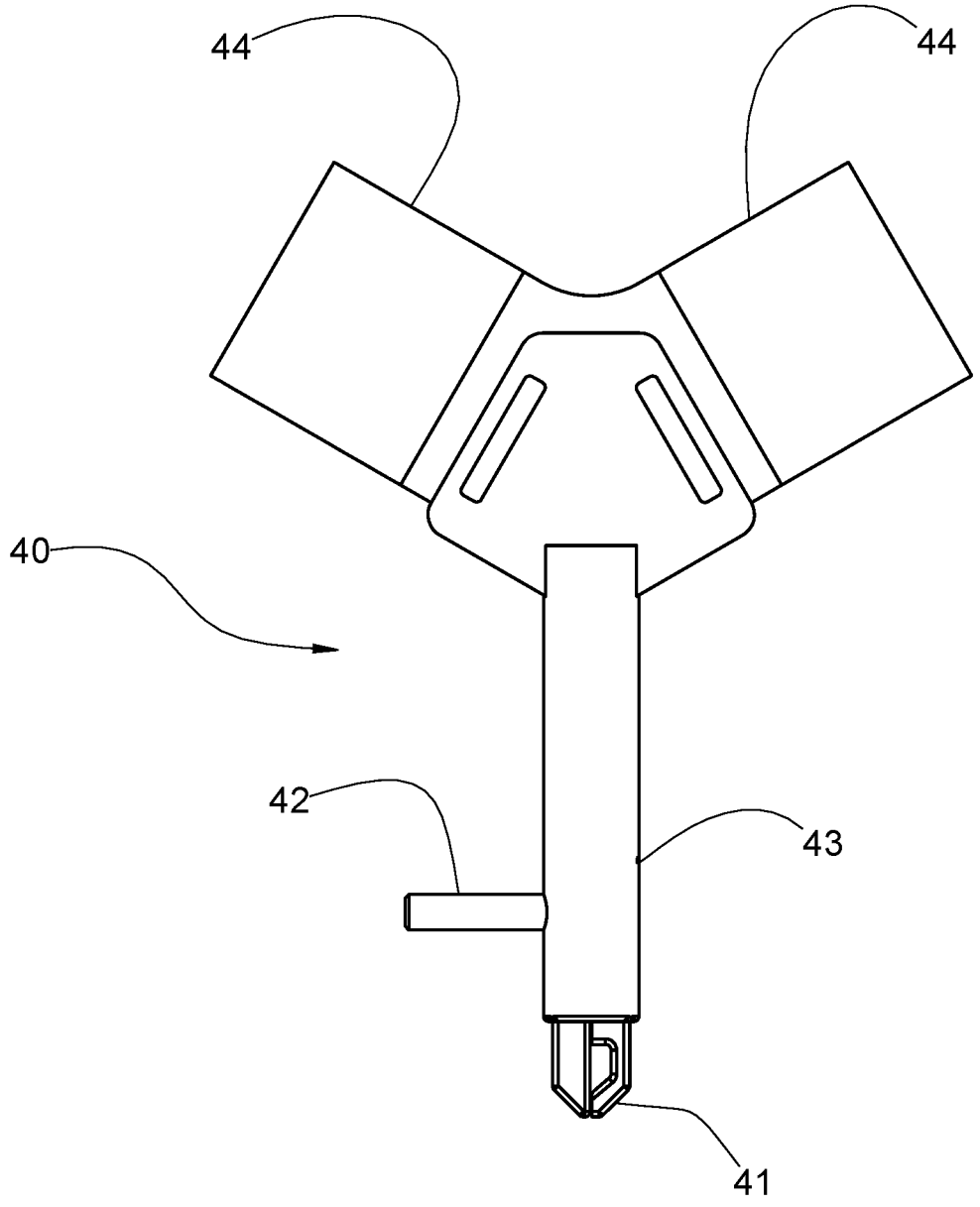
FIGURE 4 (PRIOR ART)
FIG. 4, FIG. 5, FIG. 6, FIG. 7, and FIG. 8 show archery release aids in accordance with the prior art.
Figure 5:
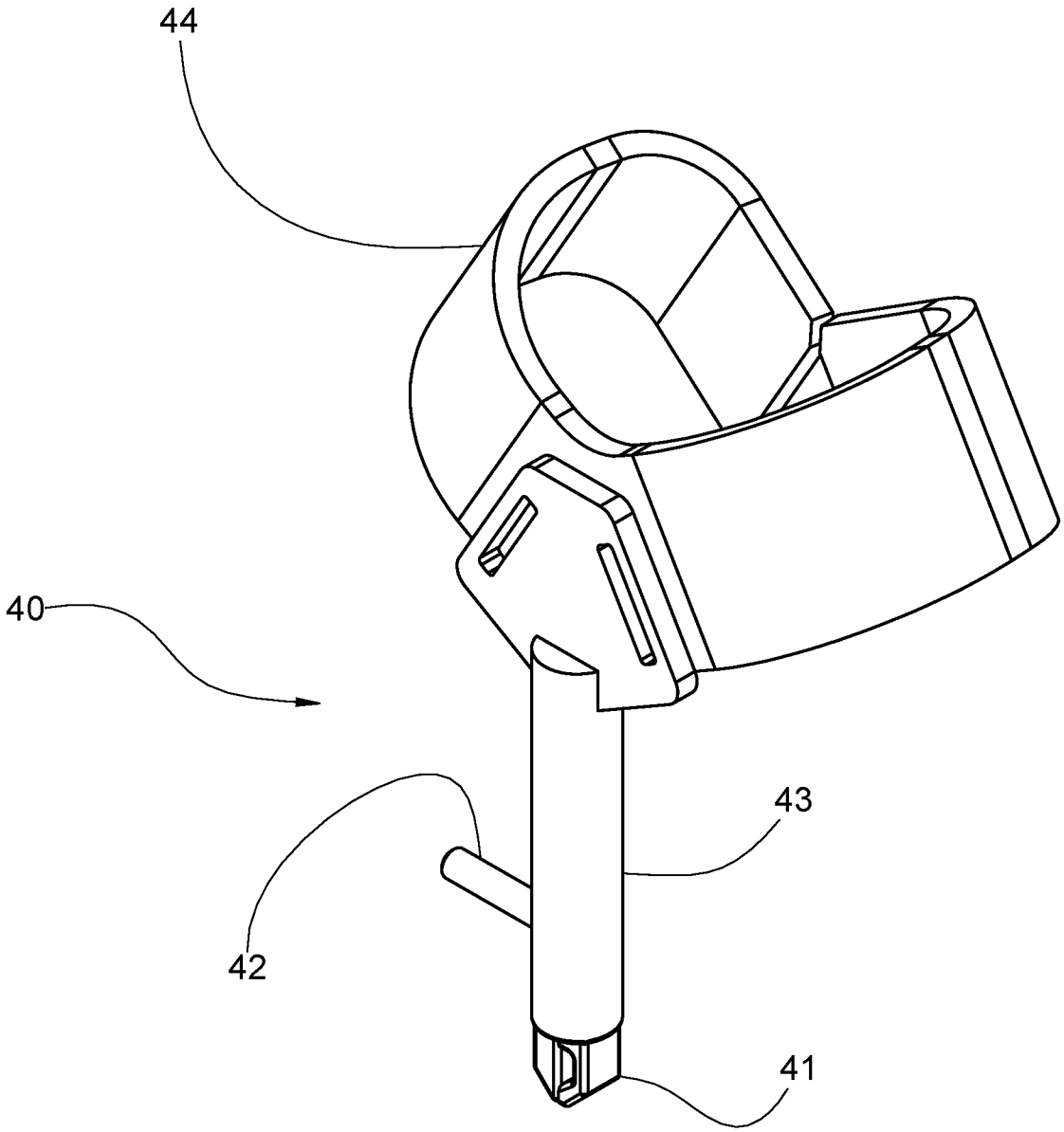
FIGURE 5 (PRIOR ART)

FIG. 4 and FIG. 5 show an archery release aid 40 that includes a wrist strap 44, a body 43, a trigger 42 and jaws 41. Jaws 41 are used for capturing bow string 19.

Figure 6:
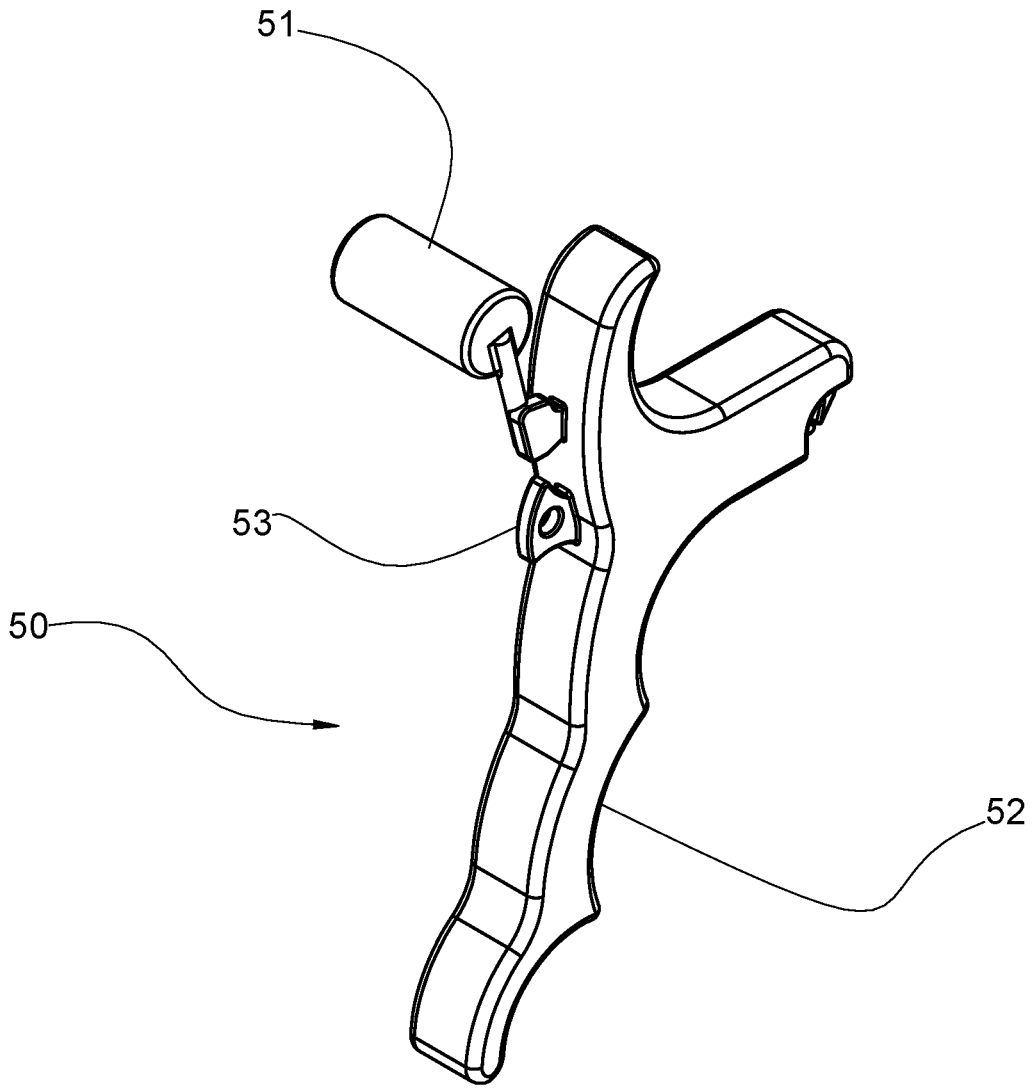
FIGURE 6 (PRIOR ART)
Figure 7:
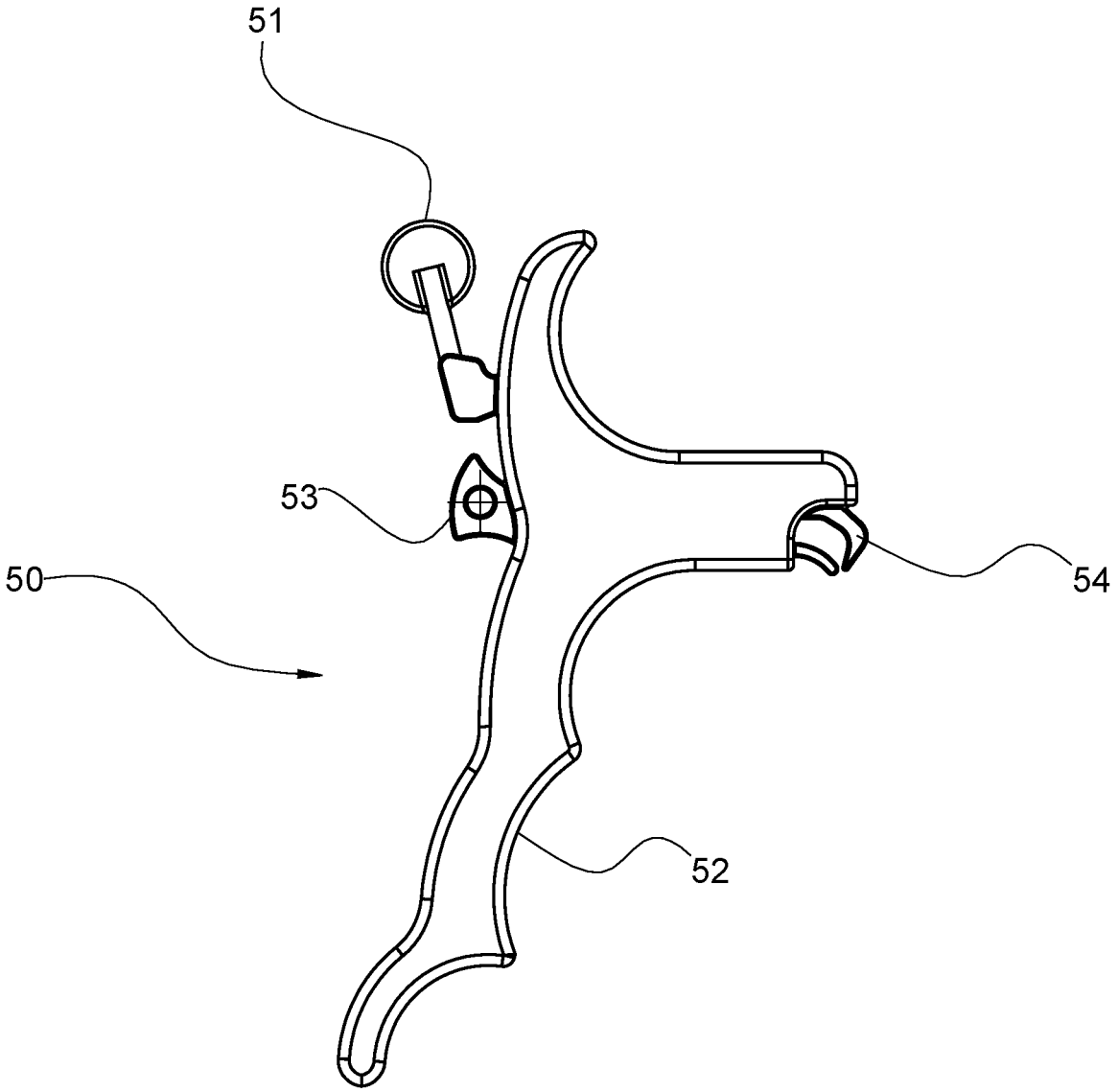
FIGURE 7 (PRIOR ART)
Figure 8:
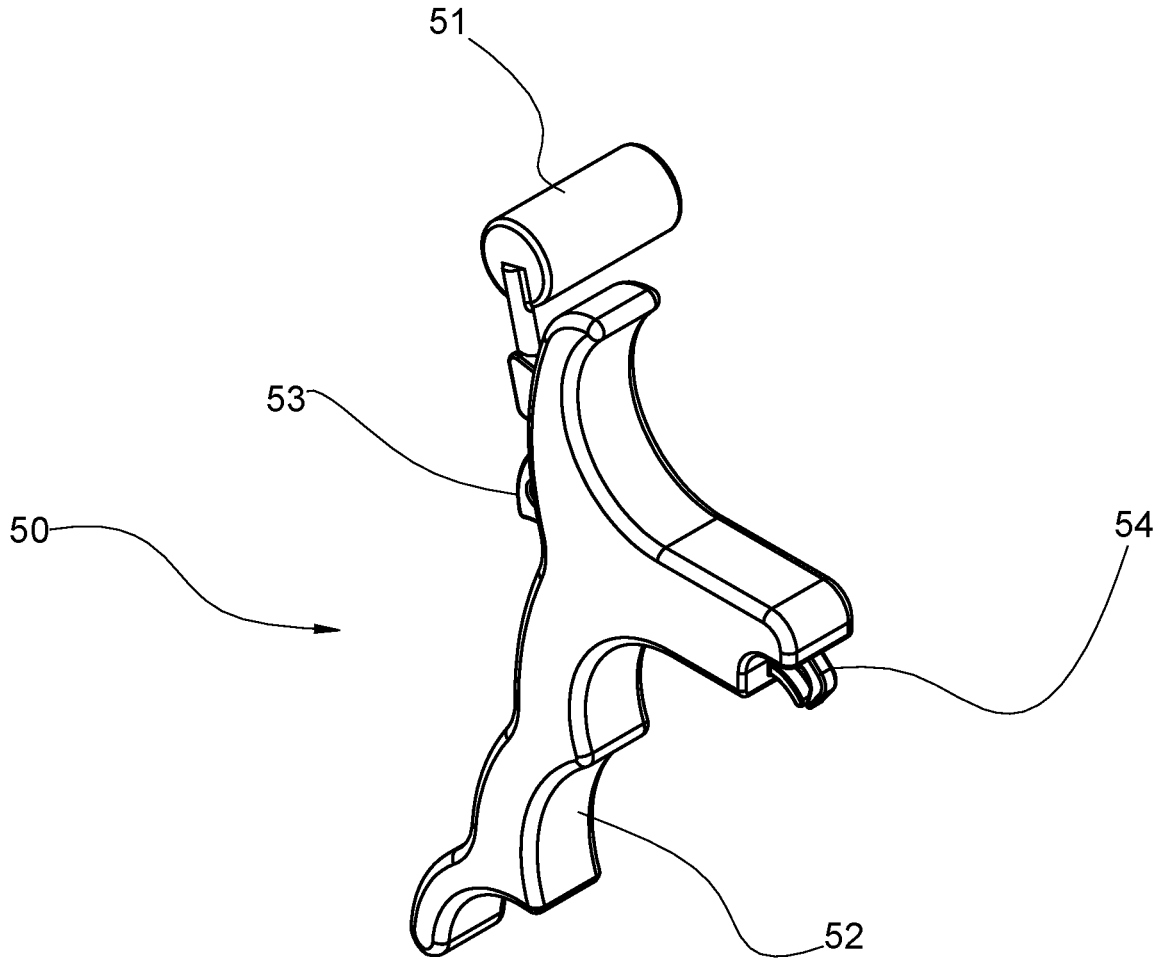
FIGURE 8 (PRIOR ART)

FIG. 6, FIG. 7 and FIG. 8 show an archery release aid 50 that includes a thumb trigger 51, a mechanical reset 53, a structure 52 with contours for fingers 52 and jaws 54 that are used to capture bow string 19.

Figure 9:
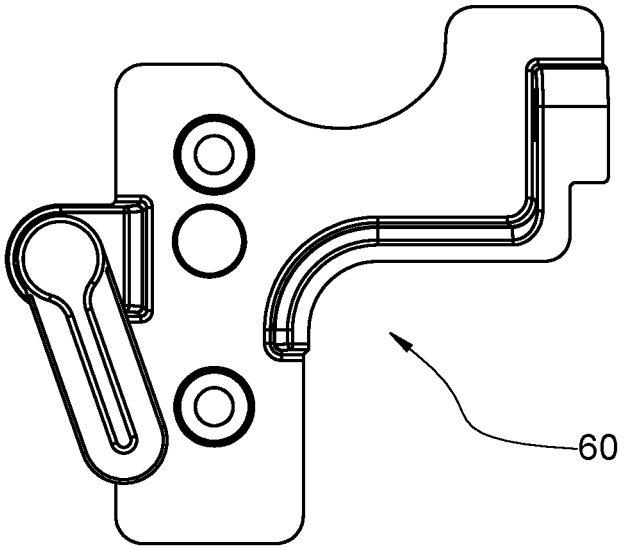
FIG. 9, FIG. 10, FIG. 11, FIG. 12, FIG. 13, FIG. 14 and FIG. 15 show archery release aid mounts in accordance with preferred implementations.

FIG. 9 shows an archery release aid mount 60 optimized to hold a Carter/nockon Silverback backtension archery release aid available from Nock on Archery and is manufactured by Carter enterprises.

Figure 10:
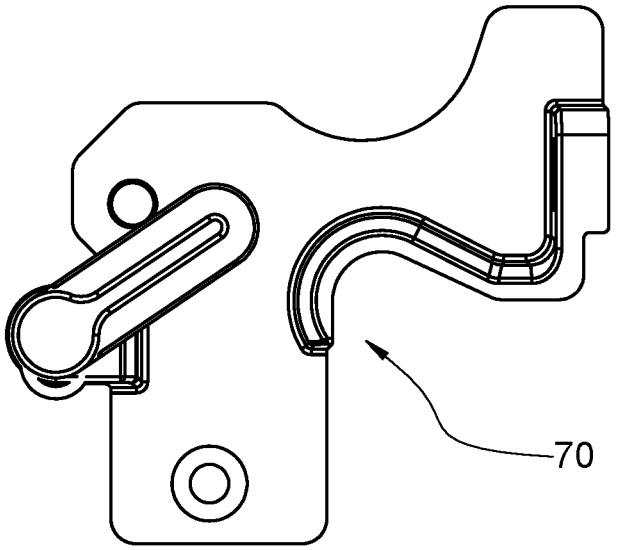

FIG. 10 shows an archery release aid mount 70 optimized to hold a Carter "Nock 2it" archery release aid available from Nock on Archery and manufactured by Carter enterprises.

Figure 11:
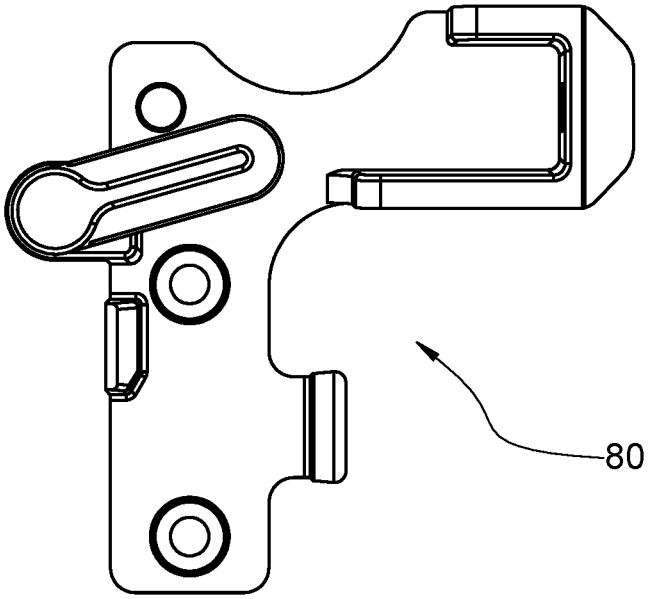

FIG. 11 shows an archery release aid mount 80 optimized to hold a Stan PerfX archery release aid available from Stanislawski Archery Products.

Figure 12:
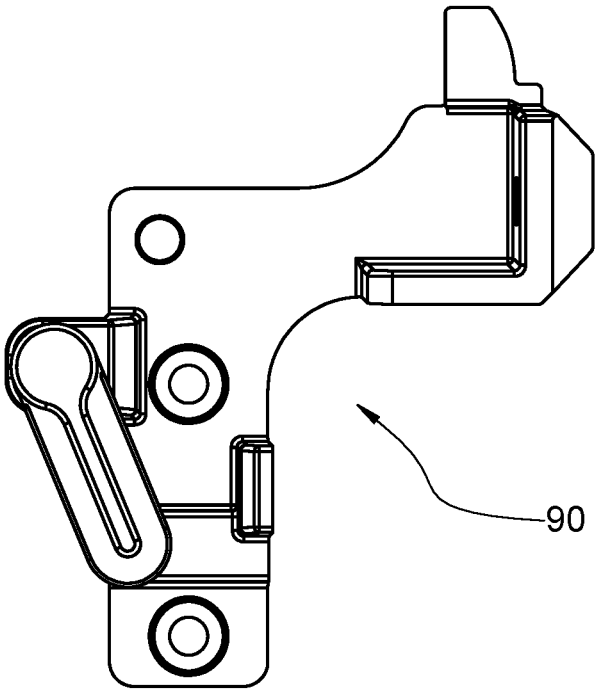

FIG. 12 shows an archery release aid mount 90 optimized to hold a Scott Sigma Release available from Scott Archery.

Figure 13:
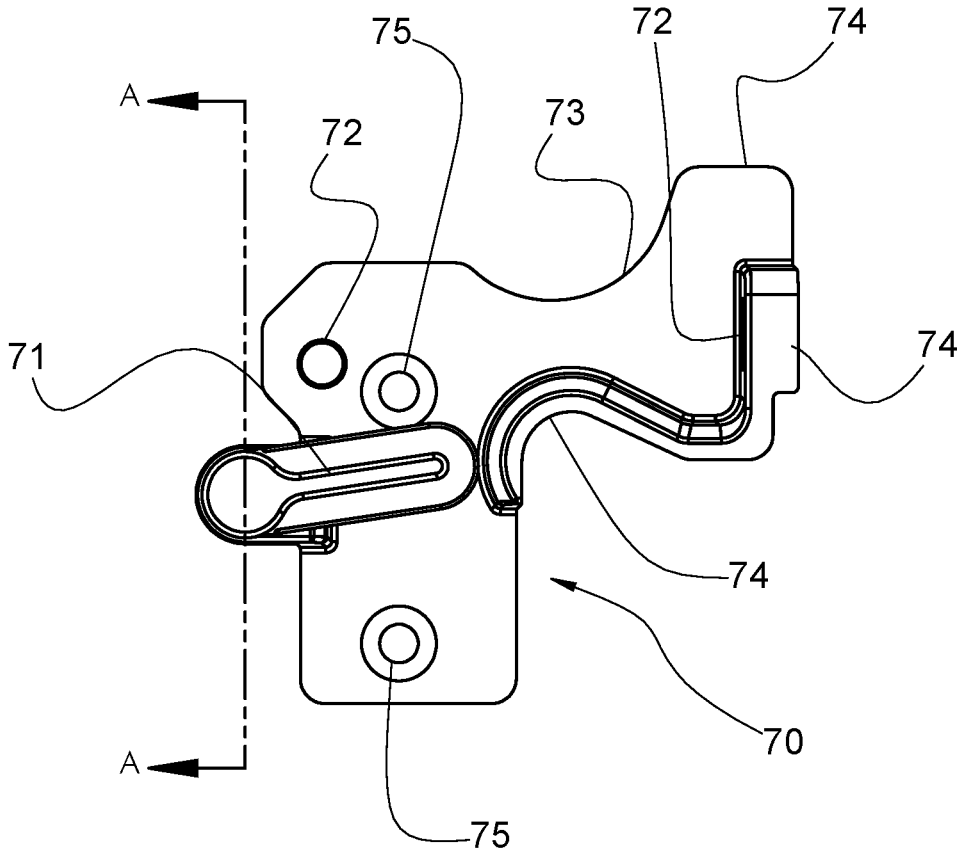
Figure 14:
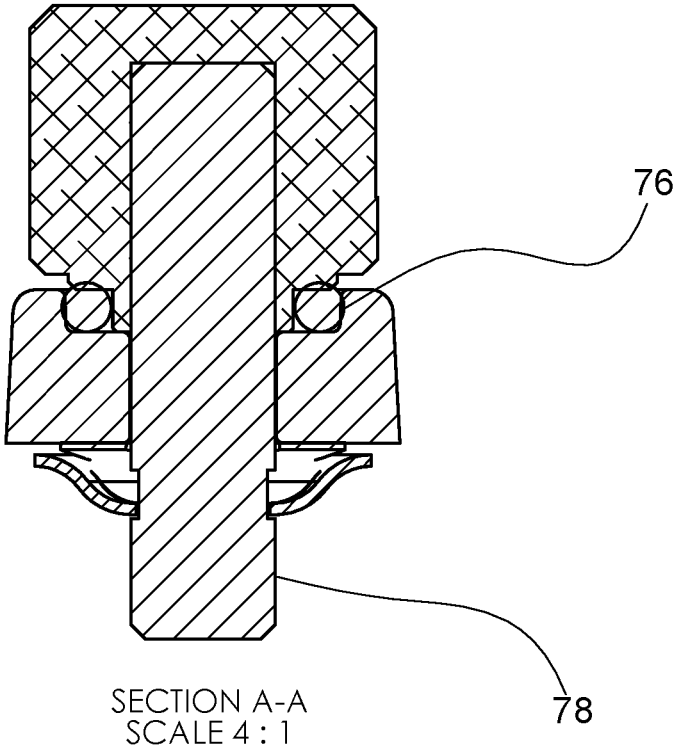
Figure 15:
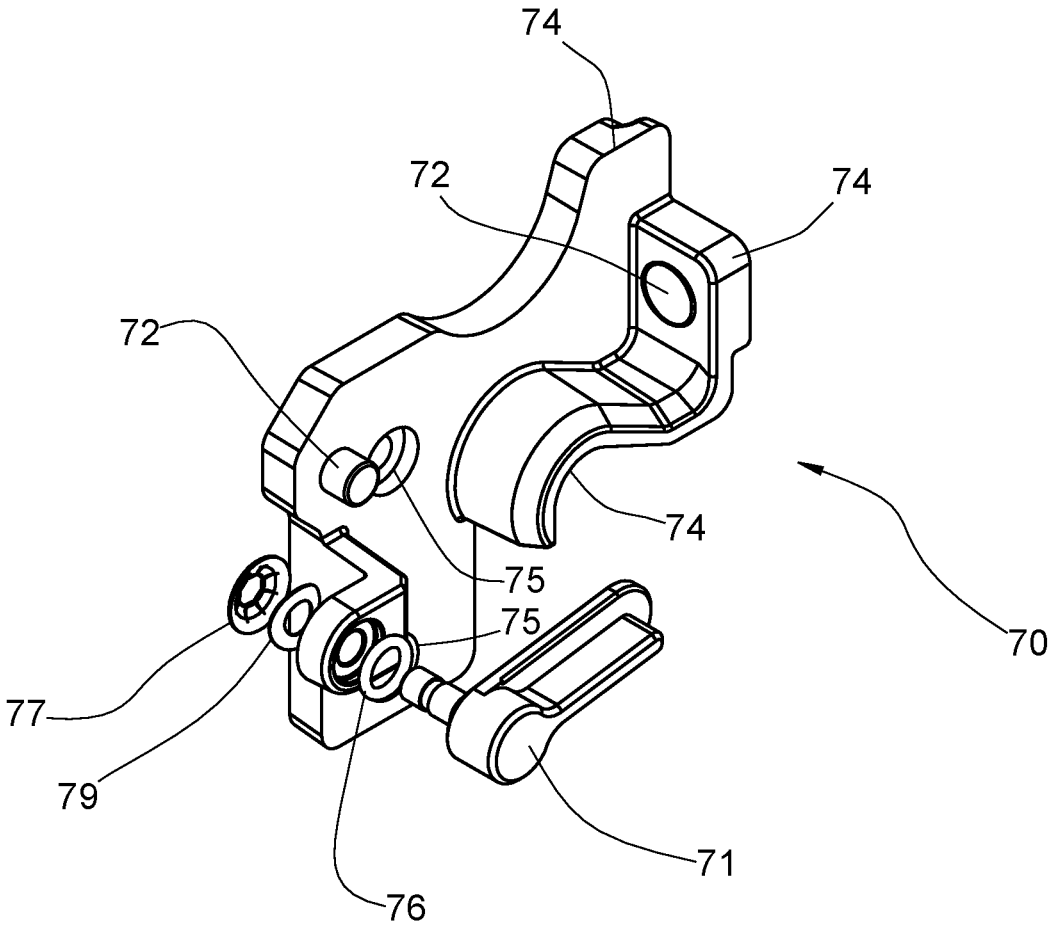

FIG. 13, FIG. 14 and FIG. 15 show that archery release aid mount 70 includes a locking lever 71 with a tab 78, magnets 72, a structure 74 with hand clearance area 73, mounting holes 75, an O-ring 76, a spring washer 79 and a retaining ring 77 that fastens onto rod 78. As illustrated by FIG. 14, O ring 76 creates friction to keep tab 78 in position. Locking lever 71 and magnets 72 serve as securing devices of a mounting mechanisms that upon the archery release aid mount 70 receiving an archery release aid, hold the archery release aid securely, and that is configured to allow a user to without tools remove the archery release aid from archery release aid mount 70 when the user wants to use the archery release aid during archery.

Figure 16:
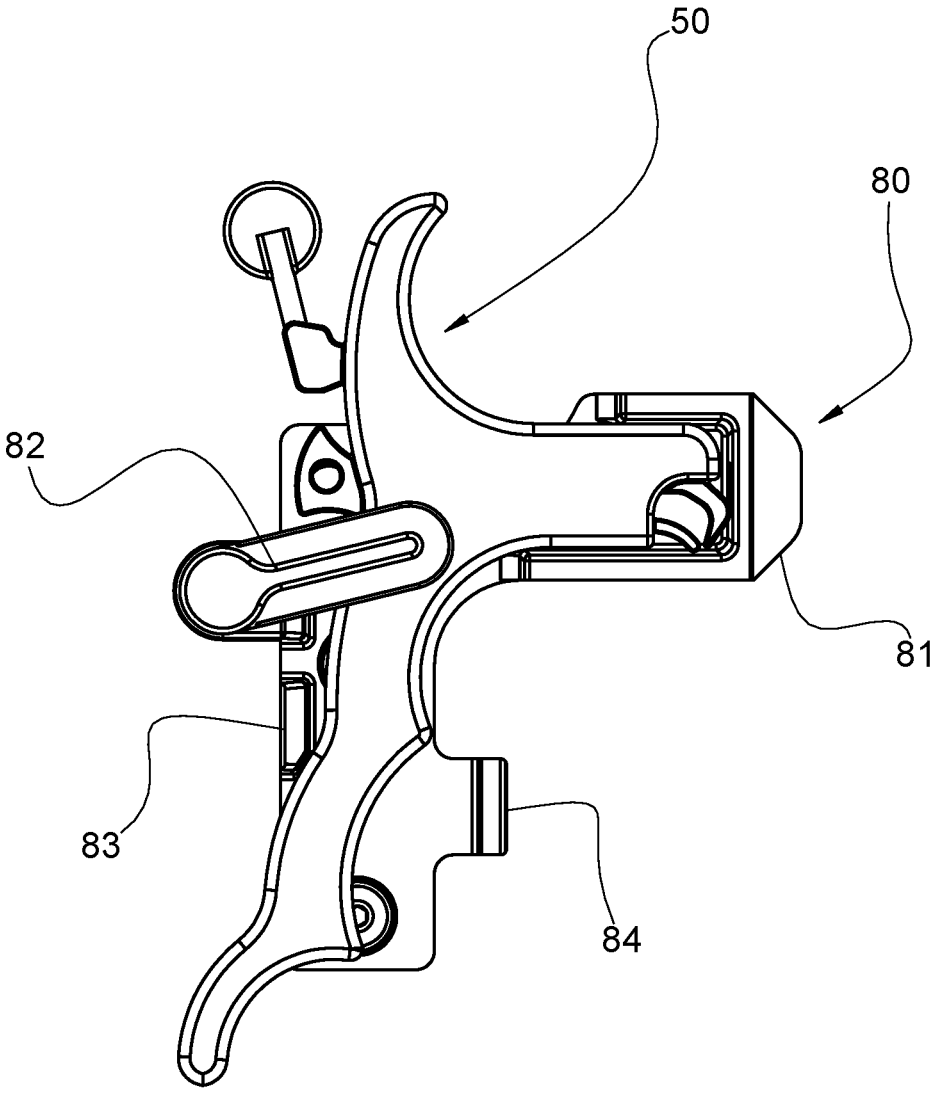
FIG. 16 and FIG. 17 show an archery release aid stored within an archery release aid mount in accordance with an implementation.
Figure 17:
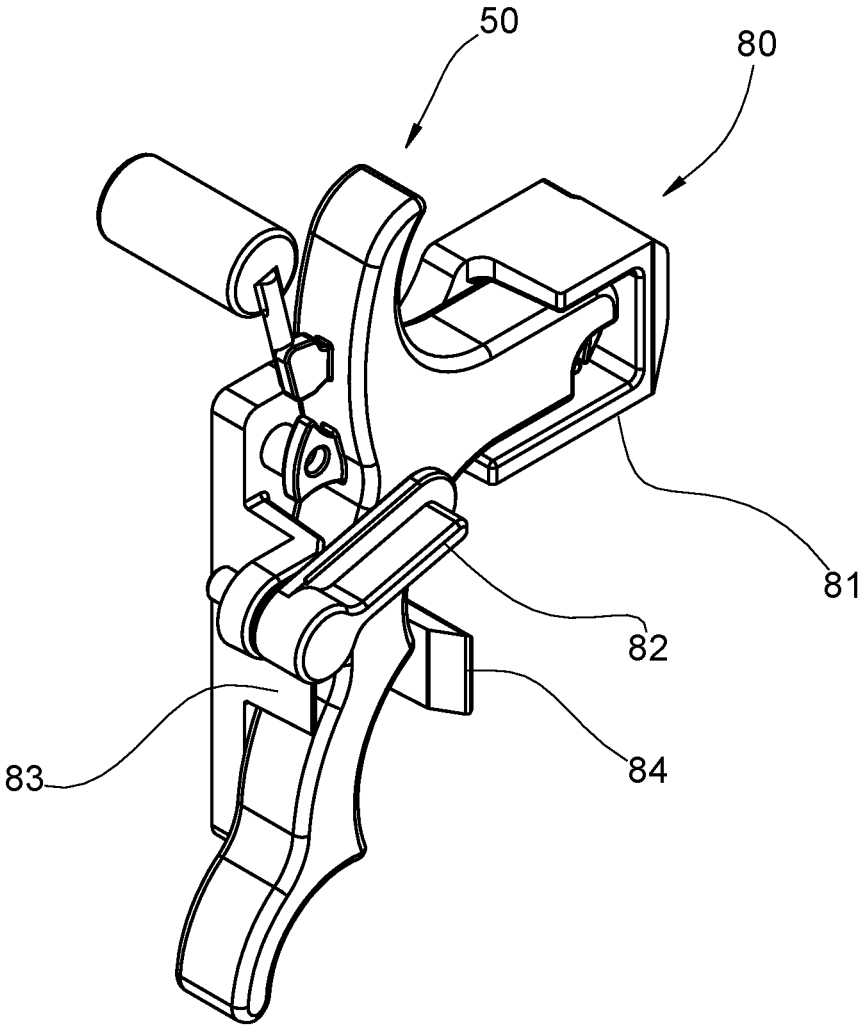
Figure 18:
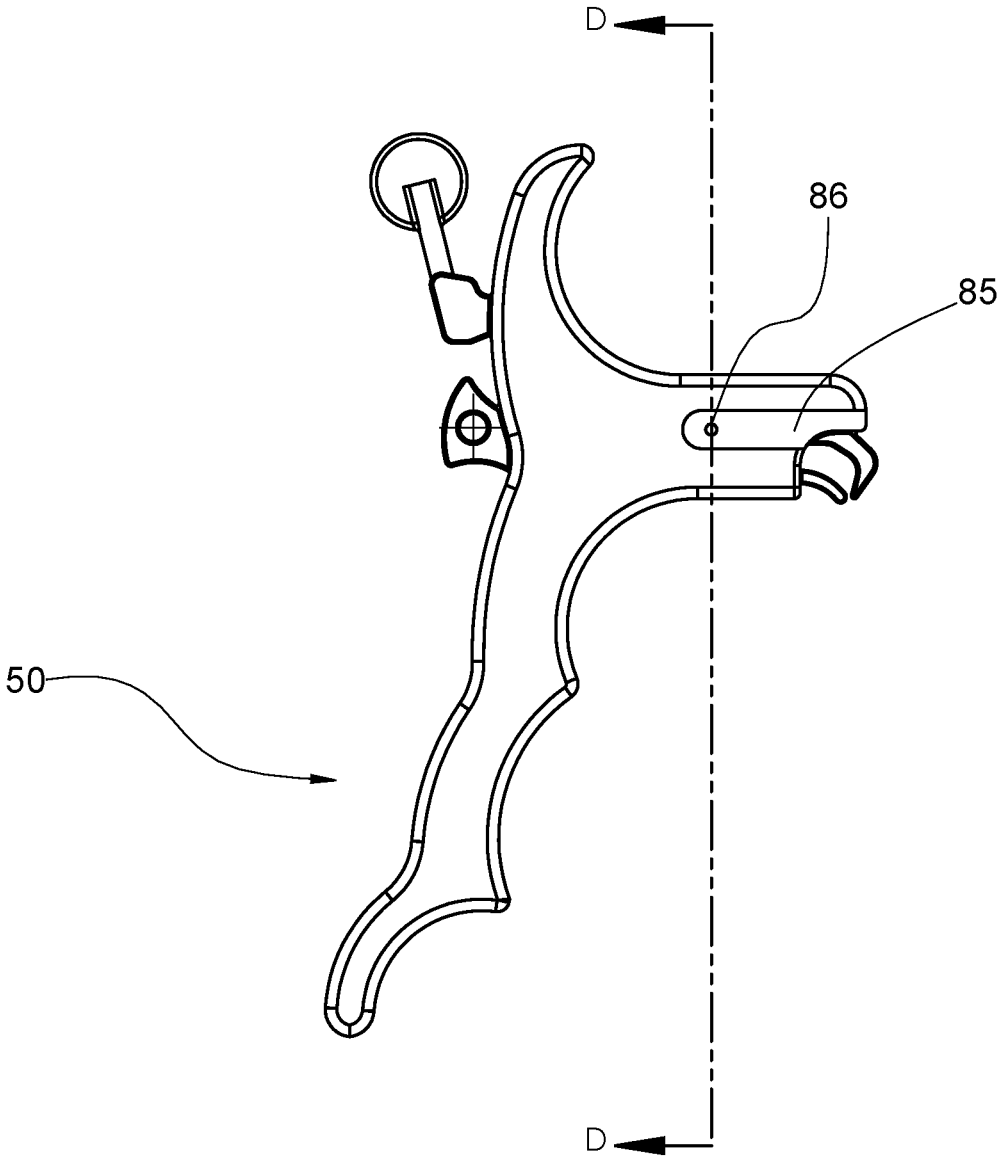
FIG. 18, FIG. 19, FIG. 20 and FIG. 21 shows an archery release aid modified to be better stored within an archery release aid mount in accordance with an implementation.
Figure 19:
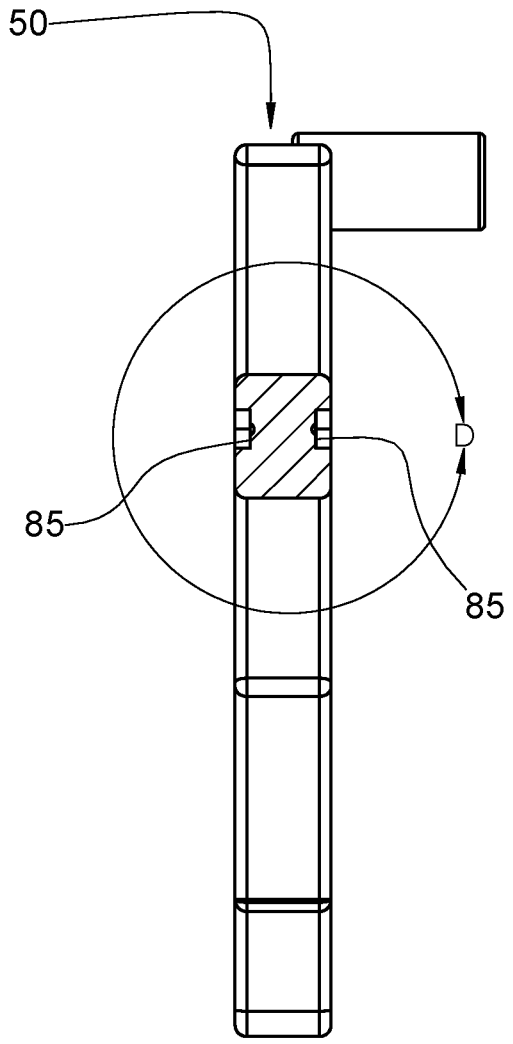
Figure 20:
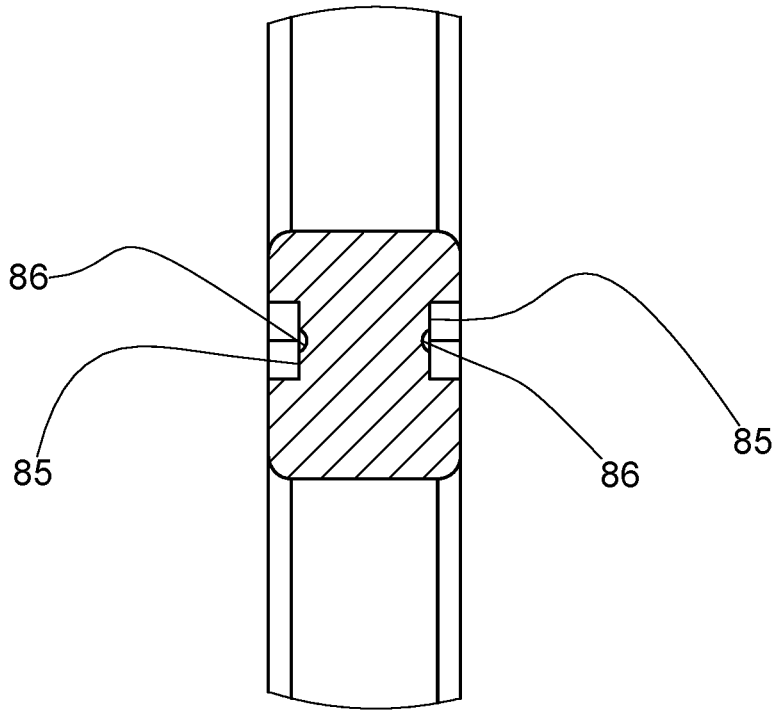
Figure 21:
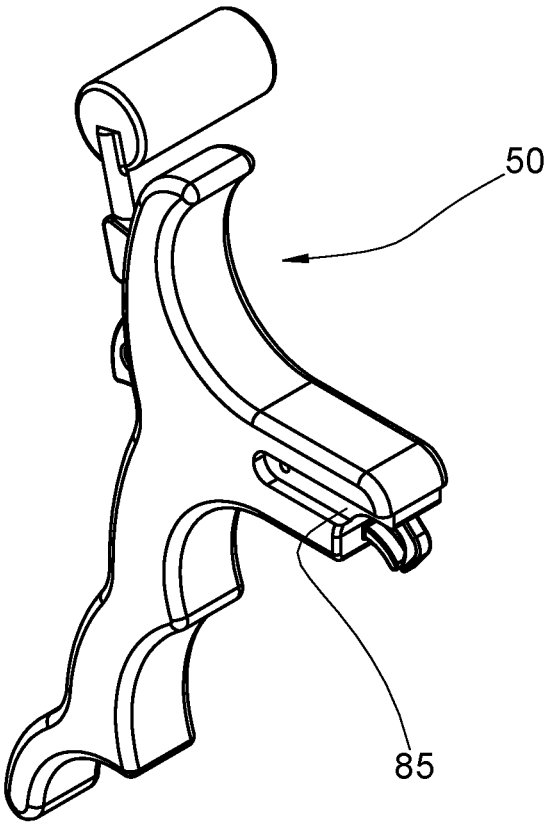
Figure 22:
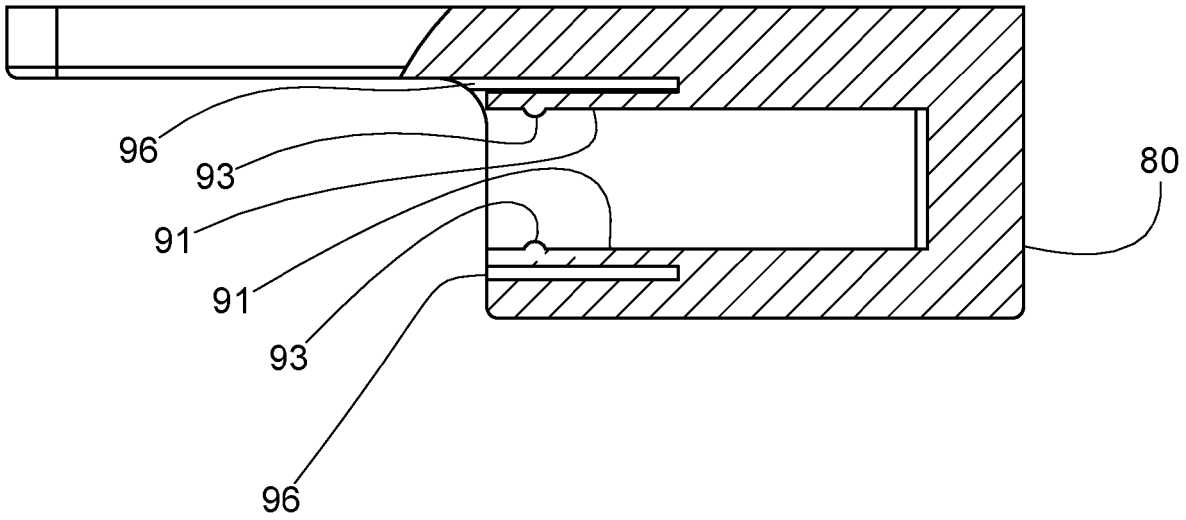
FIG. 22, FIG. 23, FIG. 24, FIG. 25, FIG. 26, FIG. 27 and FIG. 28 show modification to archery release aid mounts to better hold archery release aids in accordance with preferred implementations.
Figure 23:
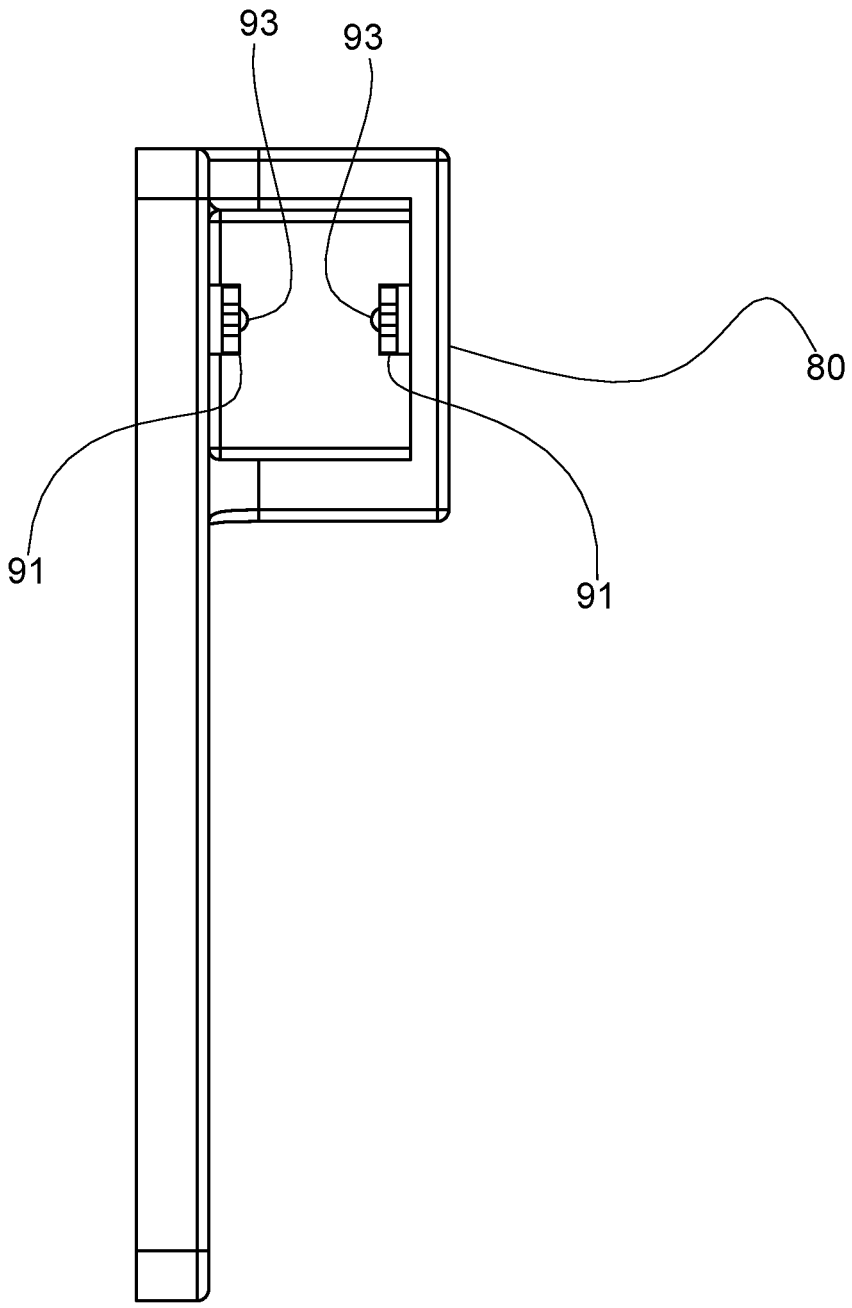
Figure 24:
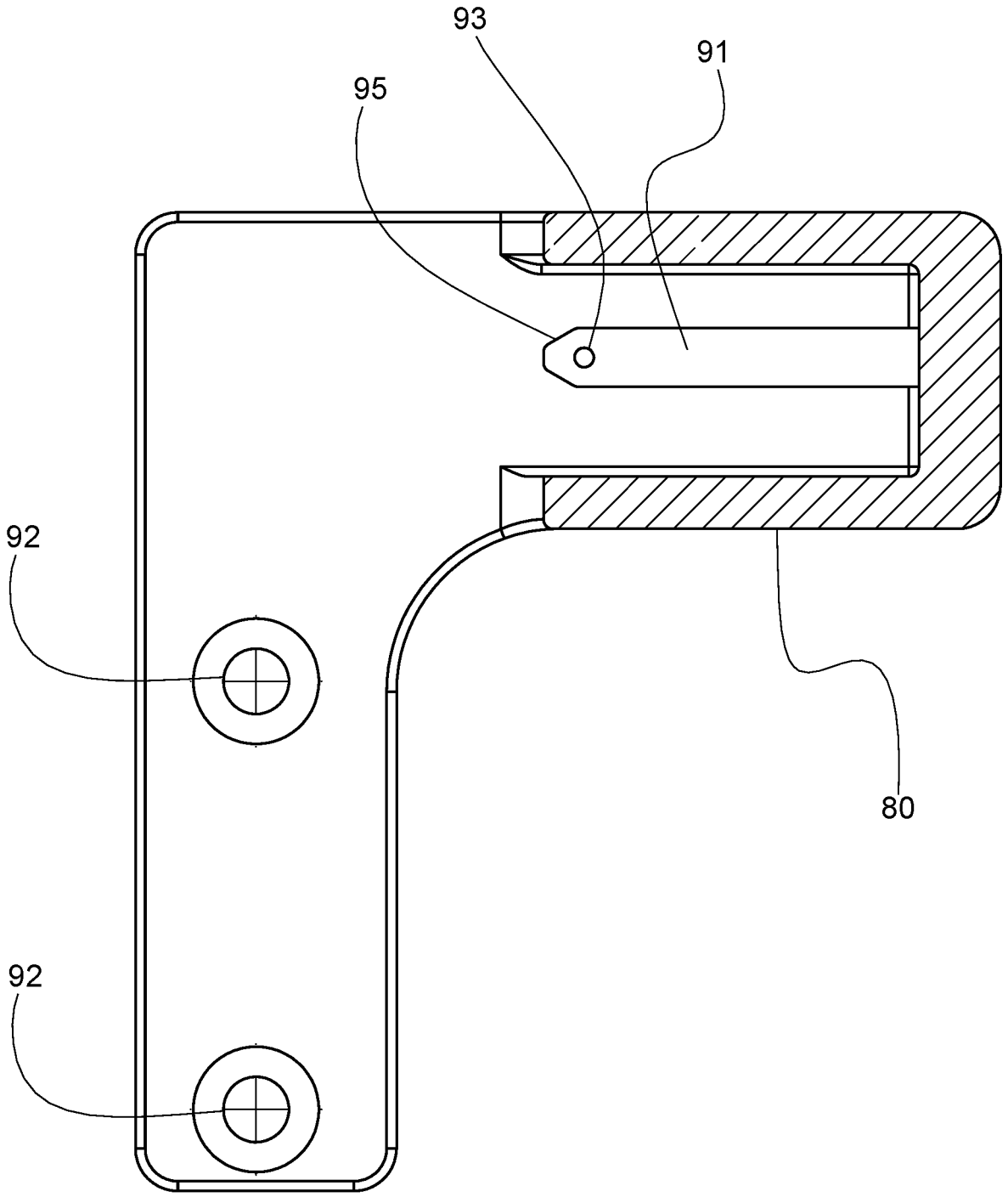
Figure 25:
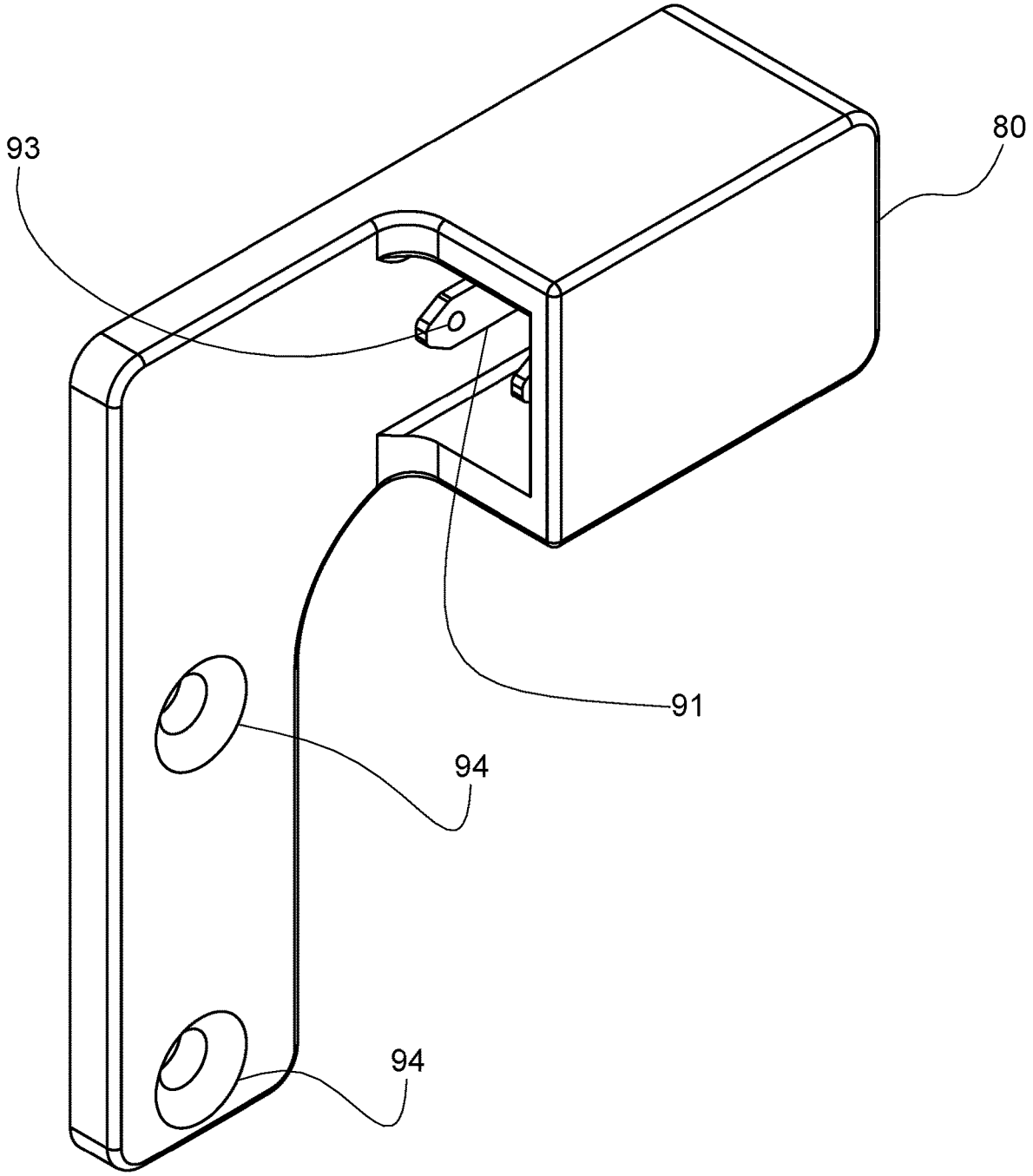

FIG. 16 and FIG. 17 show archery release aid 50 mounted within archery release aid mount 80. A lever 82 keeps archery release aid securely held within structure 81 of archery release aid mount 80. In various embodiments, changes can be made to archery release aid mount 80 to accommodate configuration changes to archery release aid mount 50. For example, lever 82 can be designed to lock in an open or a closed position. A tab 83 and a tab 84 can also be designed to adjust locations to accommodate configuration changes to archery release aid mount 50.

FIG. 18, FIG. 19, FIG. 20 and FIG. 21 show grooves 85 added to one or both sides of archery release aid 50. Grooves 85 are used to interface with archery release aid mount 80 to create a solid but easily removable mounting feature. Additionally, spherical indentations 86 can be added to interface with a spherical protrusions in archery release aid mount 80. This allows archery release aid mount 80 to hold securely archery release aid 50 while also allow a user to easily remove archery release aid 50 from archery release aid mount 80.

FIG. 22, FIG. 23, FIG. 24, and FIG. 25 show archery release aid mount 80 configured to include protrusions 91 and spherical protrusions 93. Protrusions s 91 are sized to fit within grooves 85 of archery release aid 50. Spherical protrusions 93 are sized to fit within spherical indentations 86. A relief area 96 behind protrusions s 91 allow deflection so that spherical protrusions lock in place within spherical indentions 86. Tapers 95 at the end of protrusions 91 aid alignment when placing archery release aid 50 within archery release aid mount 80. Screw holes 94, shaped to receive screws 92, are used to attached archery release aid mount 80 to a bow. Protrusions 91 and spherical protrusions 93 serve as securing devices of a mounting mechanisms that upon the archery release aid mount 80 receiving an archery release aid, hold the archery release aid securely, and that is configured to allow a user to without tools remove the archery release aid from archery release aid mount 80 when the user wants to use the archery release aid during archery.

Figure 26:
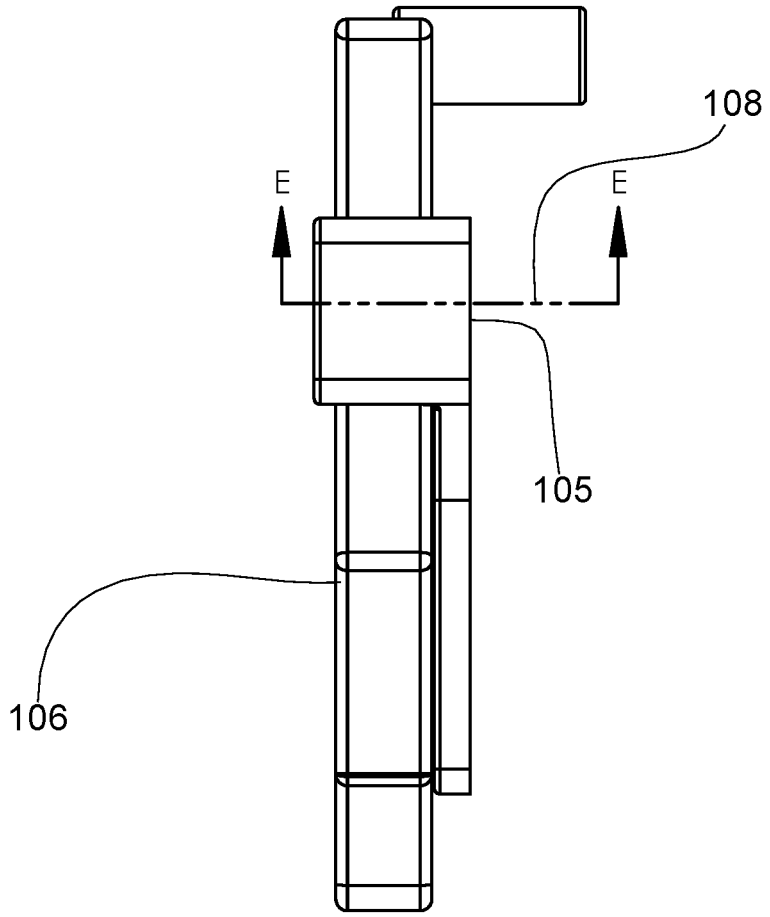
Figure 27:
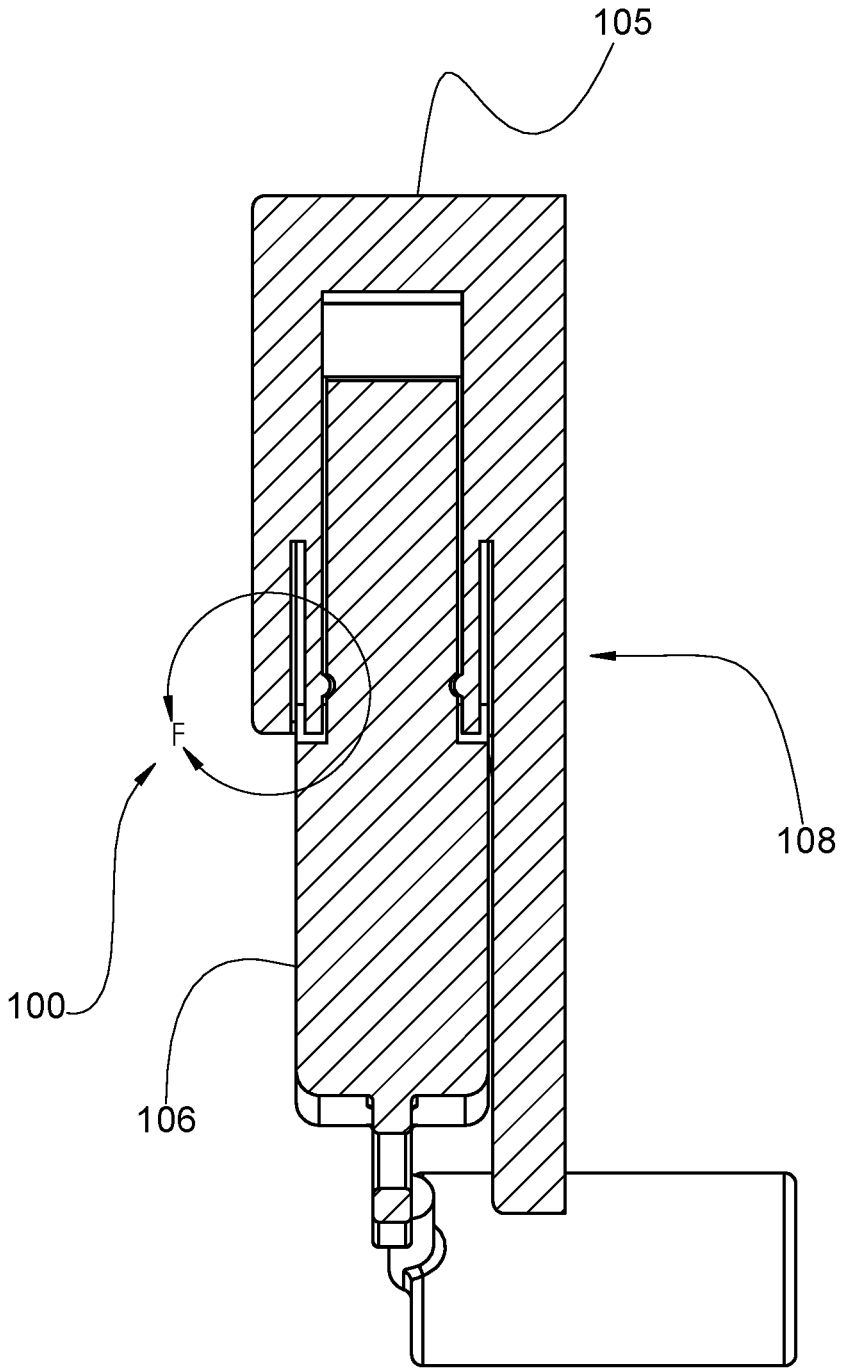
Figure 28:
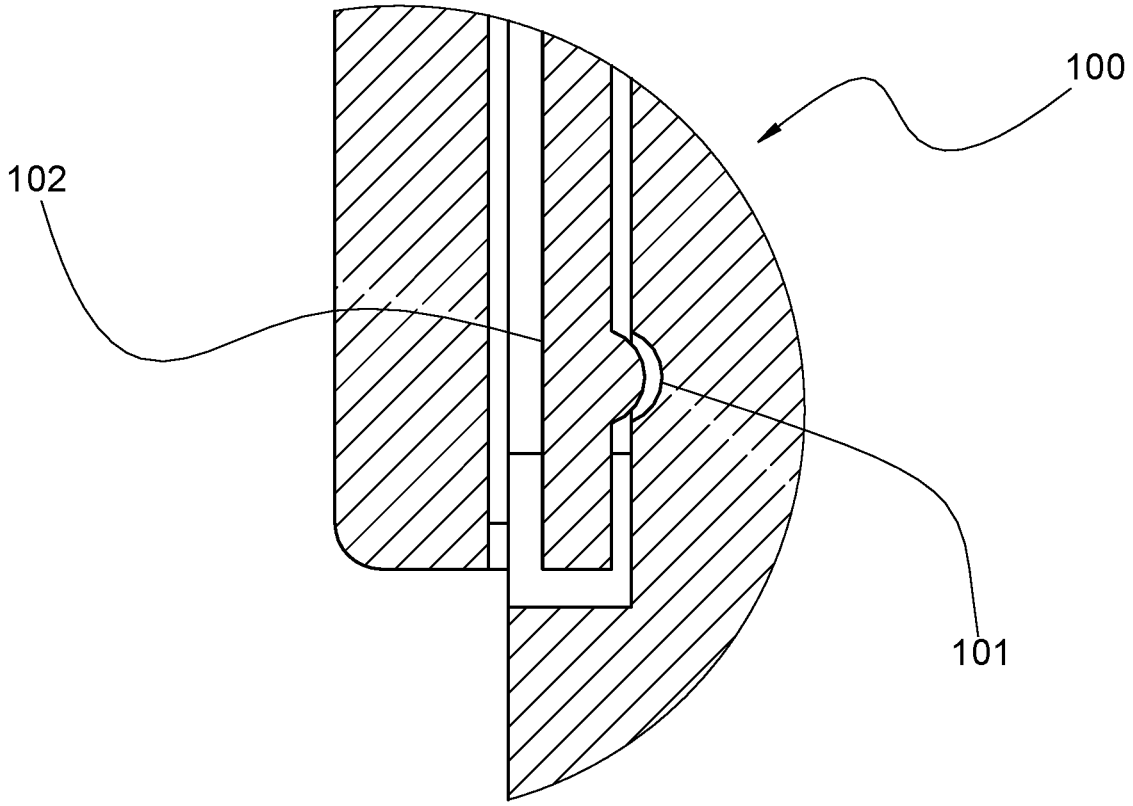

FIG. 26 shows an archery release aid 106 held by an archery release aid mount 105. FIG. 27 shows a cross section 108 of archery release aid 106 and archery release aid mount 105. FIG. 28 shows a close up section 100 of cross section 108. A flange 102 has a ball and socket détente interface which secures archery release aid 106 to archery release aid mount 105, but allows archery release aid 106 to be easily removed from archery release aid mount 105 by the user. The ball and socket détente interface serves as a securing device of a mounting mechanisms that upon the archery release aid mount 106 receiving an archery release aid, holds the archery release aid securely, and that is configured to allow a user to without tools remove the archery release aid from archery release aid mount 106 when the user wants to use the archery release aid during archery.

Figure 29:
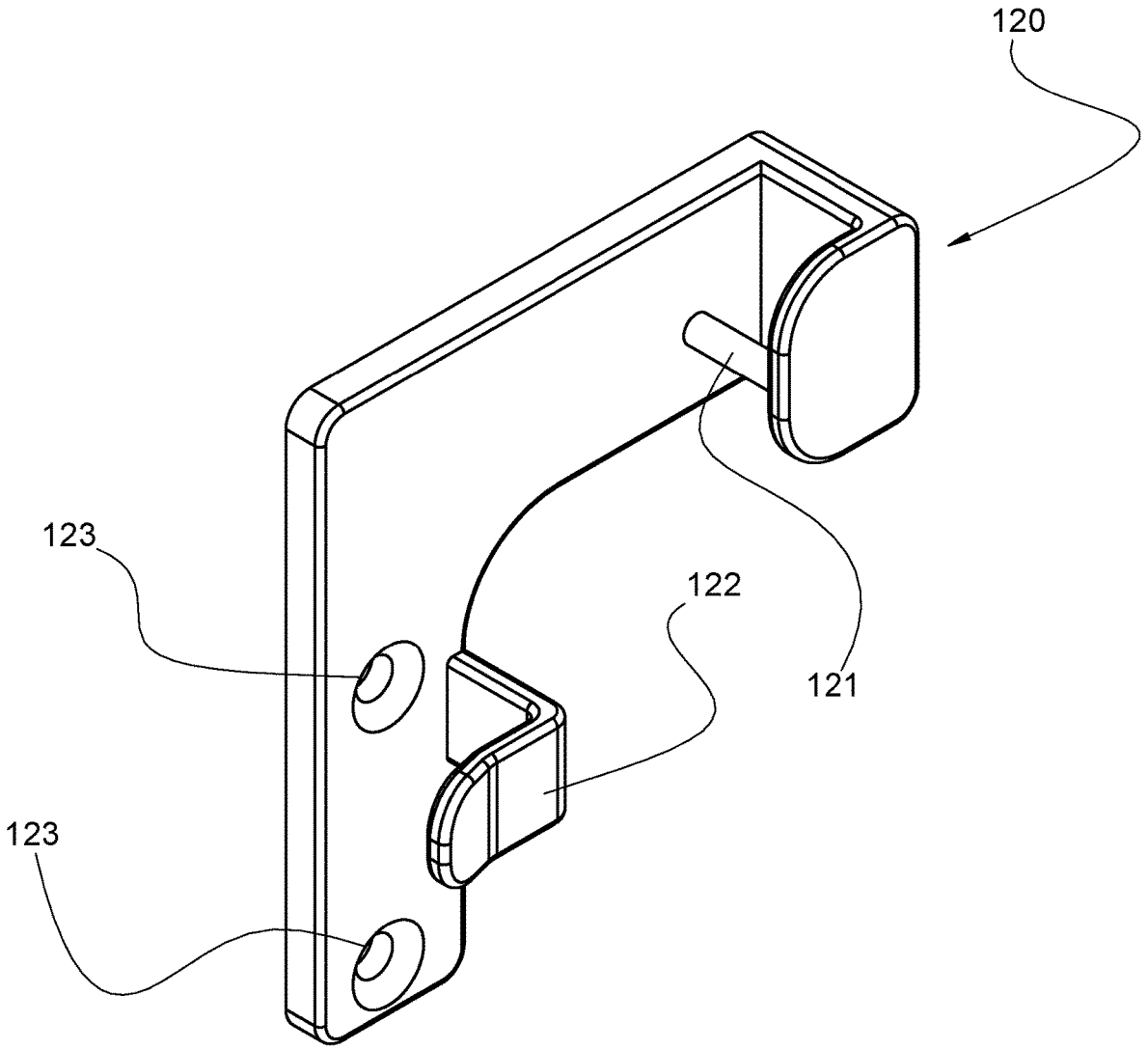
FIG. 29, FIG. 30, FIG. 31, FIG. 32, FIG. 33, FIG. 34, FIG. 35, FIG. 35A and FIG. 36 show additional archery release aid mounts in accordance with preferred implementations.

FIG. 29 shows an archery release aid mount 120 that includes a thin cylinder 121. Cylinder 121 can be composed of, for example, rope, plastic metal or another material that can be shaped to simulate a bow string. An archery release aid is attached to cylinder 121 in that same way the archery release aid is attached to a bow string. This allows a simple way to retain the archery release aid attached to archery release aid mount 120. An additional feature 122 is used to hold another part of the archery release aid to reduce movement when attached to archery release aid mount. For example, additional feature 122 is a spring loaded tab. Screw holes 123 are used to attached archery release aid mount 120 to a bow. Thin cylinder 121 and additional feature 122 serve as securing devices of a mounting mechanisms that upon the archery release aid mount 120 receiving an archery release aid, hold the archery release aid securely, and that is configured to allow a user to without tools remove the archery release aid from archery release aid mount 120 when the user wants to use the archery release aid during archery.

Figure 30:
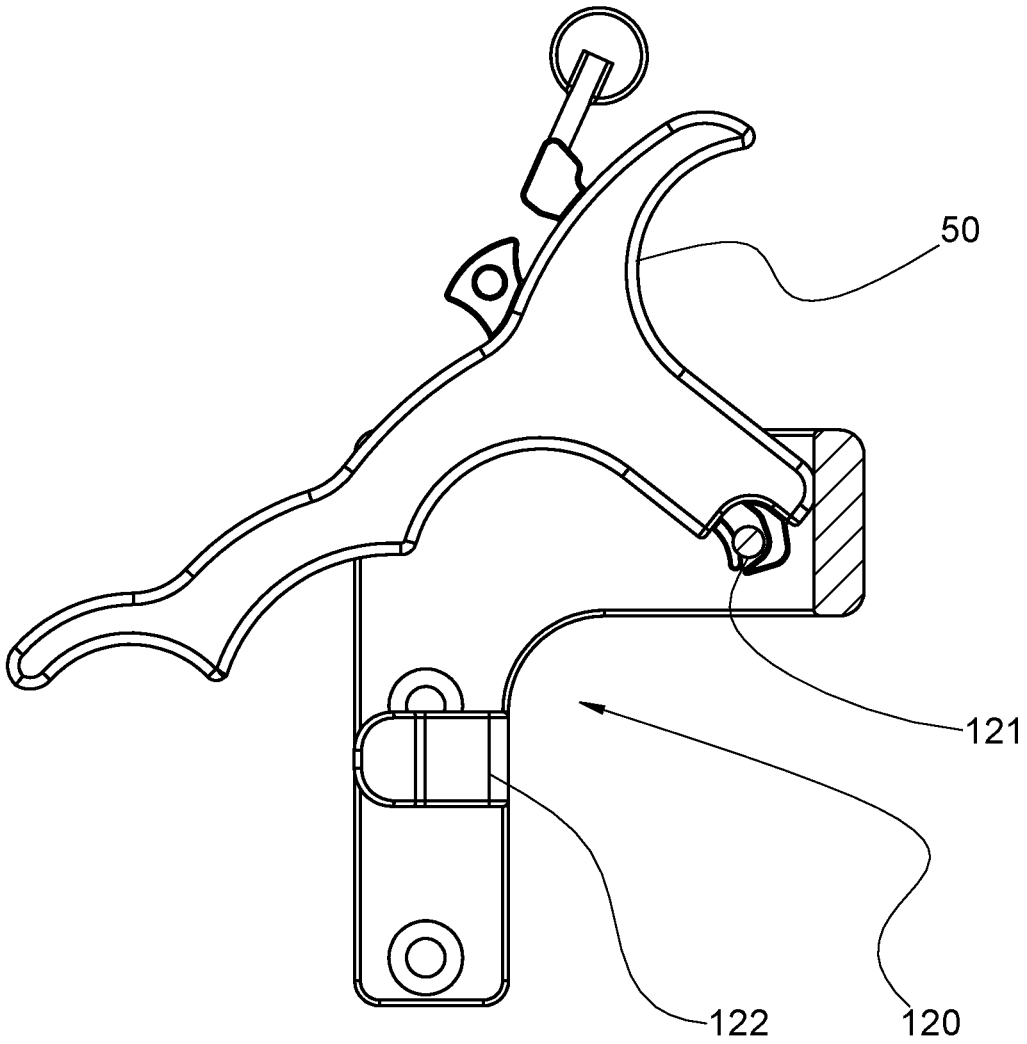
Figure 31:
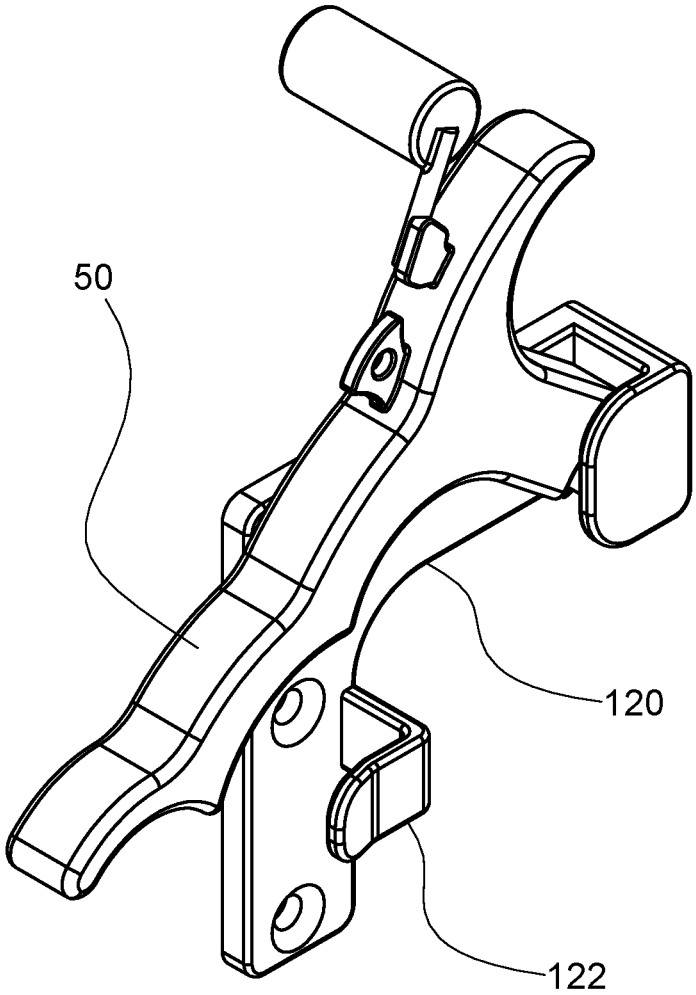

FIG. 30 and FIG. 31 show archery release aid 50 being attached to Cylinder 121 and then being rotated downward to be pressed into the cavity formed by feature (i.e., spring loaded tab) 122 in order to be secured by archery release aid mount 120.

Figure 32:
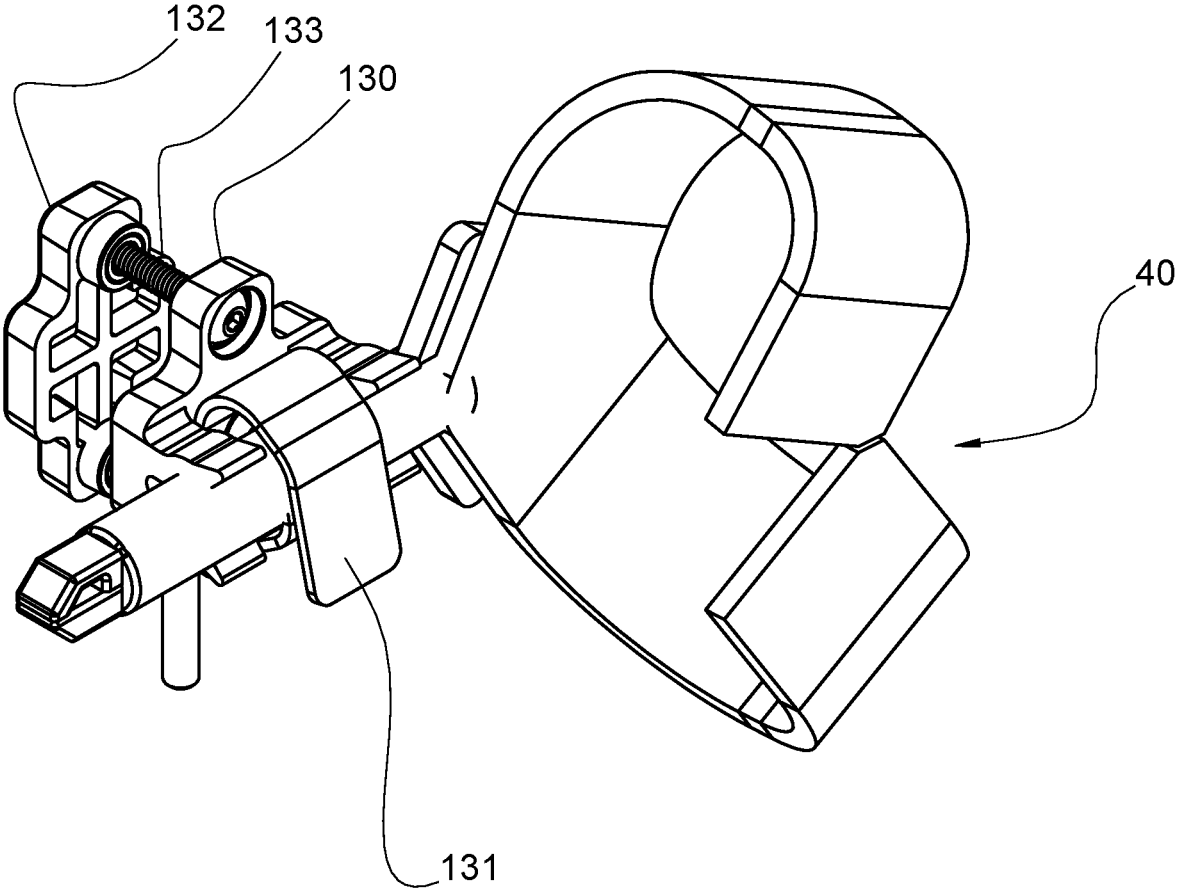
Figure 33:
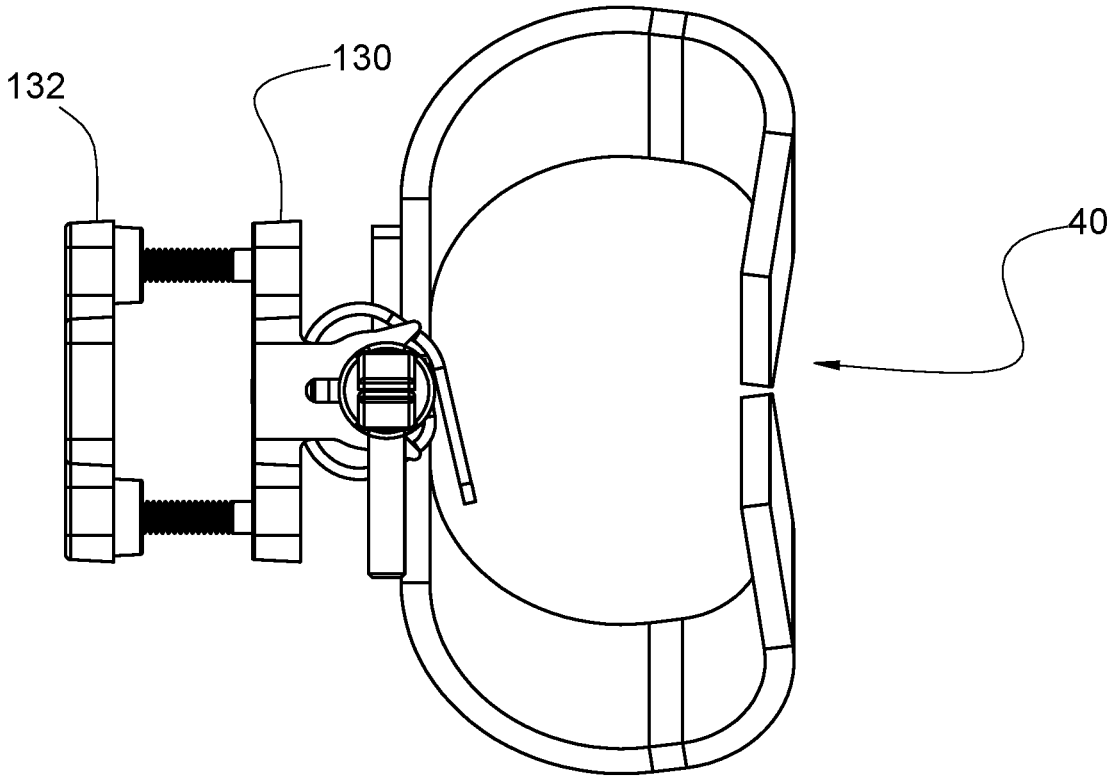
Figure 34:
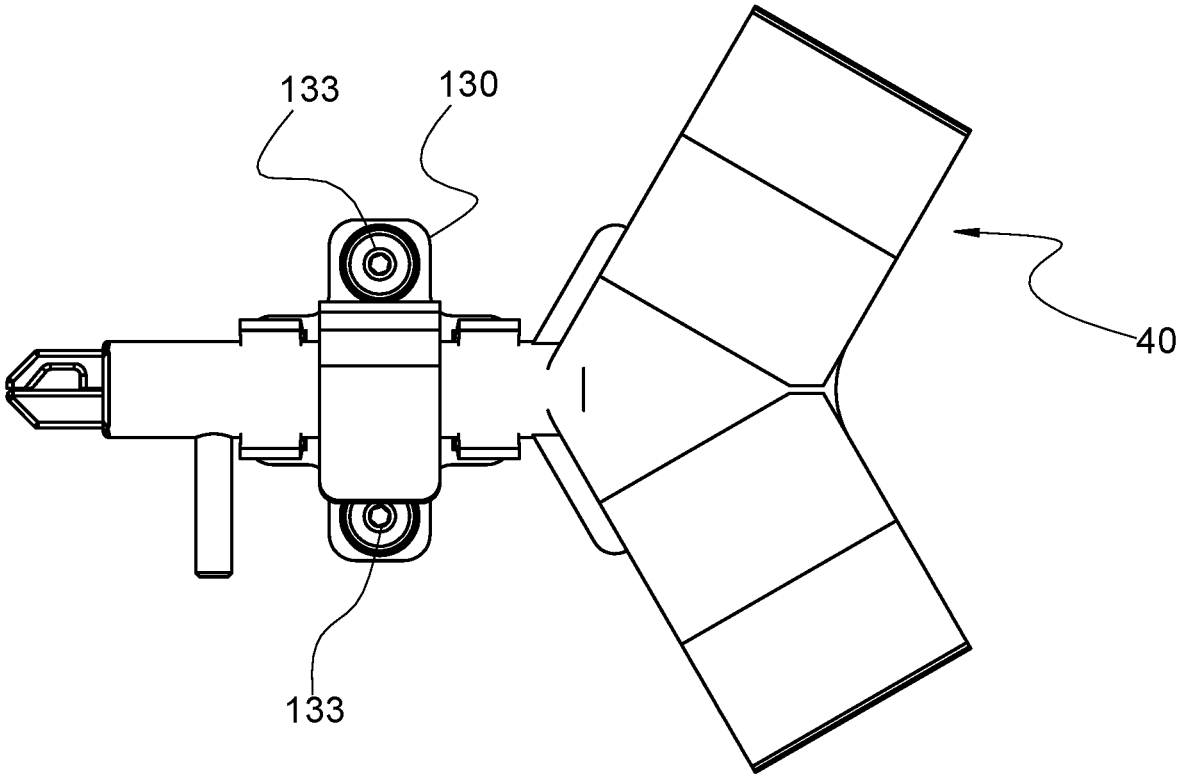

FIG. 32, FIG. 33 and FIG. 34 shows an archery release aid mount 130 that is attached to a clamp 132 by bolts 33. Clamp 132 serves as an attachment mechanism to attach release aid mount 130 to a bow. For example, archery release aid mount 130 attaches to archery release aid 40 using a hook and loop strap 131. Alternatively, the hook and loop strap 131 can be replaced with a strap that attaches using a button, a snap or some other fastening device. Hook and loop strap 131 serves as a securing devices of a mounting mechanisms that upon the archery release aid mount 130 receiving an archery release aid, hold the archery release aid securely, and that is configured to allow a user to without tools remove the archery release aid from archery release aid mount 130 when the user wants to use the archery release aid during archery.

Figure 35:
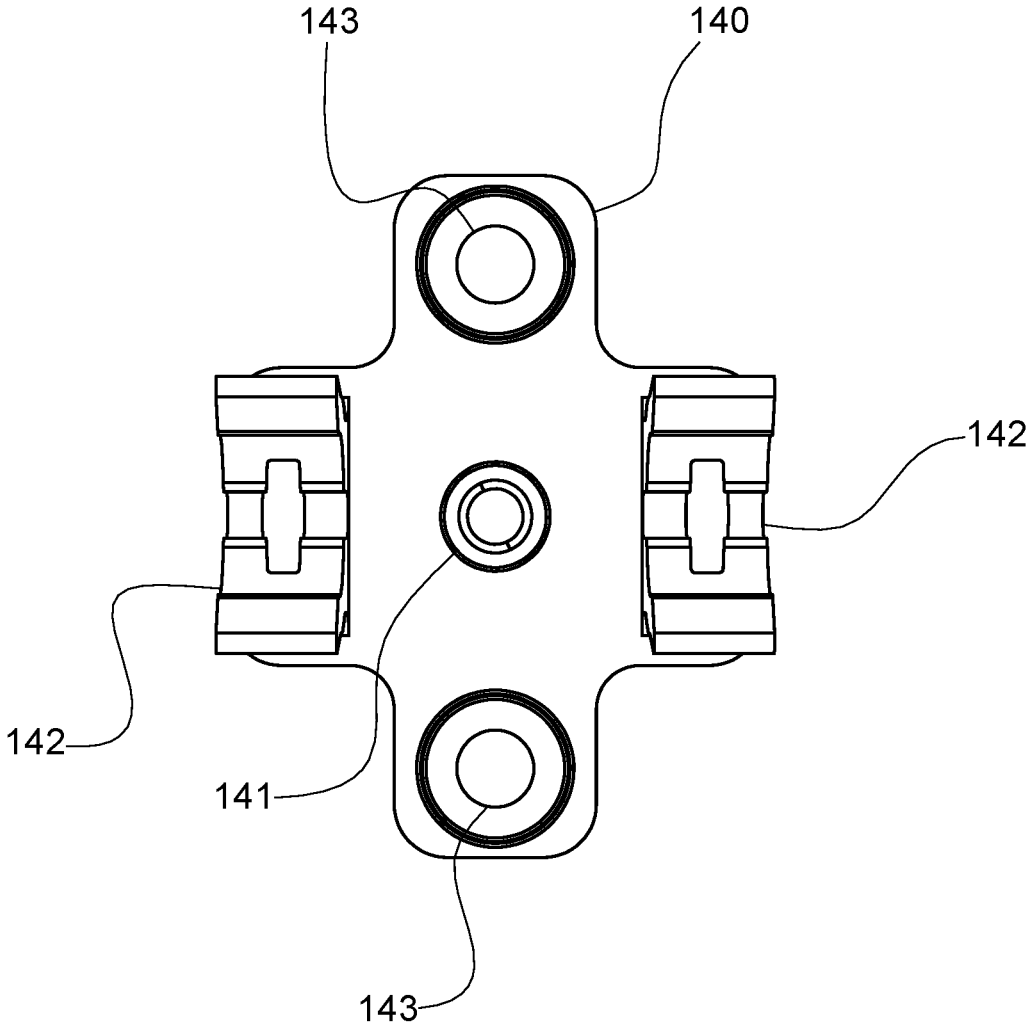
Figure 35A:
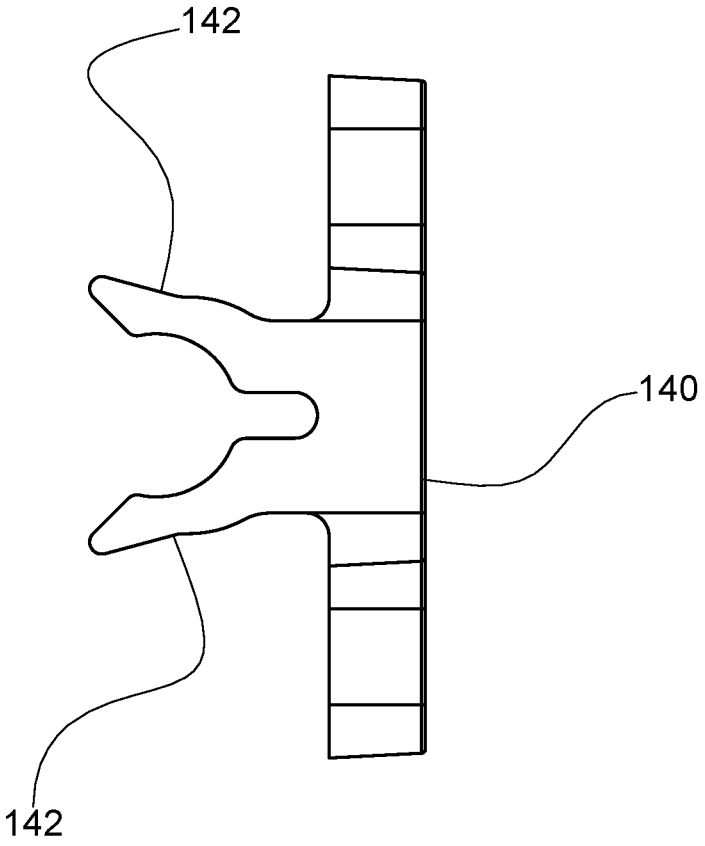
Figure 36:
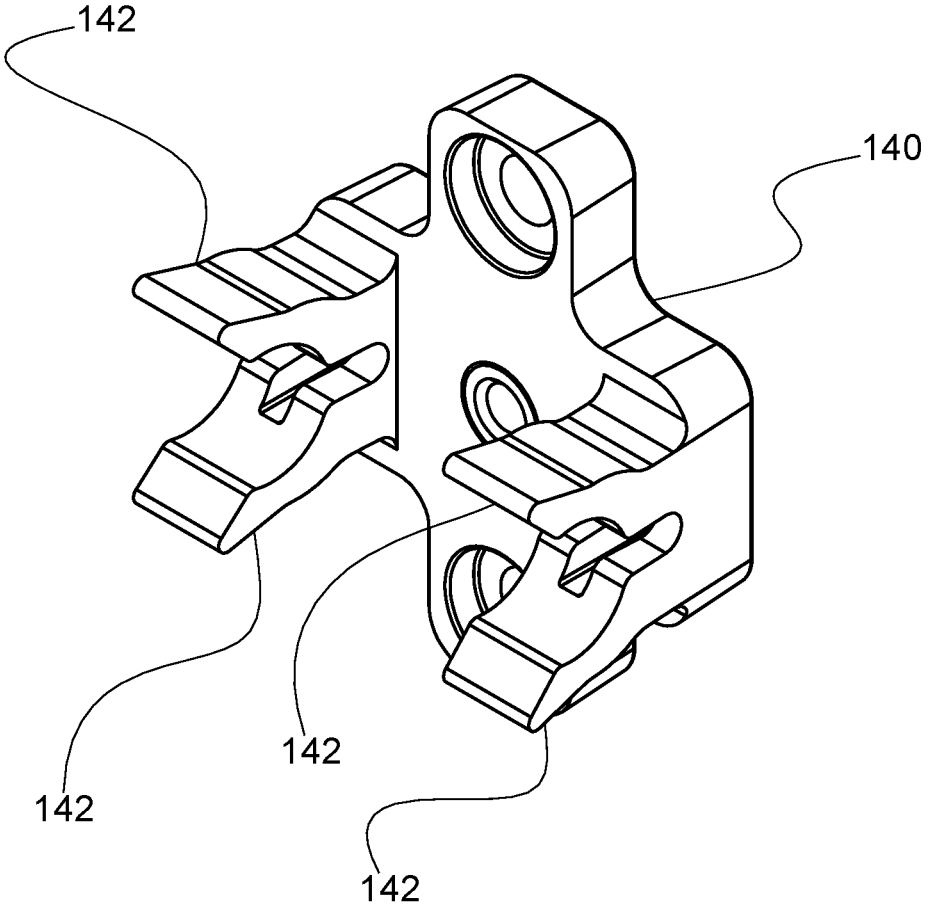
Figure 37:
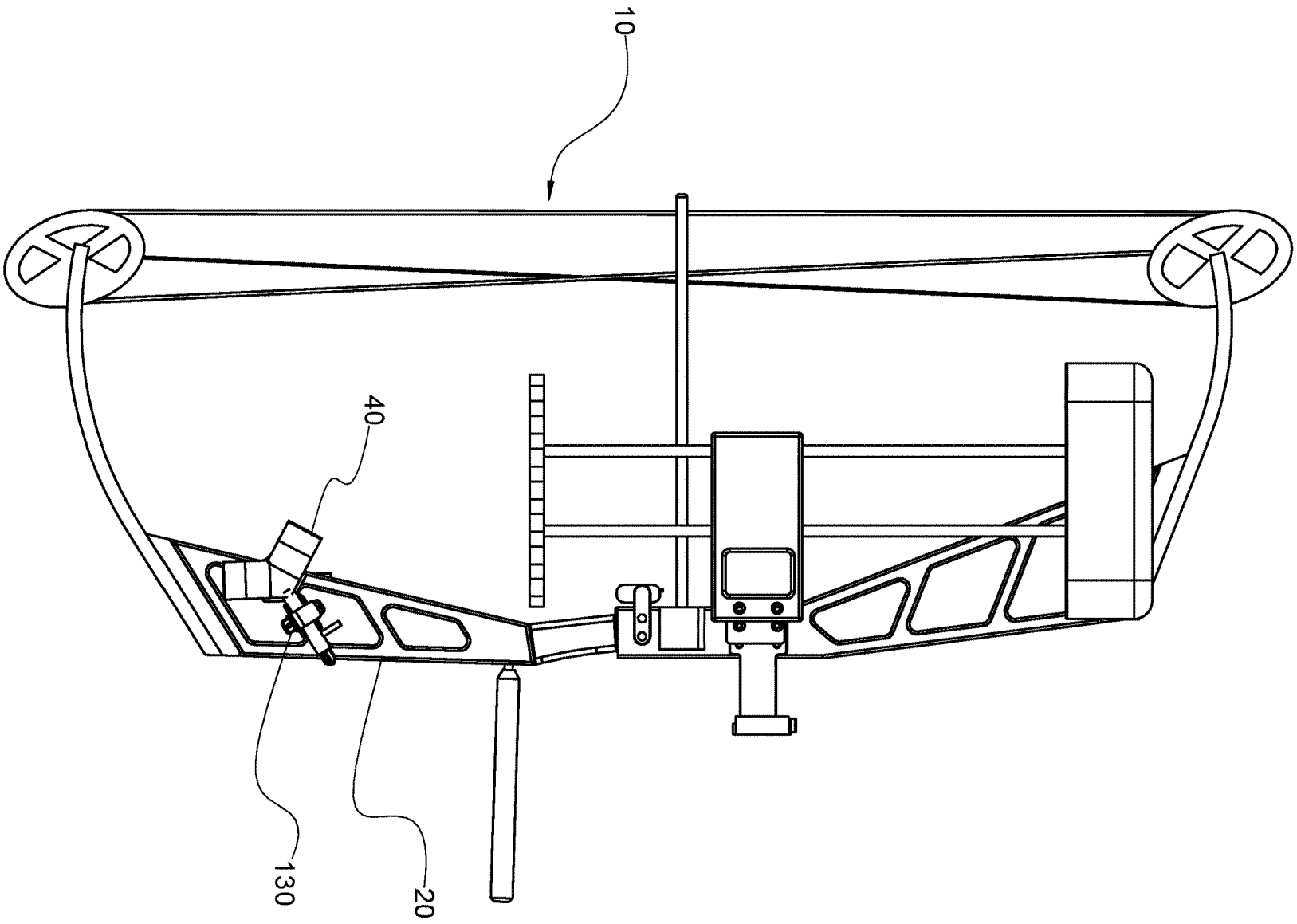
FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53, FIG. 54, FIG. 55, FIG. 56, FIG. 57, FIG. 58, FIG. 59, FIG. 60, FIG. 61, FIG. 62, FIG. 63, FIG. 64, FIG. 65, FIG. 66, FIG. 67, FIG. 68, FIG. 69, FIG. 70, FIG. 71 and FIG. 72 illustrate how archery release aid mounts are attached to an archery bow or to an archery accessory in accordance with preferred implementations.

FIG. 35, FIG. 35A and FIG. 36 show an archery release aid mount 140 that uses jaws 142 to grasp and hold an archery release aid. Bolt holes 143 are spaced to match a bolt pattern used to mount risers and fixed sights on bows. Jaws 142 serve as securing devices of a mounting mechanisms that upon the archery release aid mount 140 receiving an archery release aid, hold the archery release aid securely, and that is configured to allow a user to without tools remove the archery release aid from archery release aid mount 140 when the user wants to use the archery release aid during archery.

Figure 38:
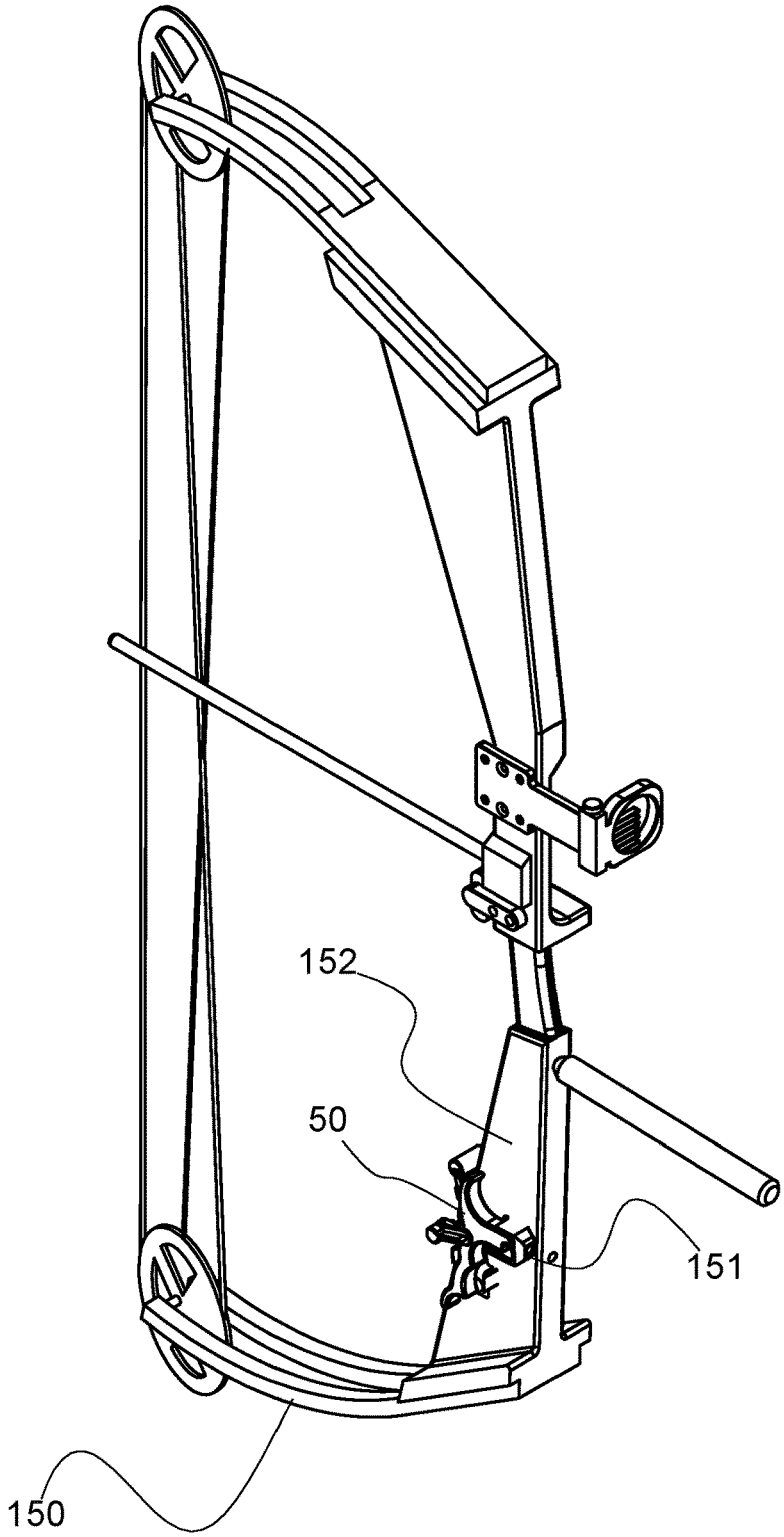
Figure 39:
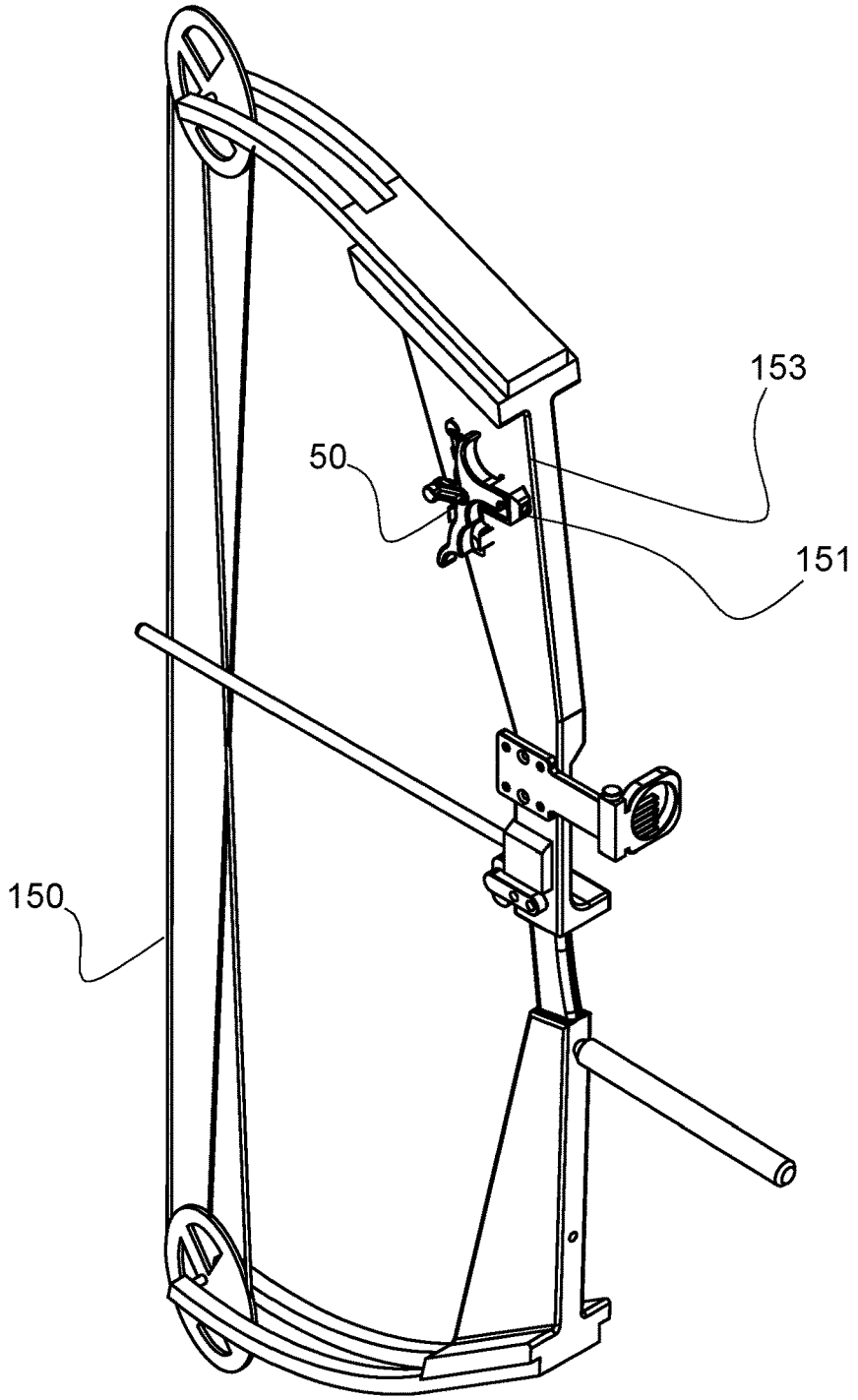

FIG. 38 shows an archery release aid mount 151 configured to hold archery release aid 50 attached to a riser 152 of a bow 150. FIG. 39 shows archery release aid mount 151 alternatively attached to a riser 153 of a bow 150.

Figure 40:
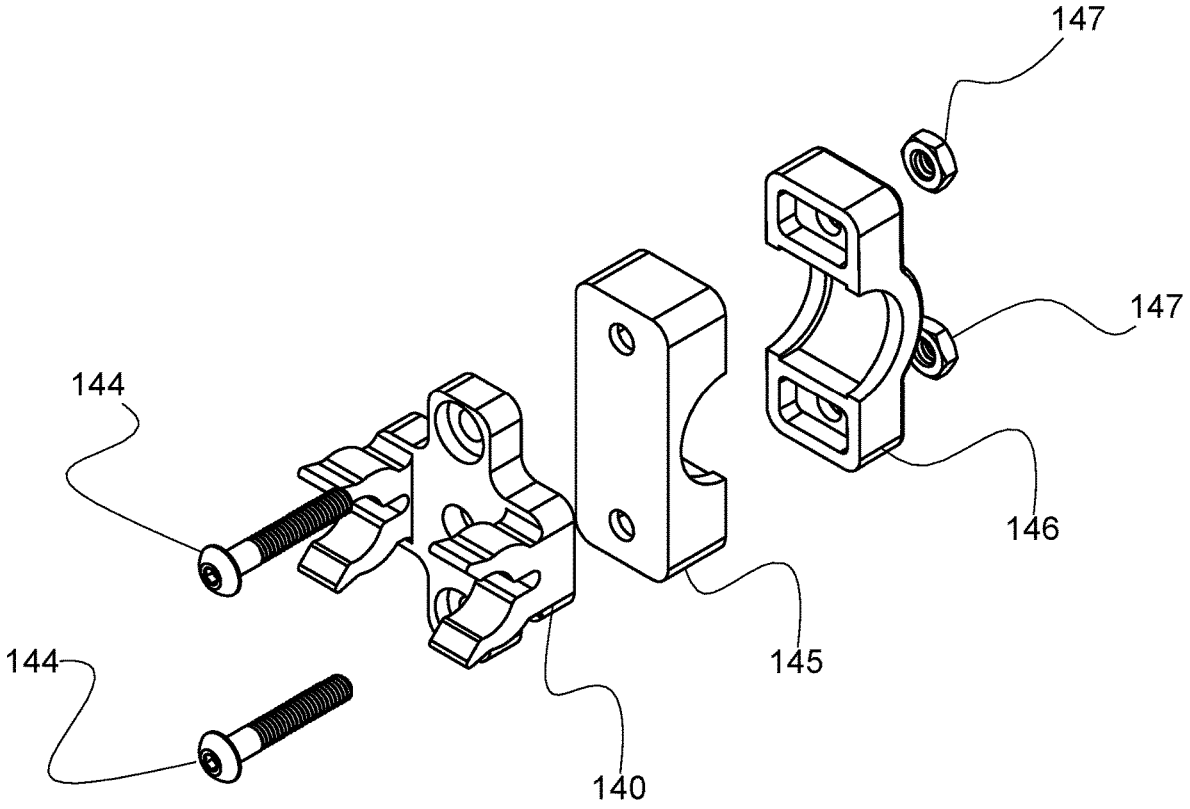

FIG. 40 shows archery release aid mount 140 configured to be attached to a stabilizer by inclusion of a mounting bracket 145, a mounting bracket 146, bolts 144 and screw nuts 147. Mounting bracket 145, mounting bracket 146, bolts 144 and screw nuts 147 form an attachment mechanism configured to rigidly attach archery release aid mount 140 to a bow.

Figure 41:
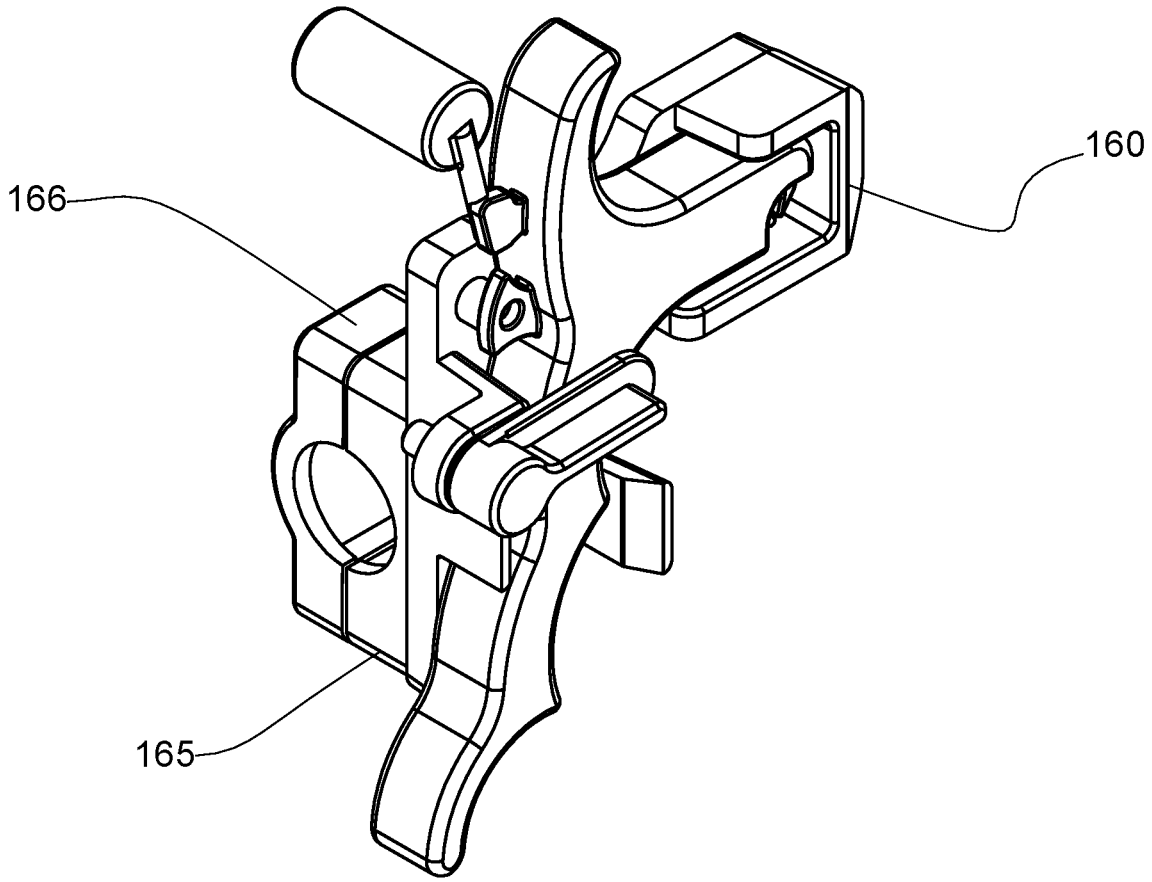
Figure 42:
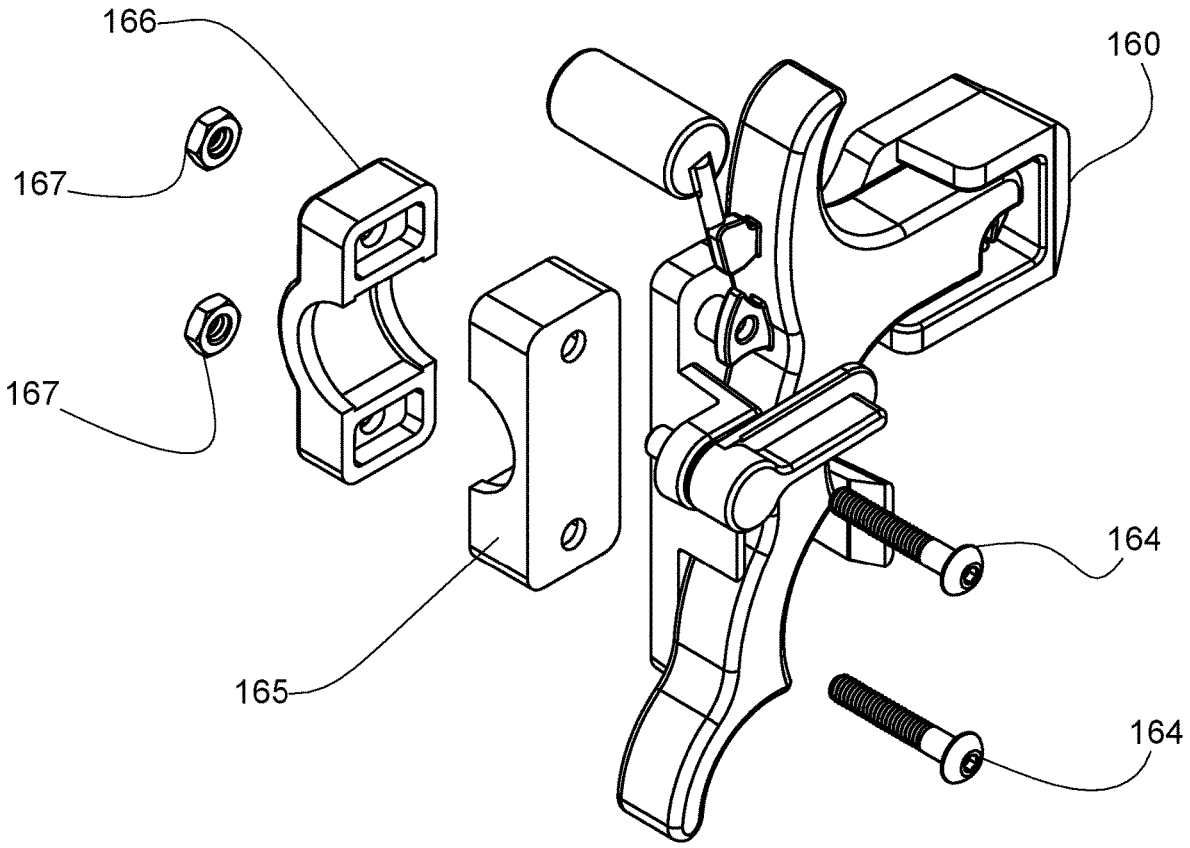

FIG. 41 and FIG. 42 shows an archery release aid mount 160 configured to be attached to a stabilizer by inclusion of a mounting bracket 165, a mounting bracket 166, bolts 164 and screw nuts 167. Mounting bracket 165, mounting bracket 166, bolts 164 and screw nuts 167 form an attachment mechanism configured to rigidly attach archery release aid mount 160 to a bow.

Figure 43:
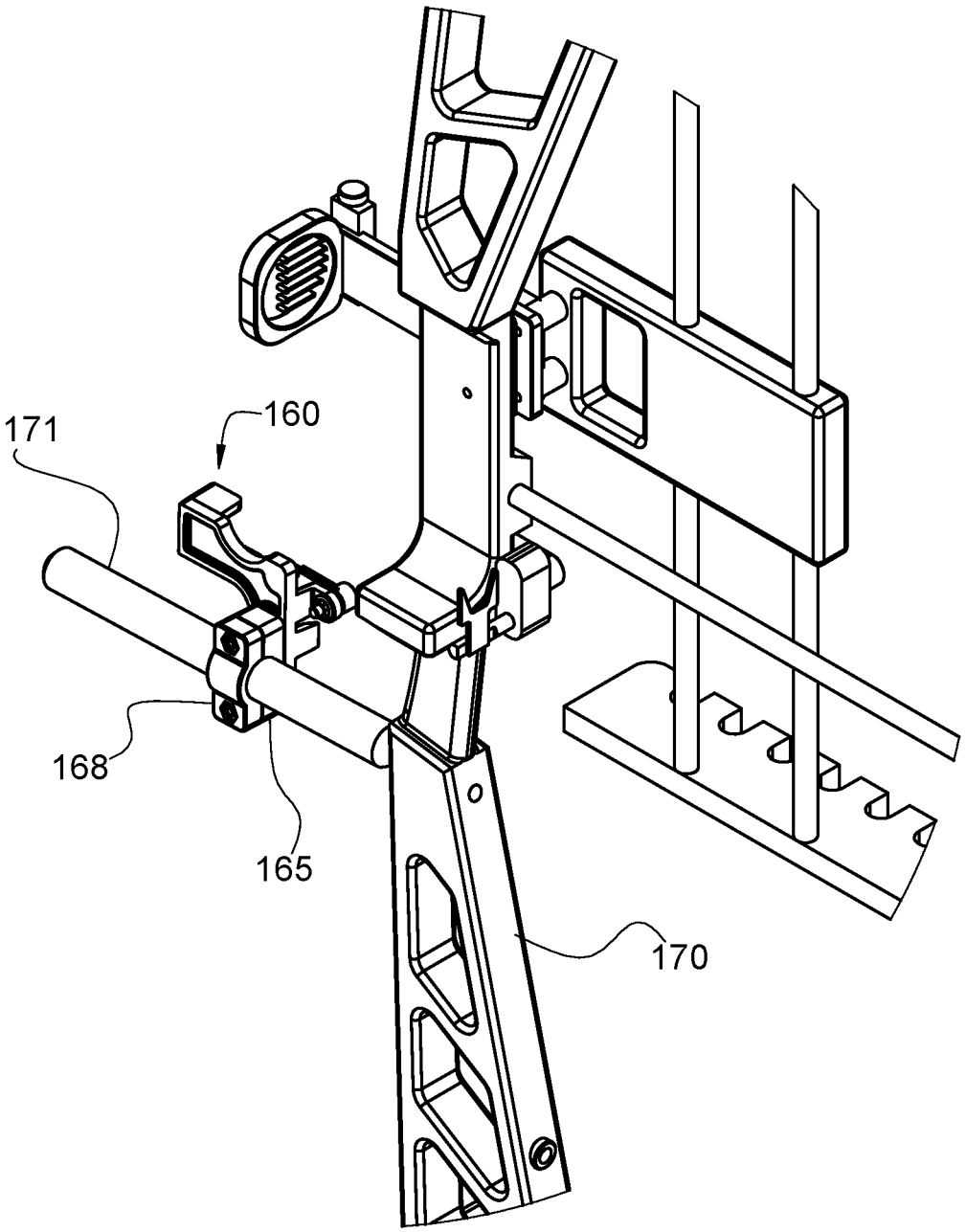

FIG. 43 shows archery release aid mount 160 attached to a stabilizer 171 of a bow 170.

Figure 44:
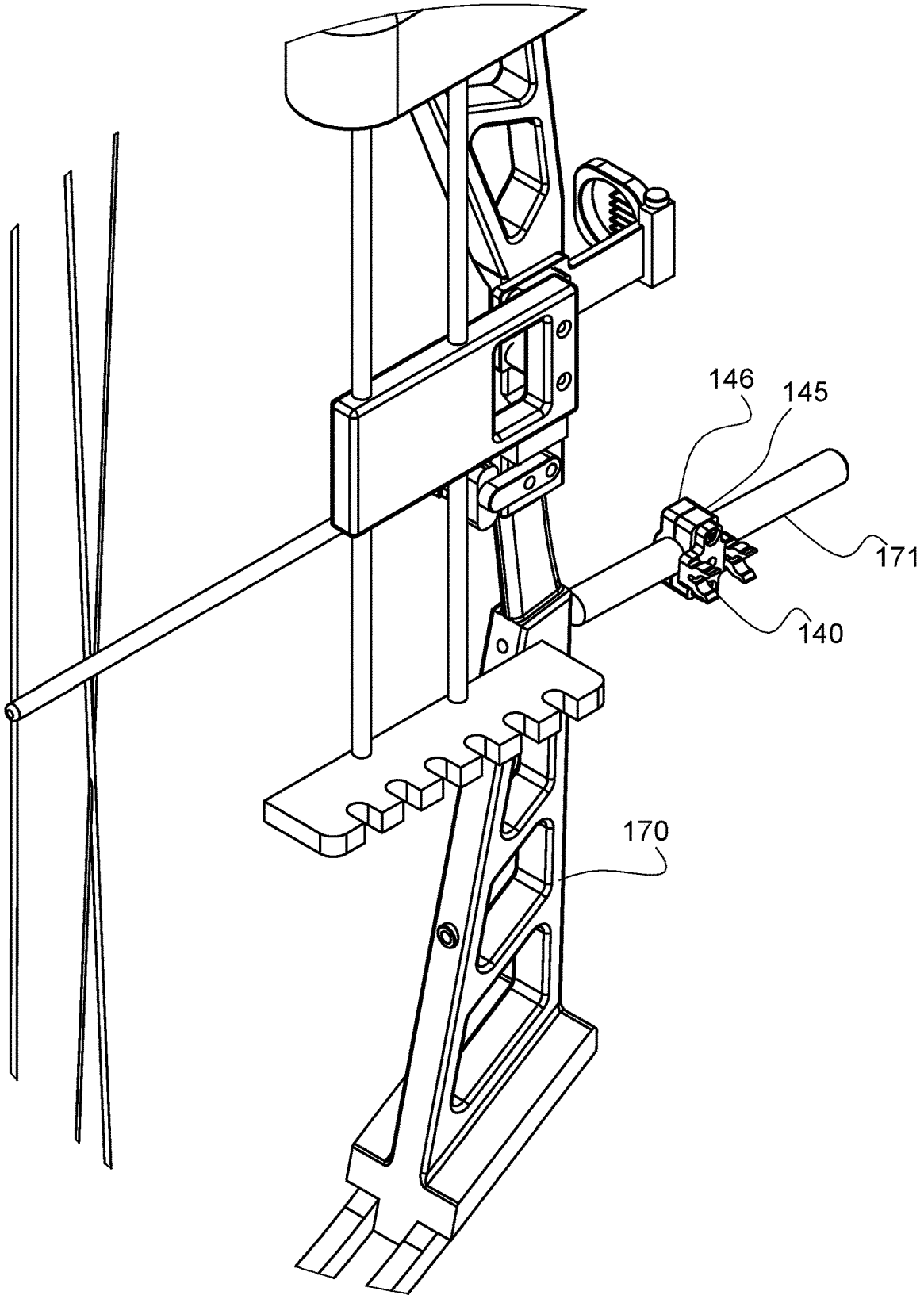

FIG. 44 shows archery release aid mount 140 attached to stabilizer 171 of bow 170.

Figure 45:
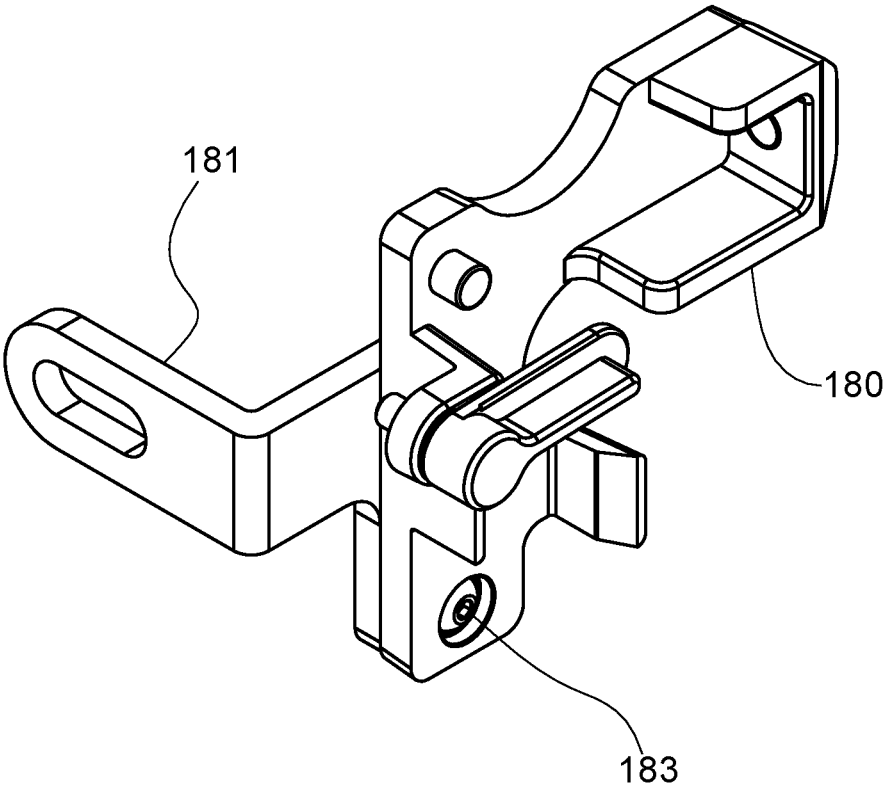
Figure 46:
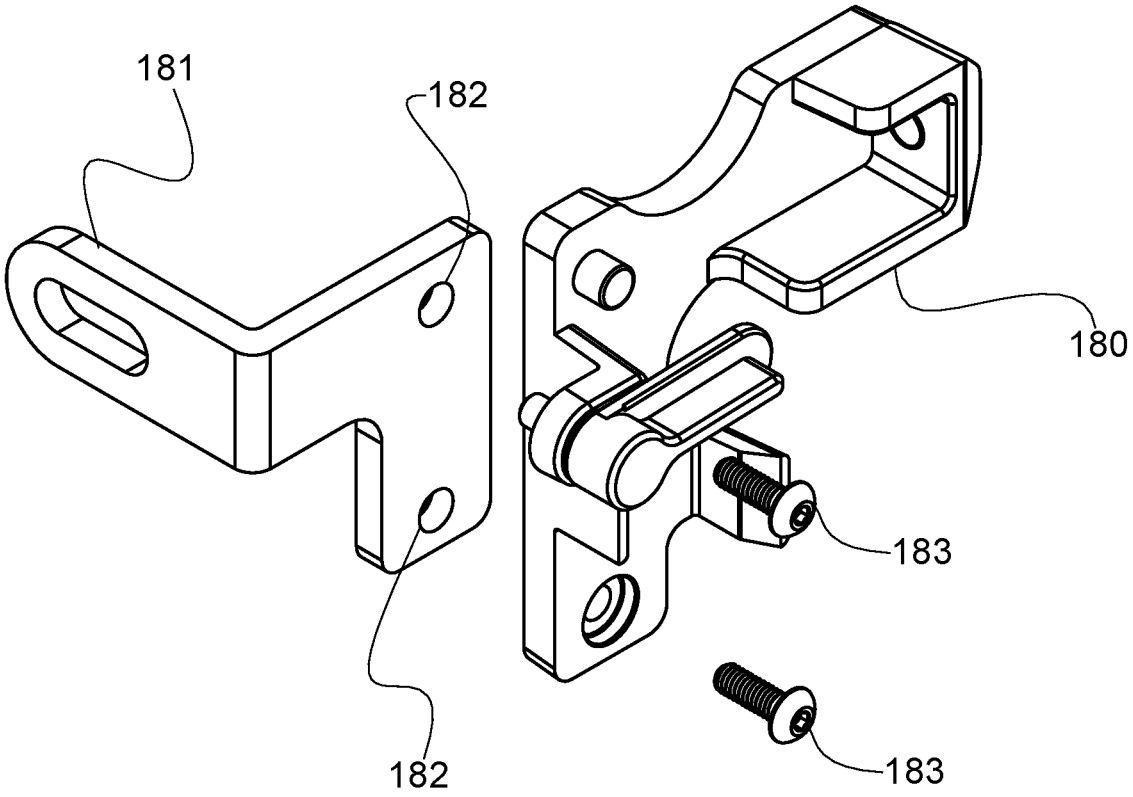

FIG. 45 and FIG. 46 shows an archery release aid mount 180 attached to a stabilizer mounting bracket 181 via bolts 183 that are screwed into threads within bolt holes 182. Stabilizer mounting bracket 181 and bolts 183 form an attachment mechanism configured to rigidly attach archery release aid mount 180 to a bow.

Figure 47:
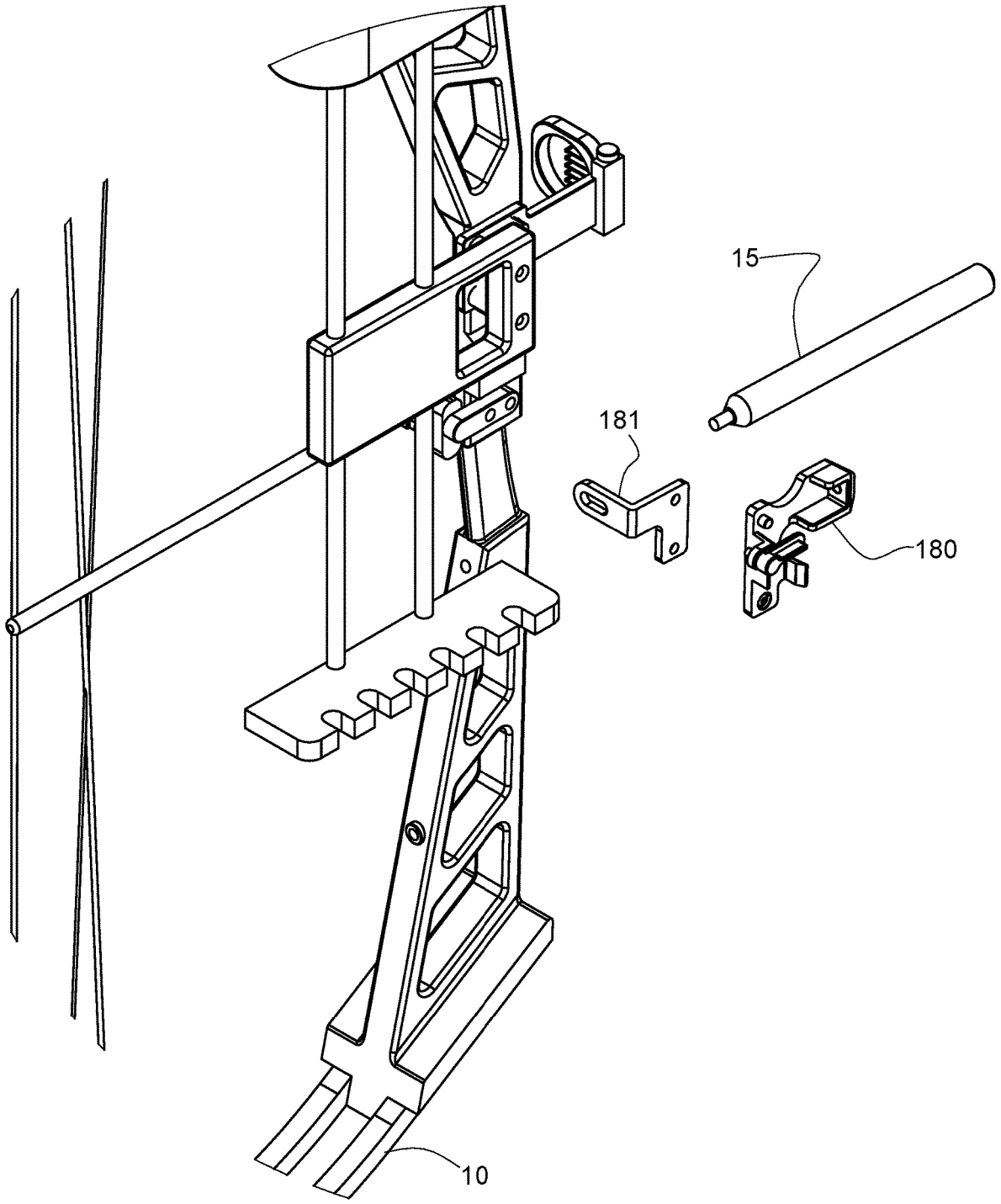
Figure 48:
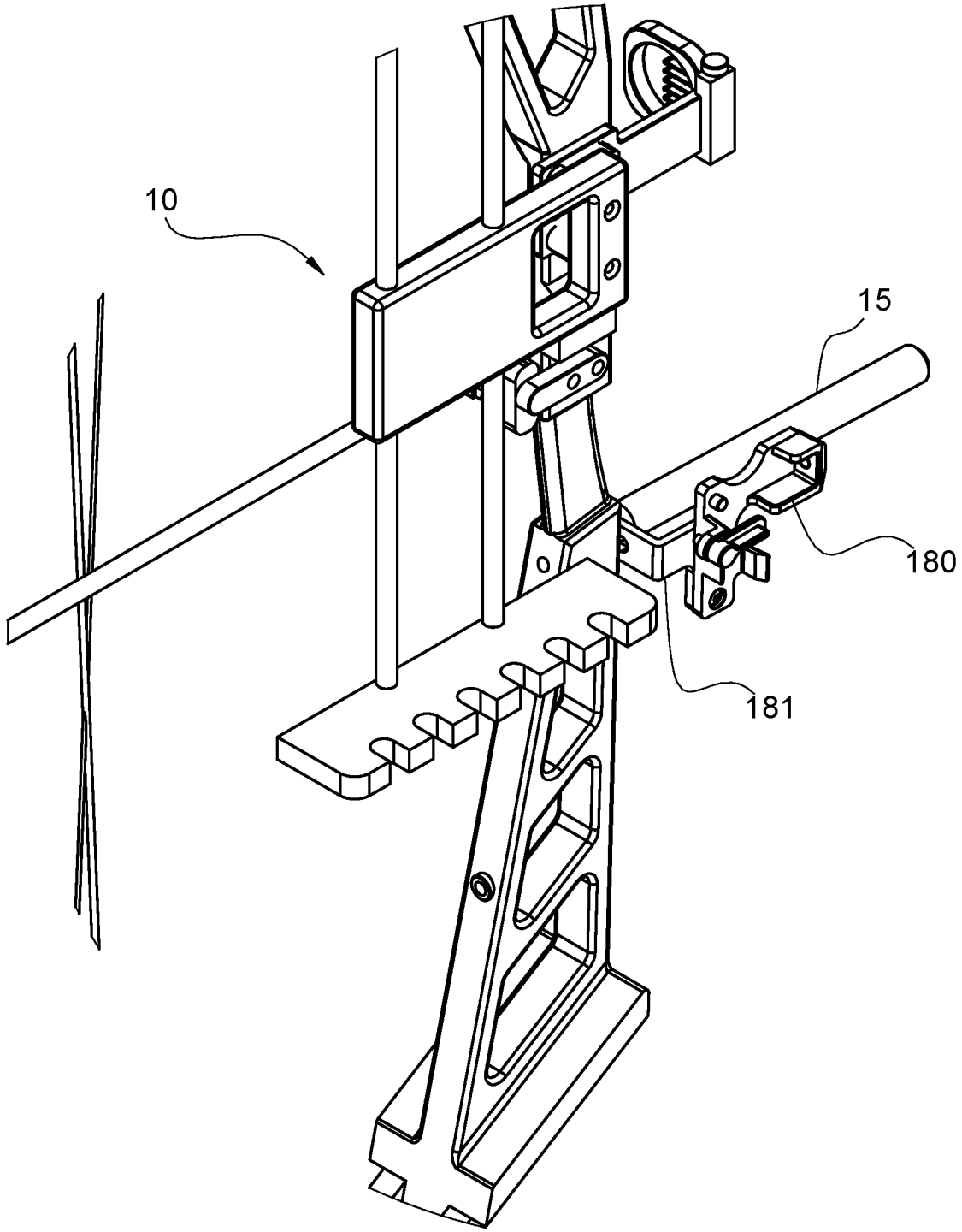

FIG. 47 and FIG. 48 illustrate archery release aid mount 180 being attached to bow 10 using stabilizer mounting bracket 181.

Figure 49:
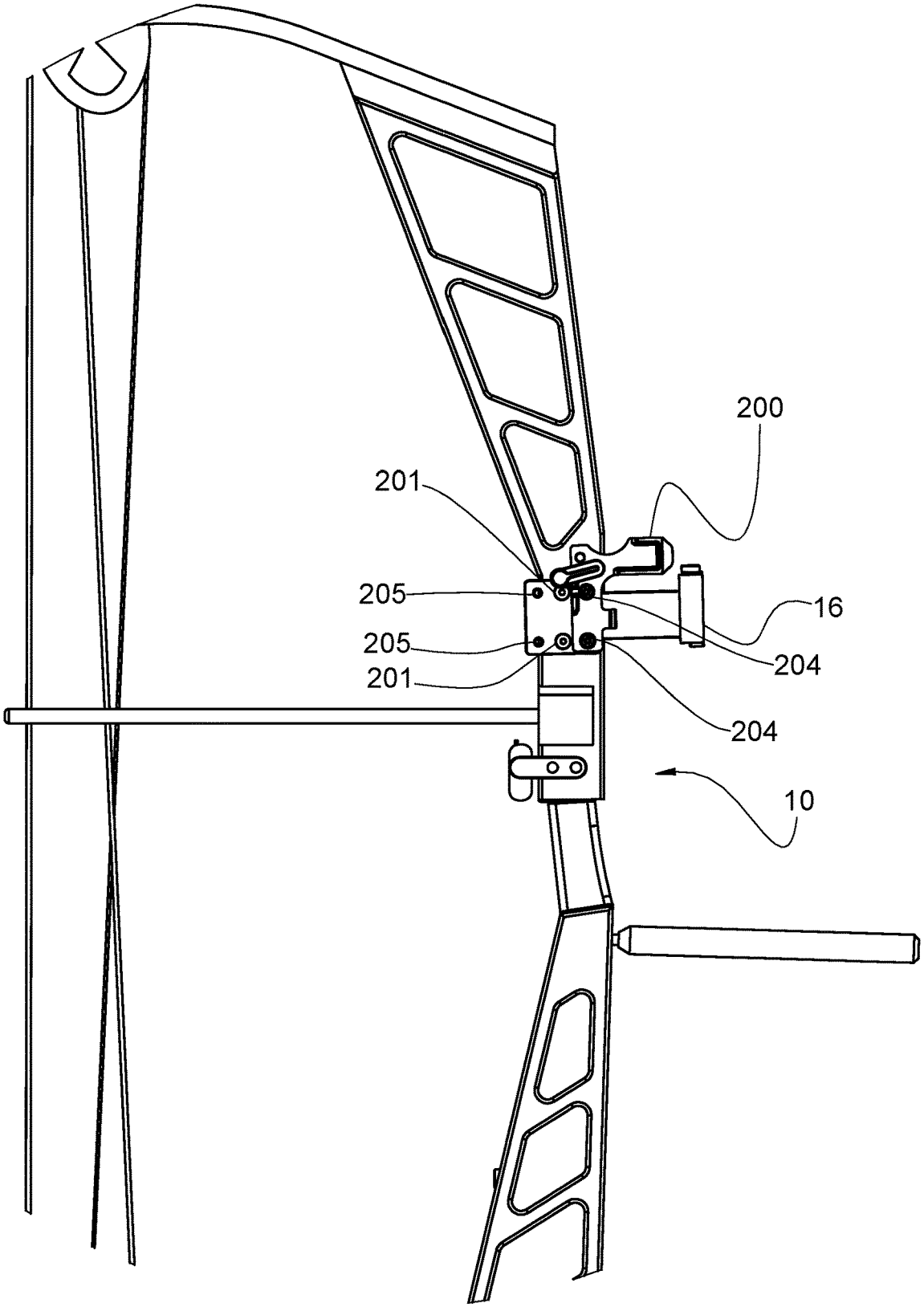
Figure 50:
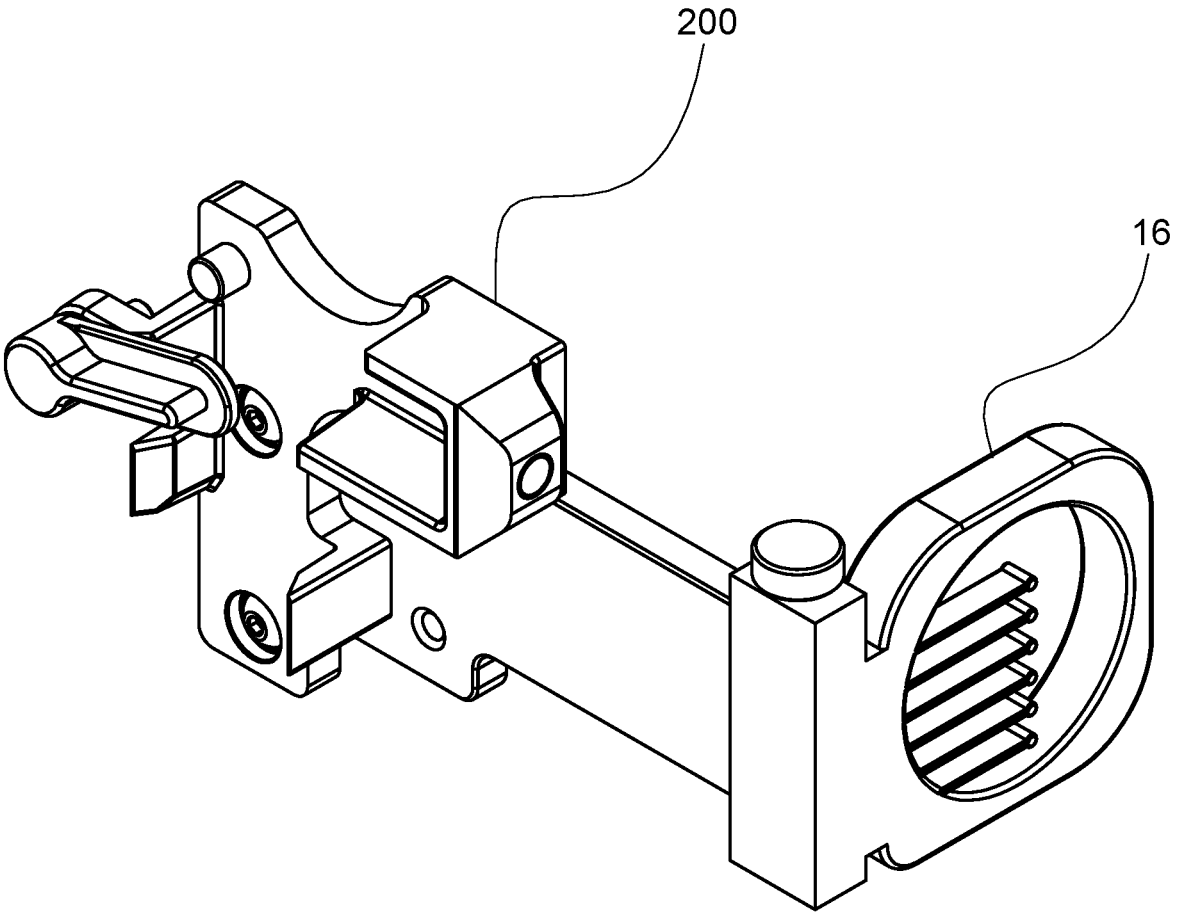

FIG. 49 shows an archery release aid mount 200 attached to bow 10 using auxiliary or accessory mounting holes such as at locations 204. For example, auxiliary or accessory mounting holes at locations 204 are in additional to standard mounting holes 201 used to mount fixed pin sight 16 on bow 10. For example, archery release aid mounts can have mounting holes configured to be attached to a bow using auxiliary or accessory mounting holes, or can be configured to use the same mounting holes on bow 10 used to mount a bow sight.

Figure 51:
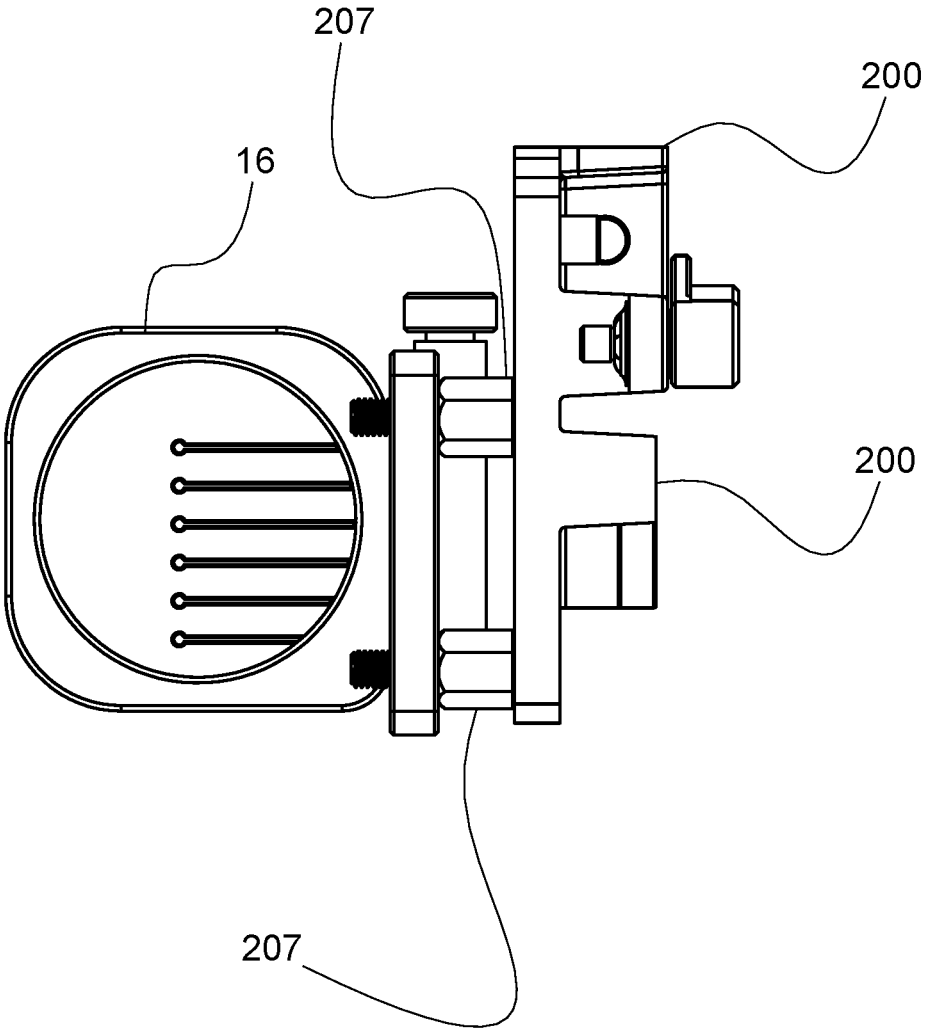
Figure 52:
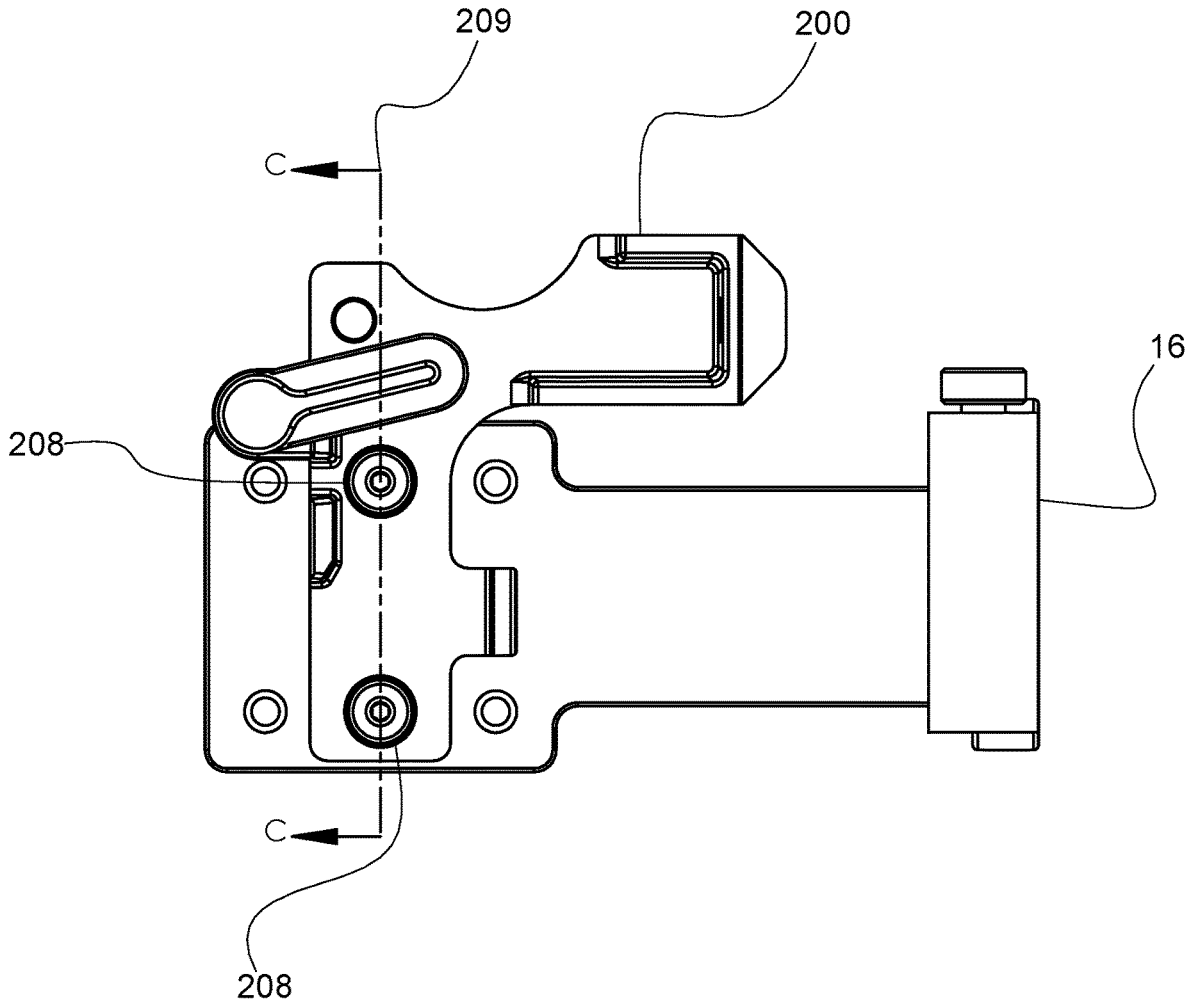
Figure 53:
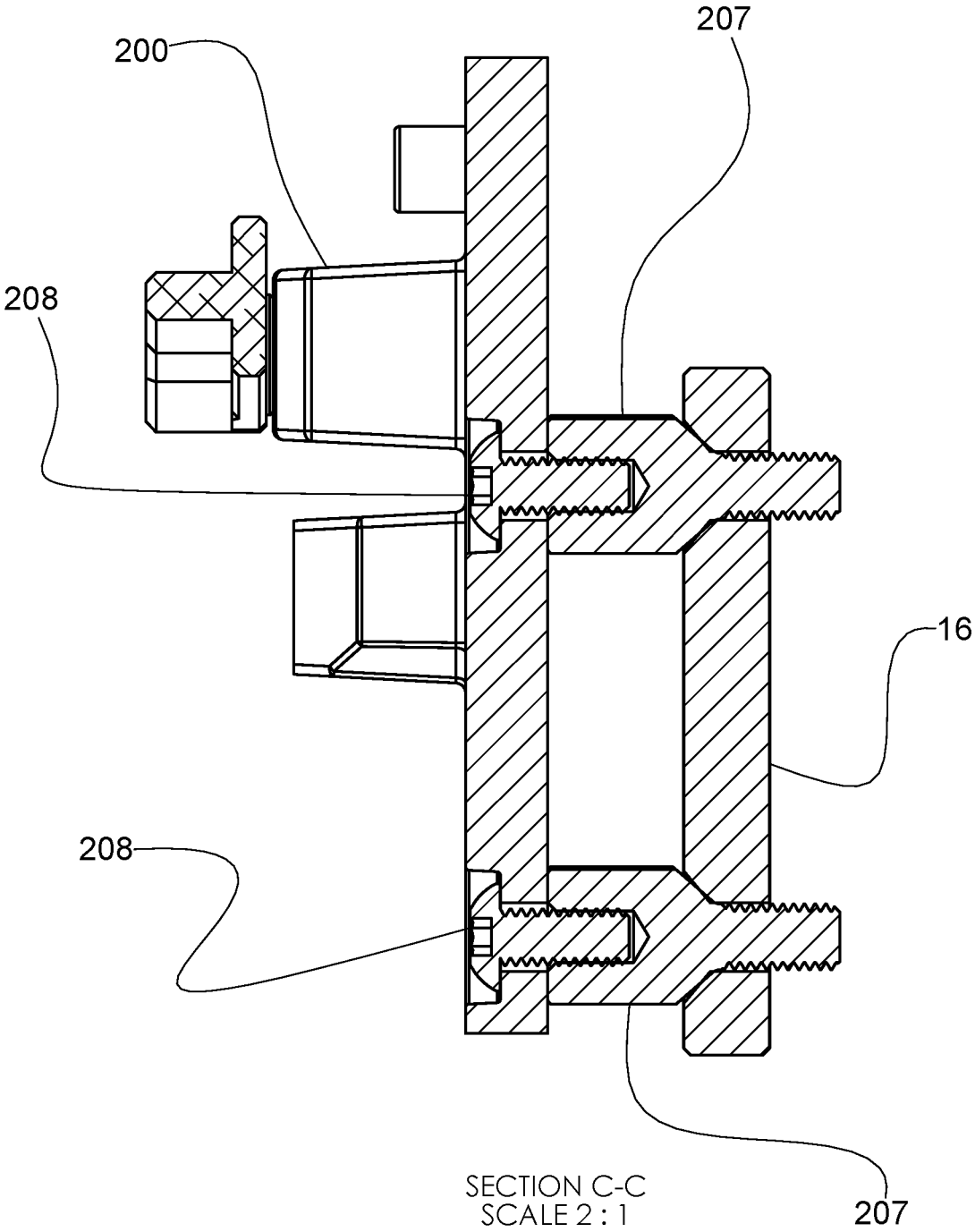

FIG. 50, FIG. 51, FIG. 52 and FIG. 53 gives more information of how additional holes are configured fixed pin sight 16 allowing mounting archery release aid mount 200 to be attached adjacent to fixed pin sight 16 on bow 10. For example, male/female threaded adapters 206 along with threaded screws 207 can be used as part of an attachment mechanism configured to rigidly attach archery release aid mount 200 to a bow, as shown in FIG. 51, FIG. 52 and FIG. 53. FIG. 53 shows a cross sectional view along a plane 209 defined in FIG. 51.

Figure 54:
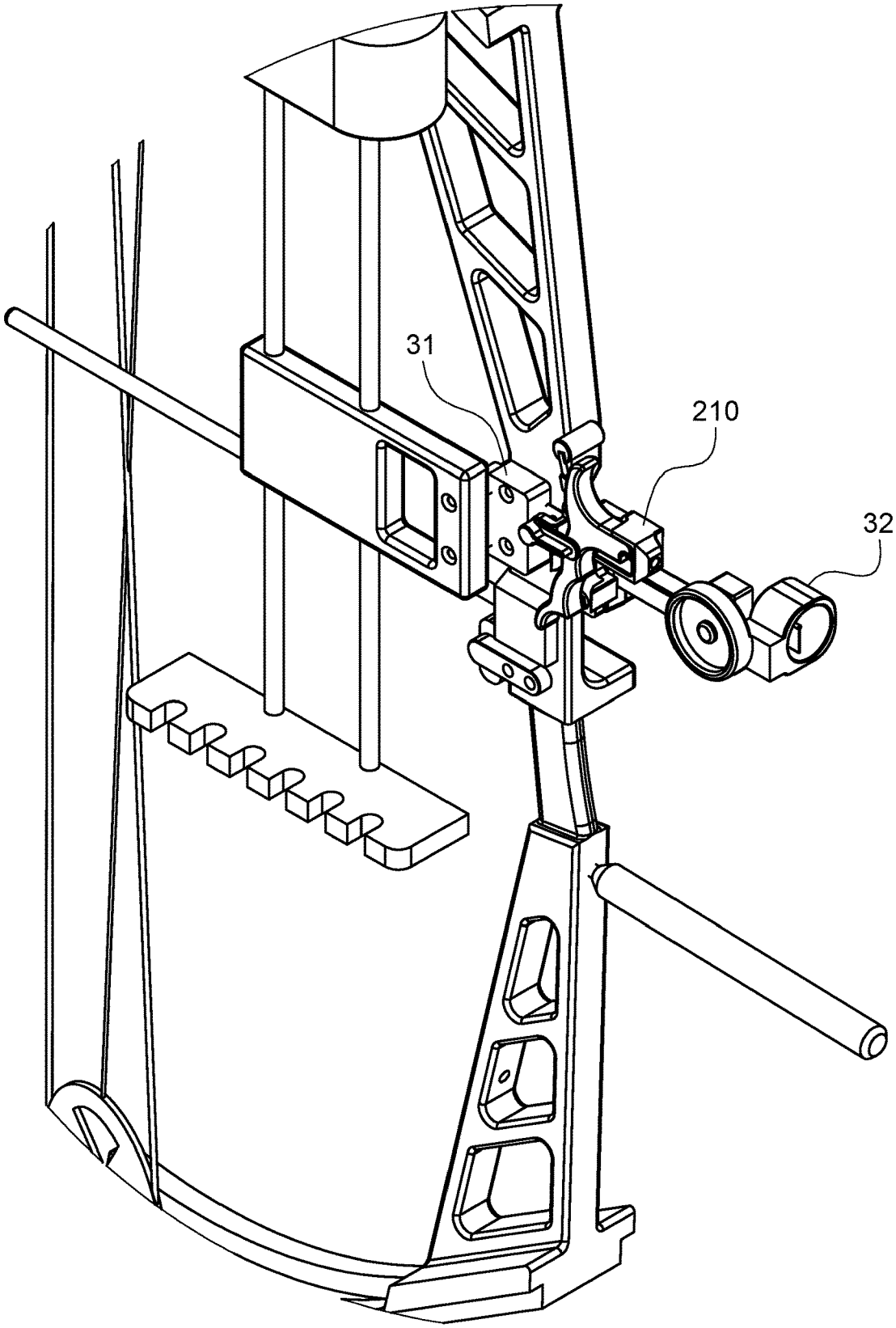
Figure 55:
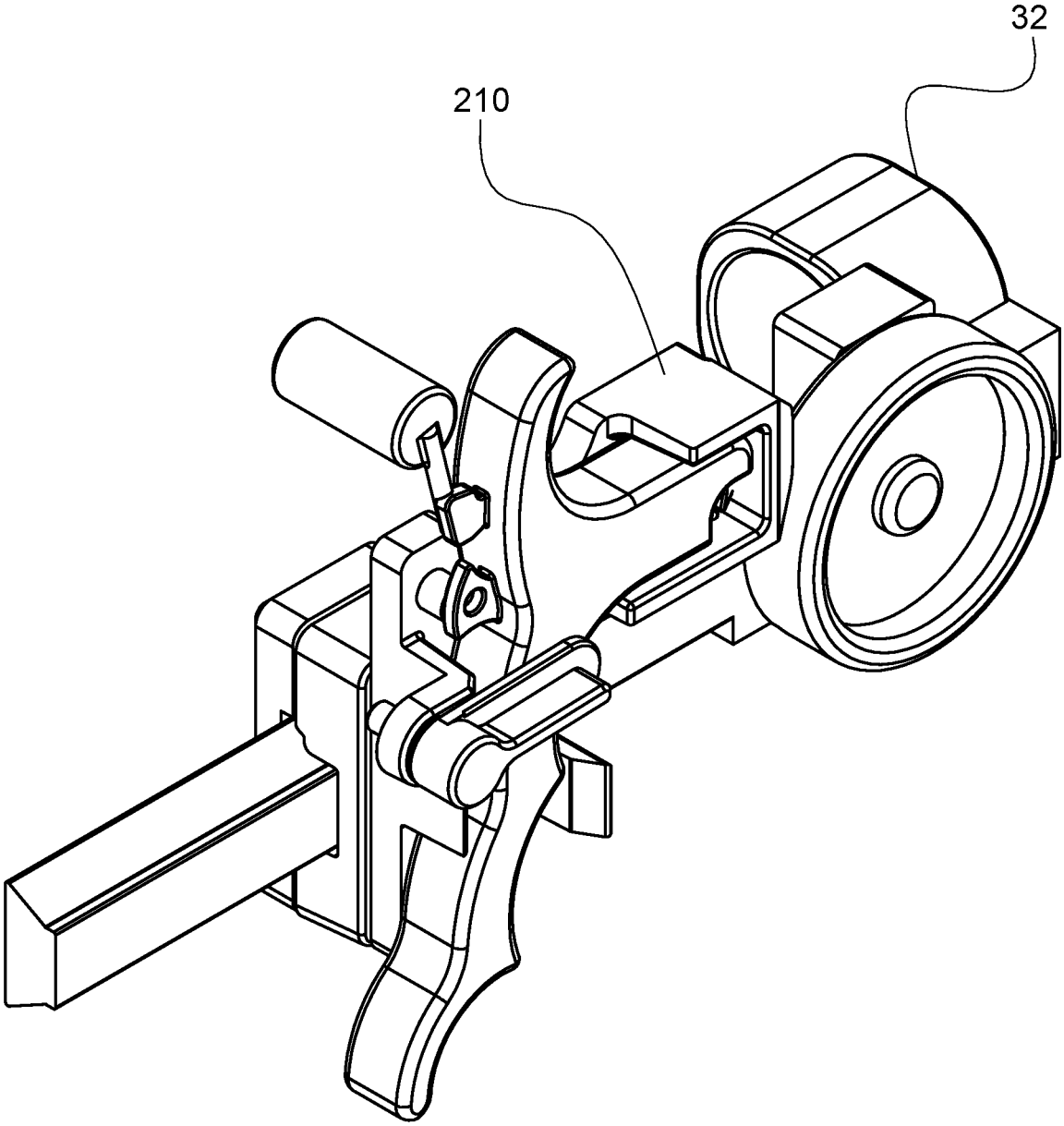
Figure 56:
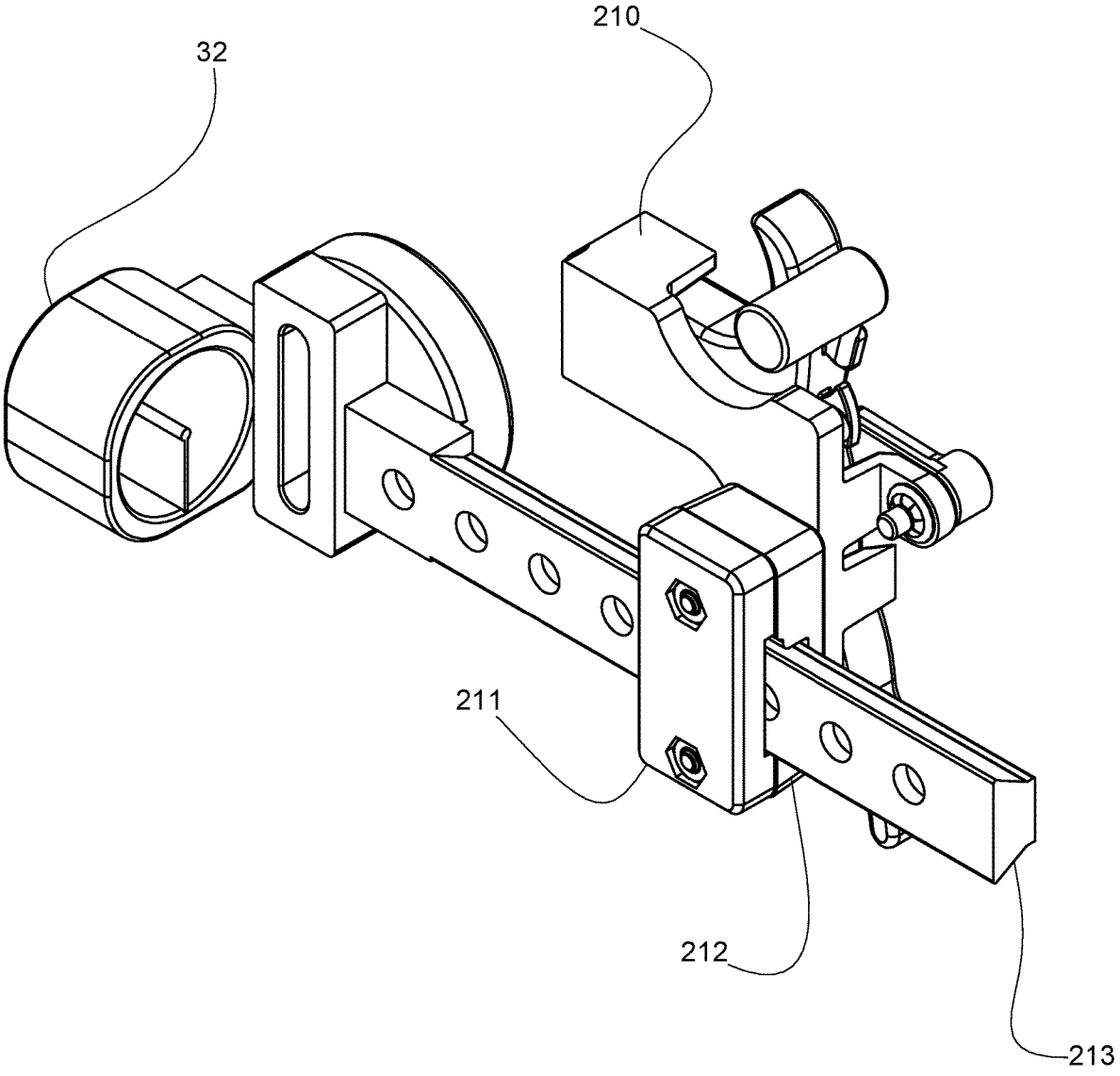
Figure 57:
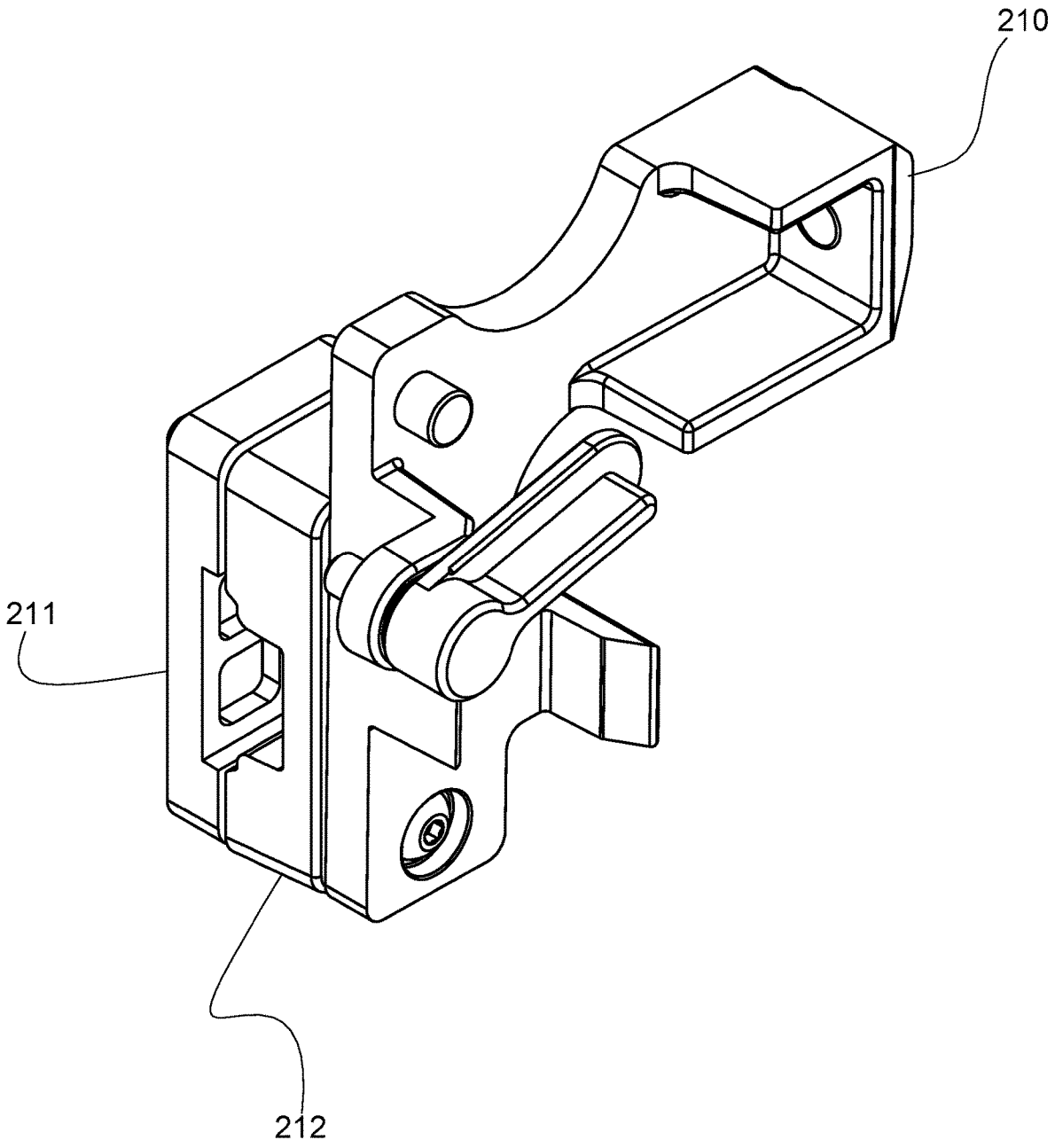
Figure 58:
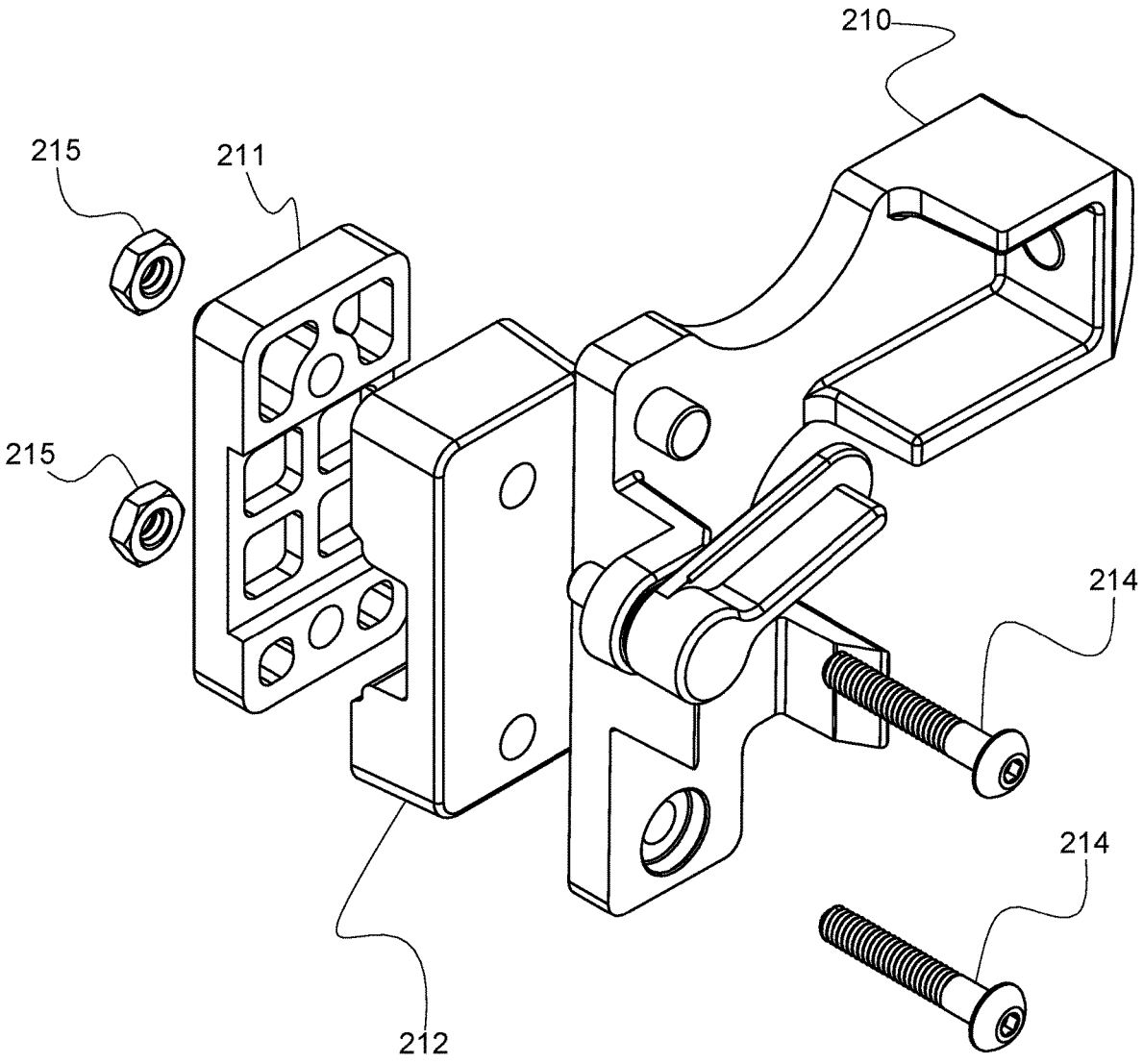

FIG. 54 shows an archery release aid mount 210 attached to adjustable sight 32, connected to bow 10 by dove tail sight mount 31. Alternatively, archery release aid mount 210 can be integrated into the design of the adjustable sight.

FIG. 55, FIG. 56, FIG. 57, FIG. 58, FIG. 59, FIG. 60 and FIG. 61 show how archery release aid mount 210 is attached to a dove tail mount crossbar 213 using a mounting fixture 212 and a clamping plate 211. Bolts 214 and nuts 215 are used to hold mounting fixture 212 and a clamping plate 211 secure to dove tail mount crossbar 213. Bolts 214, nuts 215, mounting fixture 212 and clamping plate 211 form an attachment mechanism configured to rigidly attach archery release aid mount 210 to a bow.

Figure 59:
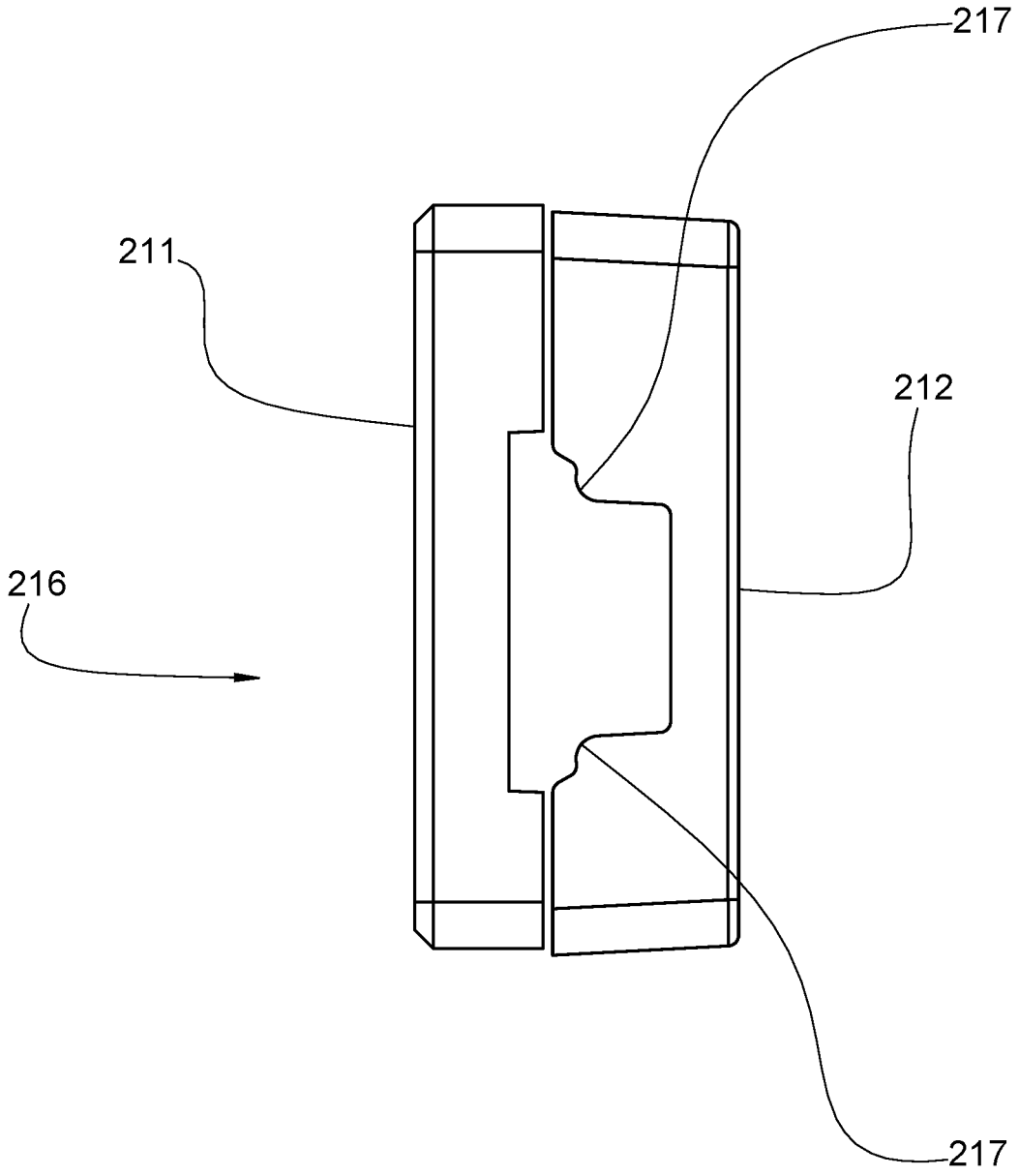
Figure 60:
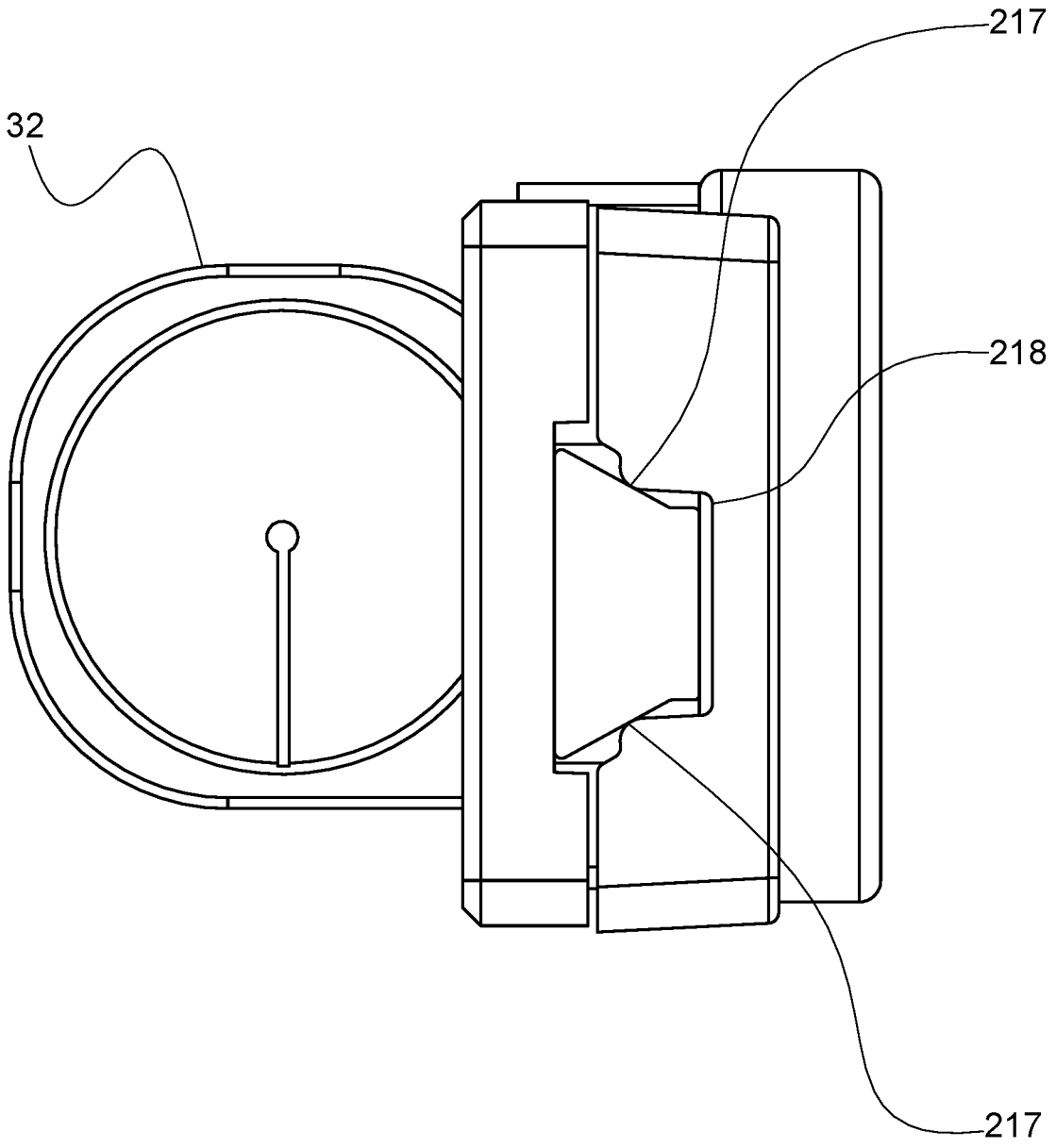
Figure 61:
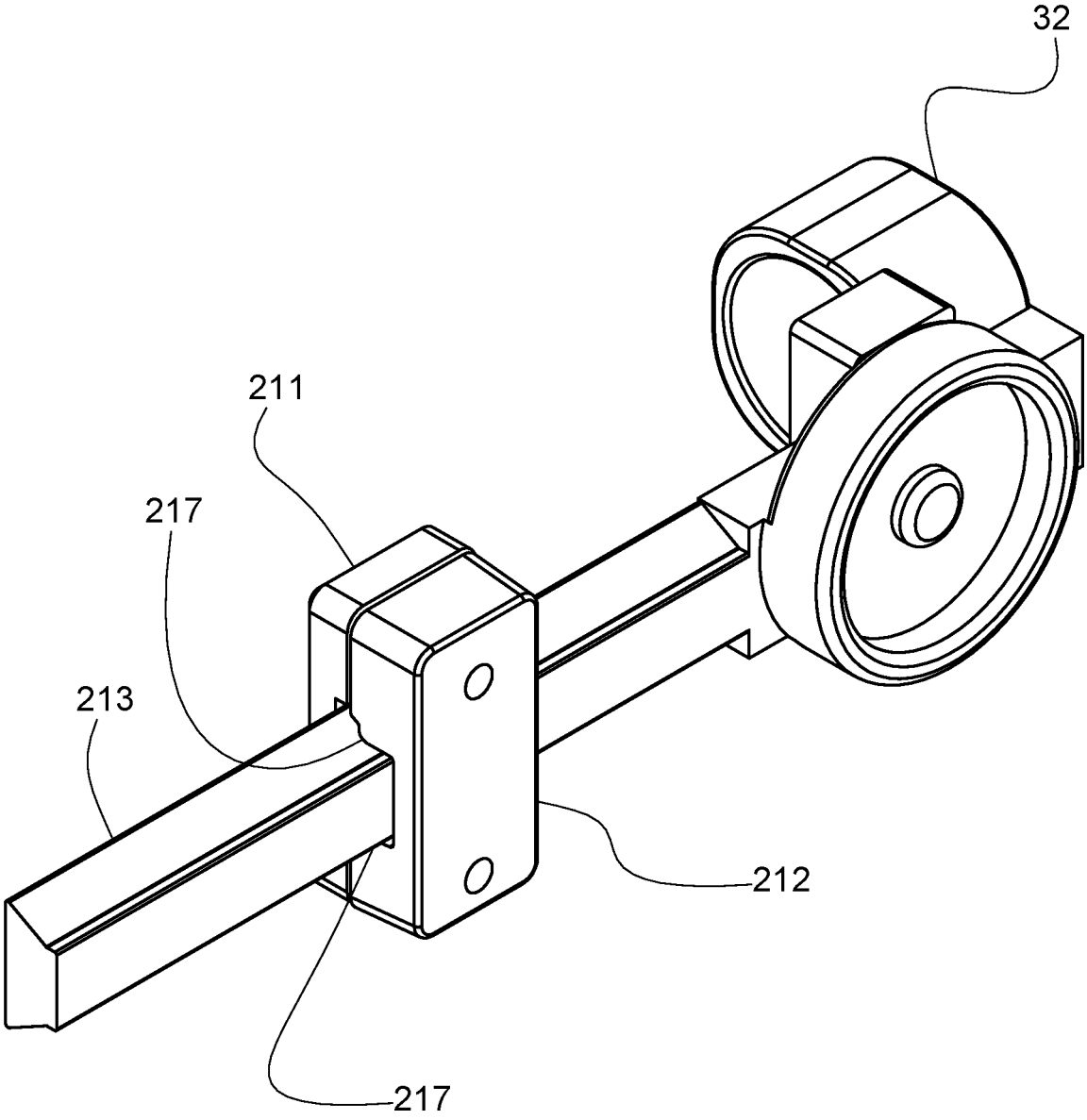

FIG. 59, FIG. 60 and FIG. 61 show how radius features 217 within mounting fixture 212 make contact on the angled surface of dove tail mount crossbar 213. The presence of radius features 217 allows secure connection of mounting fixture to dovetail cross bars that have a variety of styles and shapes and when there is a variable clearance profile 218 between mounting fixture 212 and different dovetail cross bars.

Figure 62:
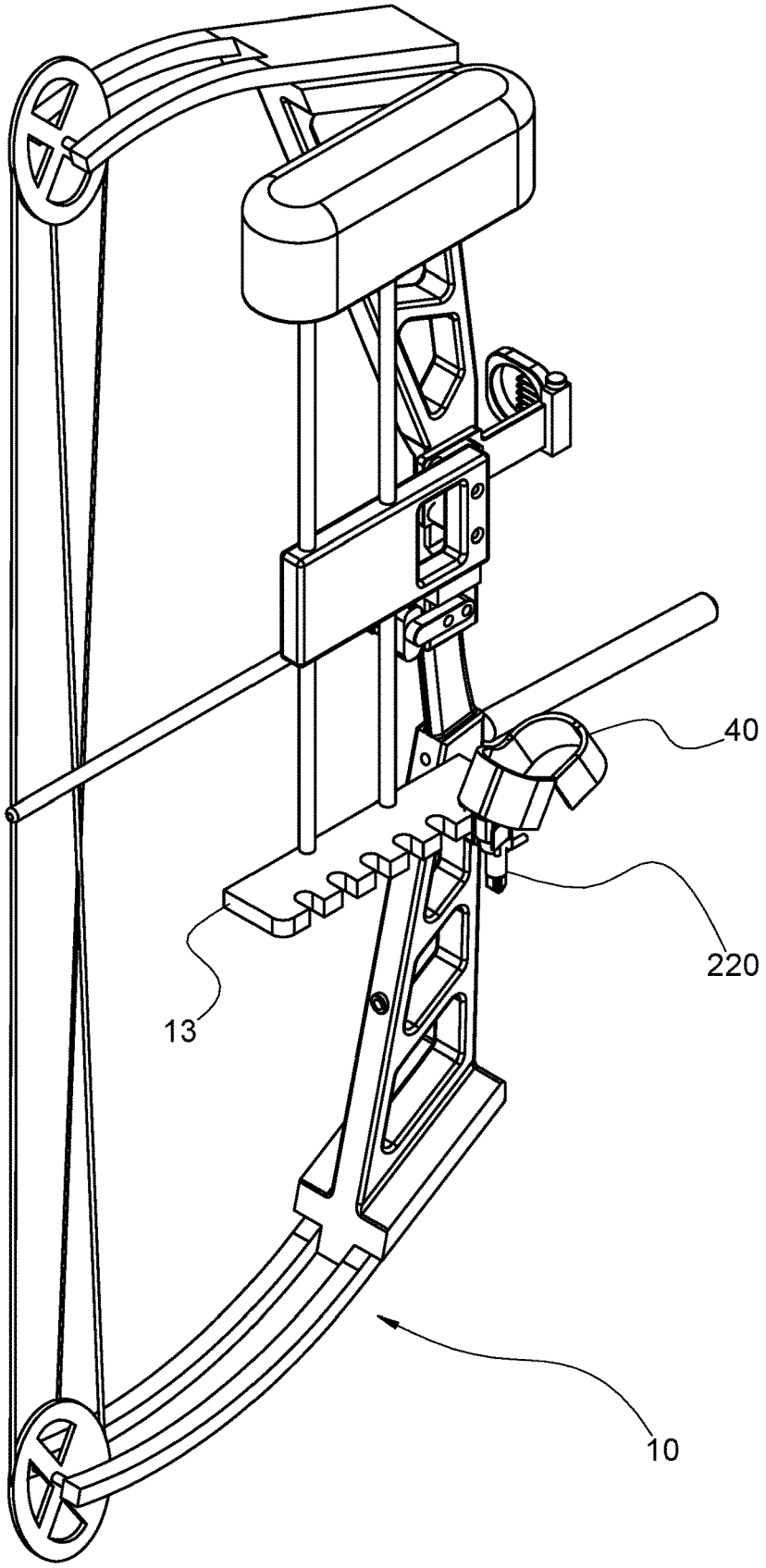
Figure 63:
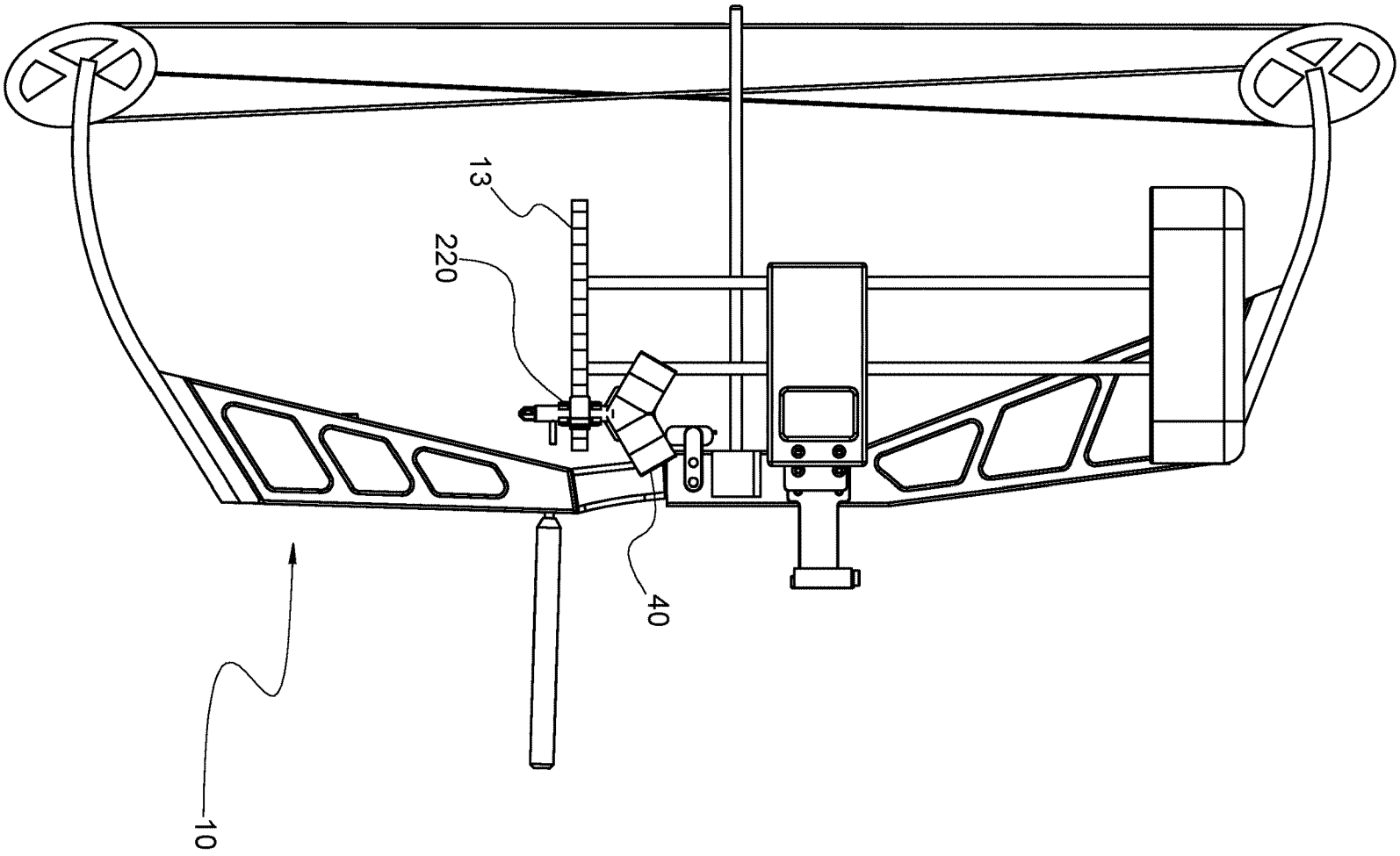

FIG. 62 and FIG. 63 show an archery release aid 220 attached to quiver arrow retainer structure 13 of bow 10. For example, archery release aid 220 is attached to quiver arrow retainer structure 13 of bow 10 using fasteners. Alternatively, archery release aid mount 220 can be integrated into the design of the bow quiver.

Figure 64:
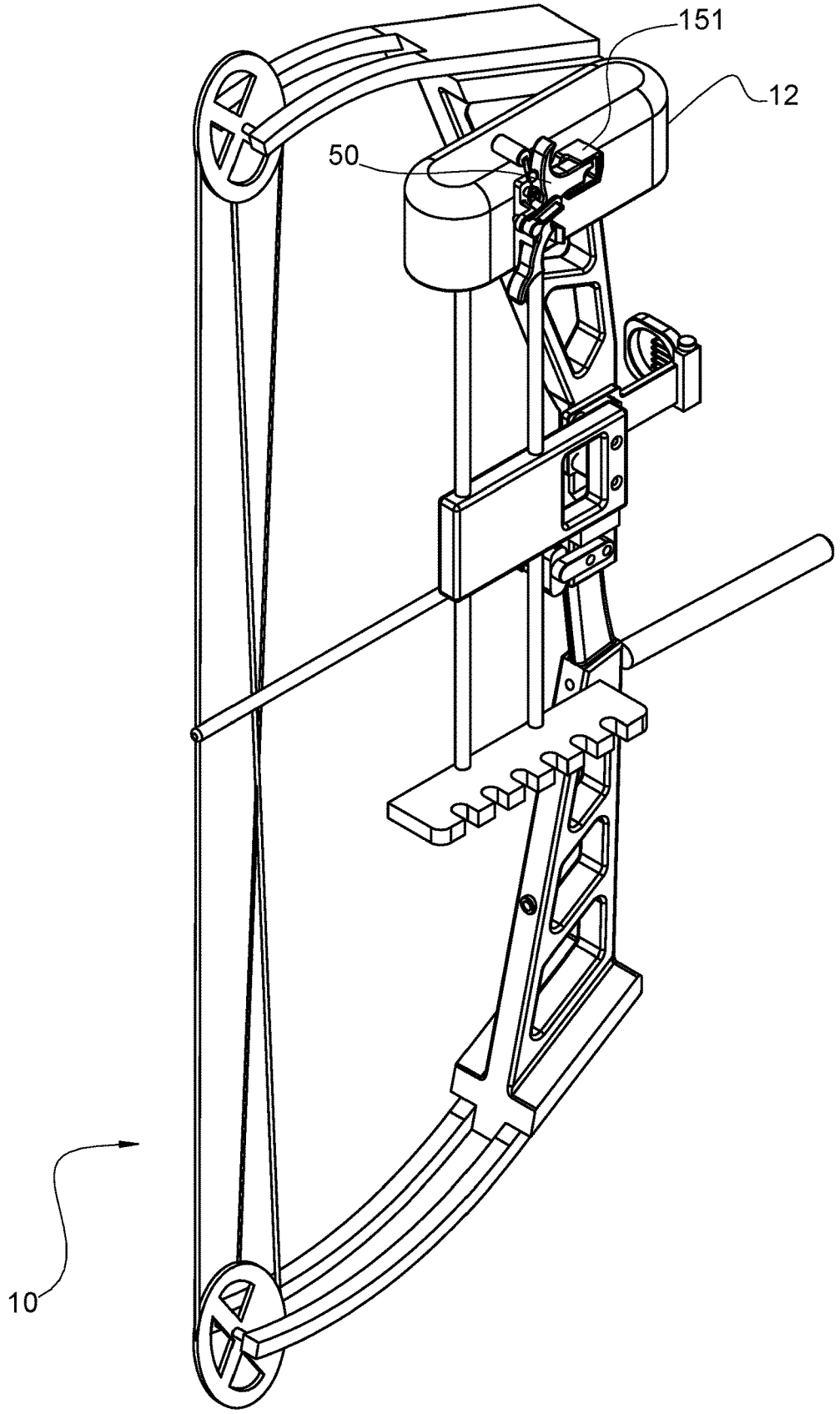
Figure 65:
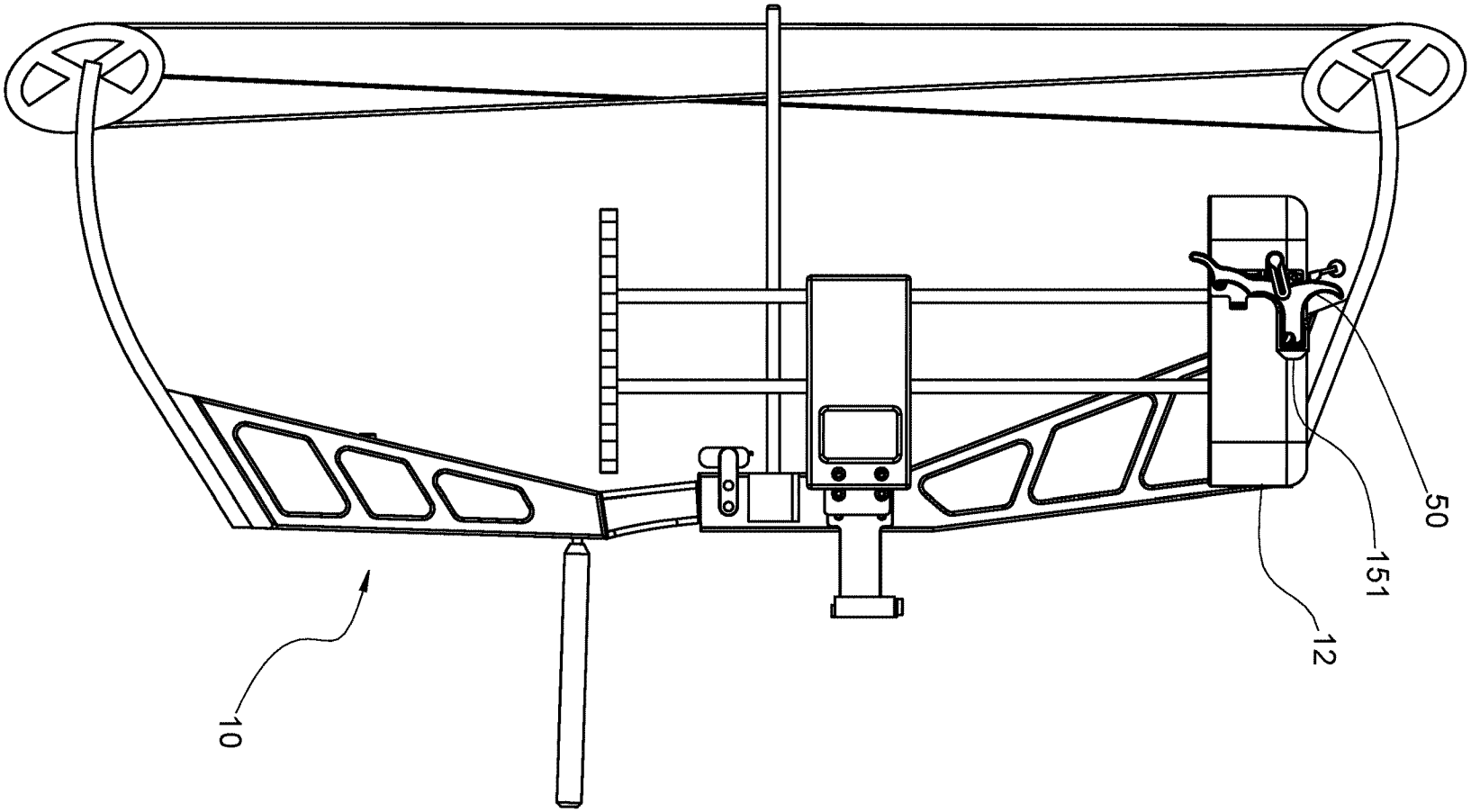

FIG. 64 and FIG. 65 show archery release aid mount 151 attached to top structure 12 of the of bow 10. For example, archery release aid mount 151 is attached to top structure 12 using fasteners. Alternatively, archery release aid mount 151 can be integrated into the design of the bow quiver.

Figure 66:
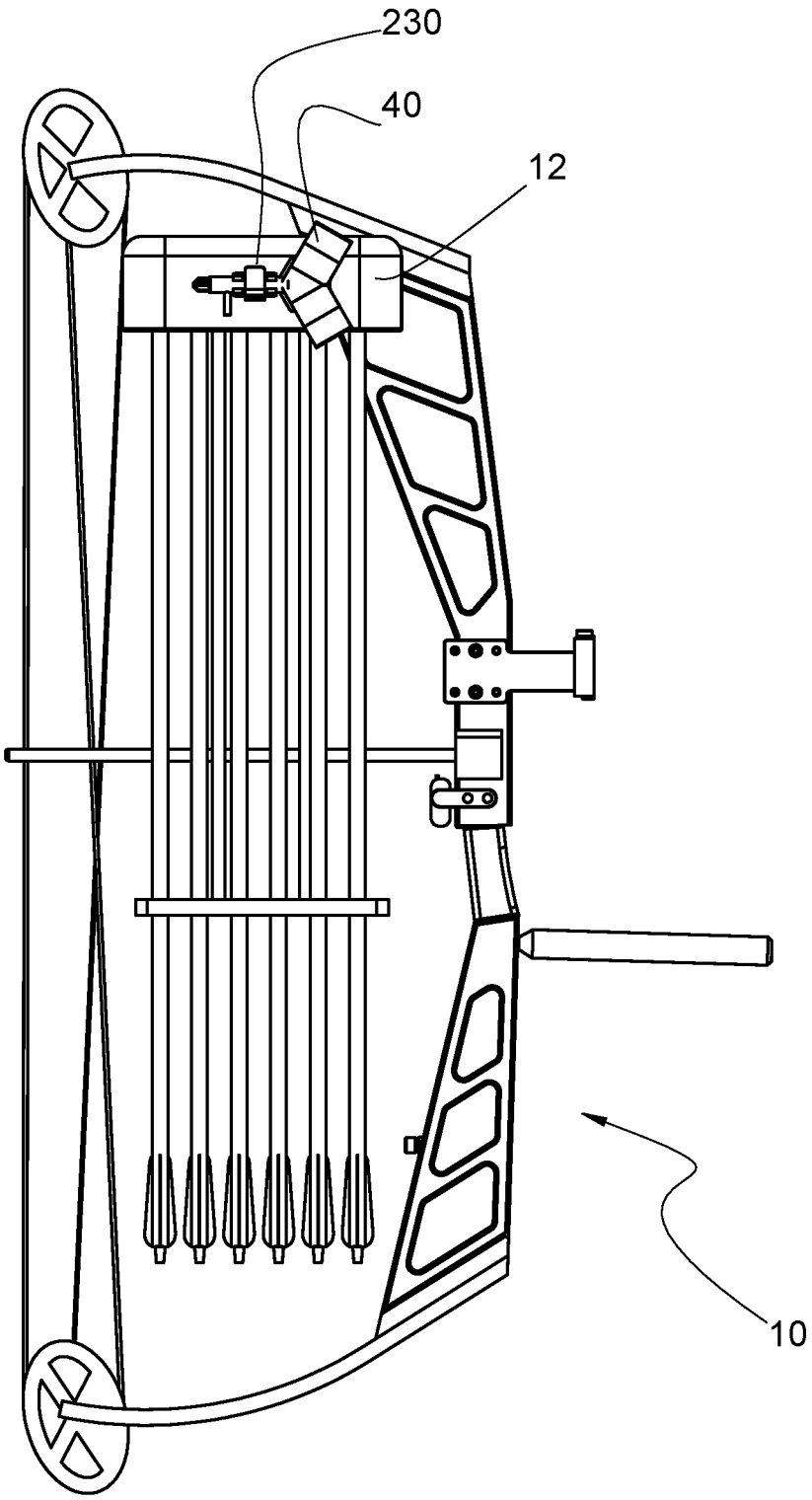
Figure 67:
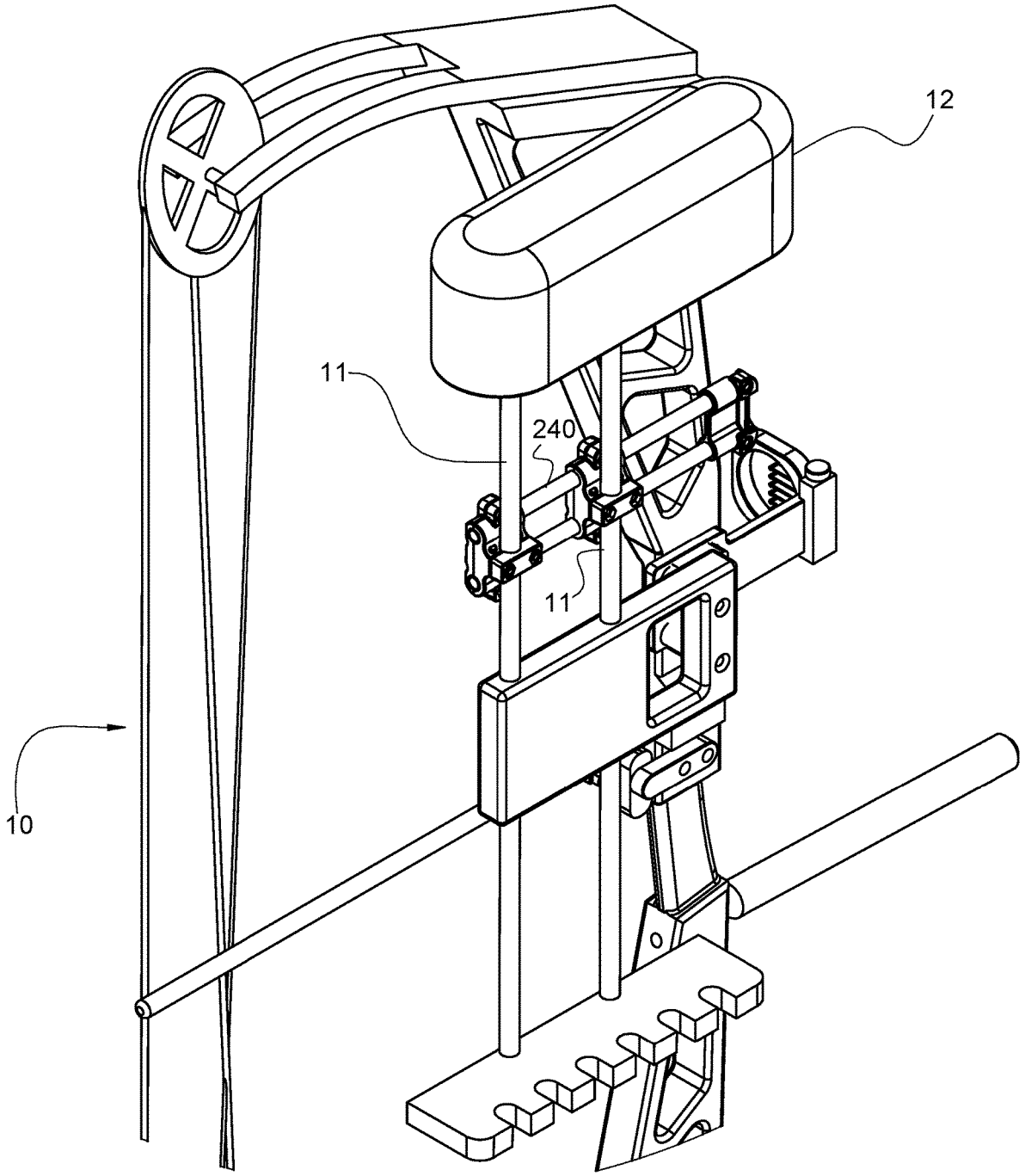
Figure 68:
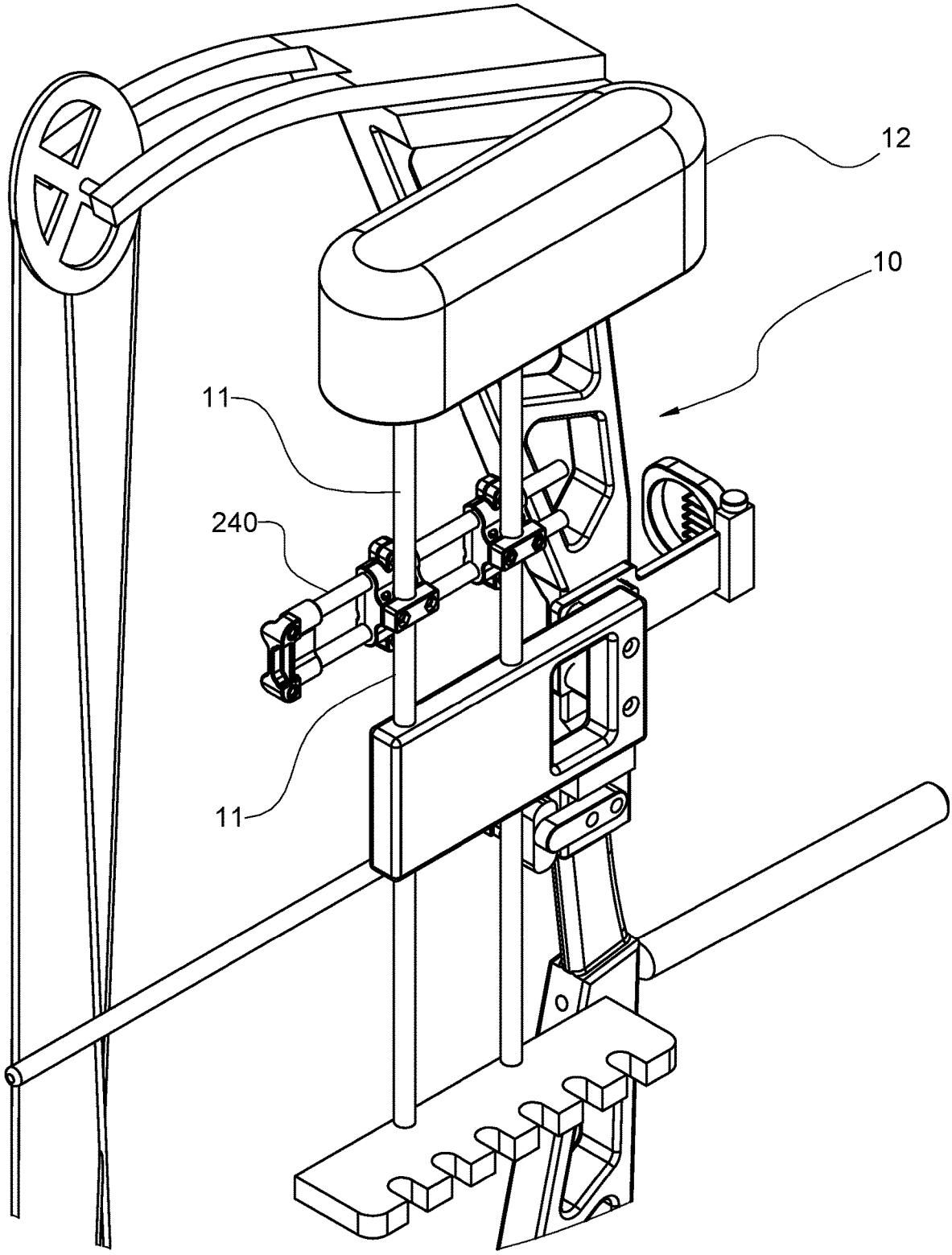

FIG. 66 shows an archery release aid mount 230 for archery release aid 40 attached to top structure 12 of the of bow 10. For example, archery release aid mount 230 is attached to top structure 12 using fasteners. Alternatively, archery release aid mount 230 can be integrated into the design of the bow quiver.

Figure 69:
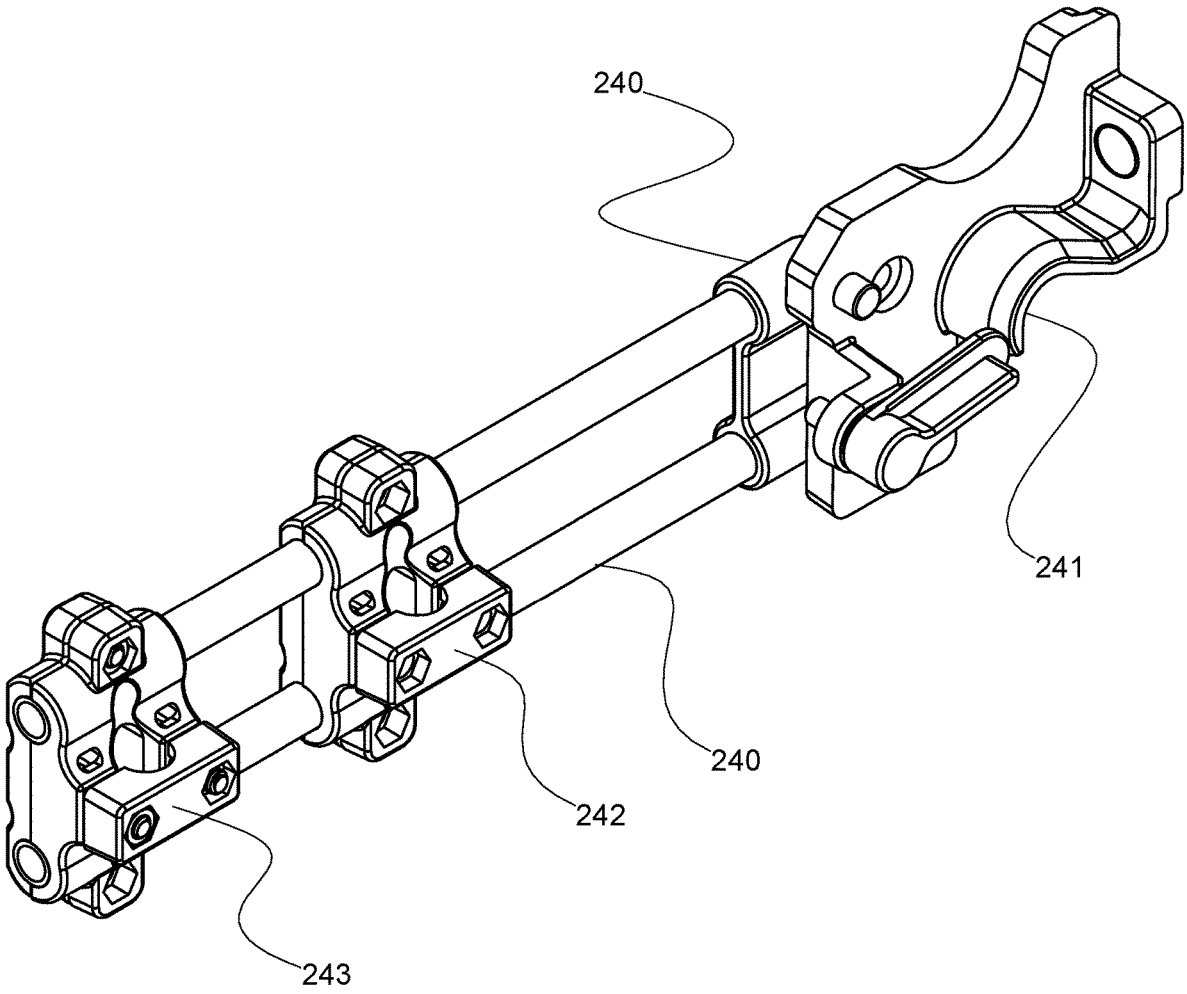
Figure 70:
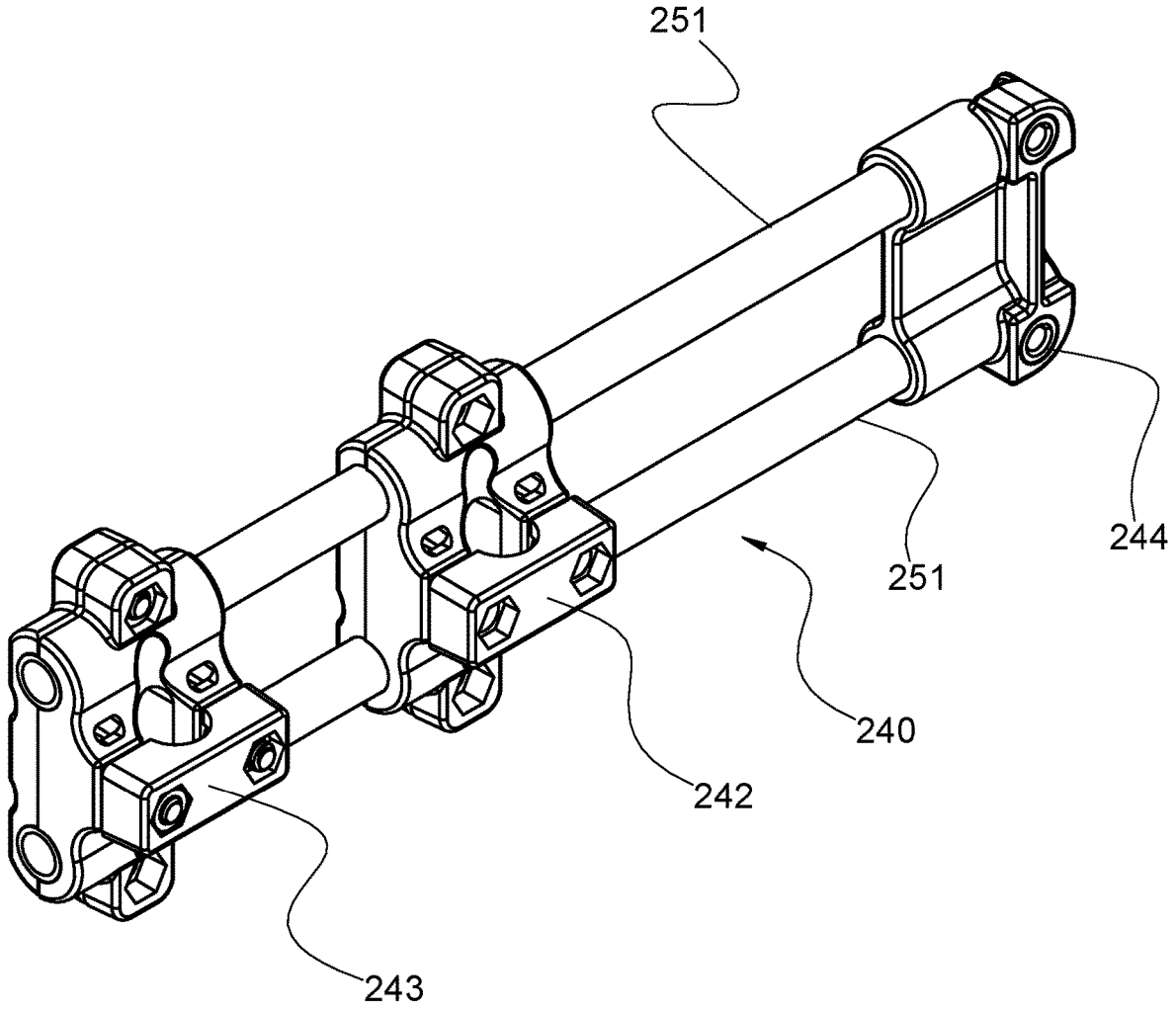

FIG. 68, FIG. 69, FIG. 70 and FIG. 71 show an accessory mount 240 that is configured to be attached to quiver support shafts 11 of the quiver for bow 10. For example, accessory mount 240 can be rotated so that the mounting surface is closer to the user. Accessory mount 240 can be positioned at different heights on the quiver by clamping at different locations along quiver support shafts 11. FIG. 69 shows an archery release aid mount 241 attached to accessory mount 240.

The distance between a clam shell bracket 242 and a clam shell bracket 243 can be adjusted to match the distance between quiver support shafts 211. Clam shell bracket 242 and clam shell bracket 243 can also be used to position support shafts 251 to adjust the location of a mounting surface 244 relative to quiver support shafts 211.

Figure 71:
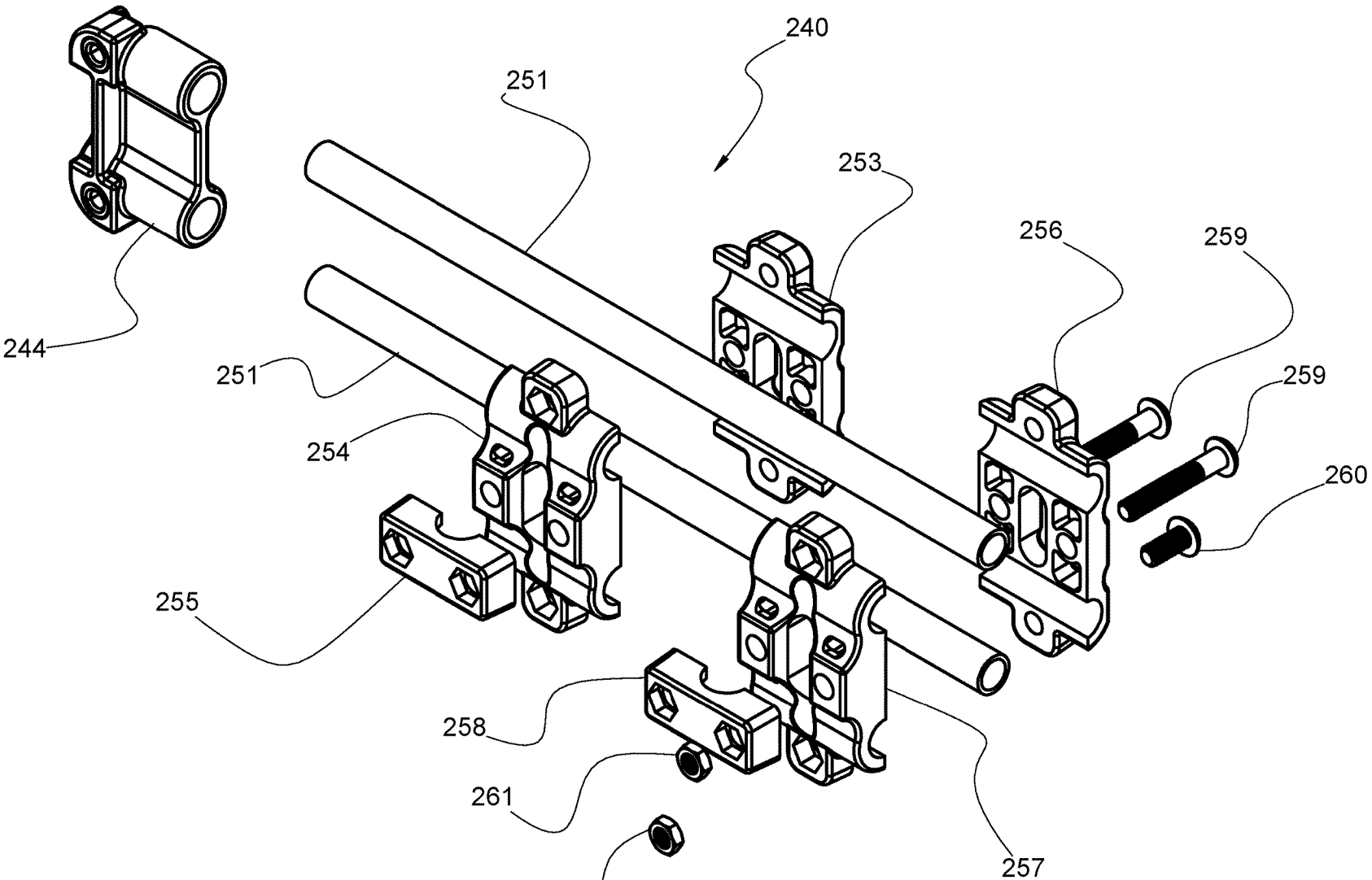

FIG. 71 shows an exploded view of accessory mount 240 where clam shell bracket 242 is shown to be composed of a clam shell clamp 253, a clam shell clamp 254 and a clamp 255. Clam shell bracket 243 is shown to be composed of a clam shell clamp 256, a clam shell clamp 257 and a clamp 258. Clamp 255 and clamp 258 capture quiver support rods allowing clam shell bracket 242 and clam shell bracket 243 to attach accessory mount 240 to quiver support shafts 211. For example, bolts 259 and nuts 261 are shown securing clamp 258 to clam shell bracket 257 and securing clam shell bracket 257 to clam shell bracket 256. Additional bolts and nuts, represented by bolt 260 are used to assemble clam shell bracket 243 and claim shell bracket 242.

Figure 72:
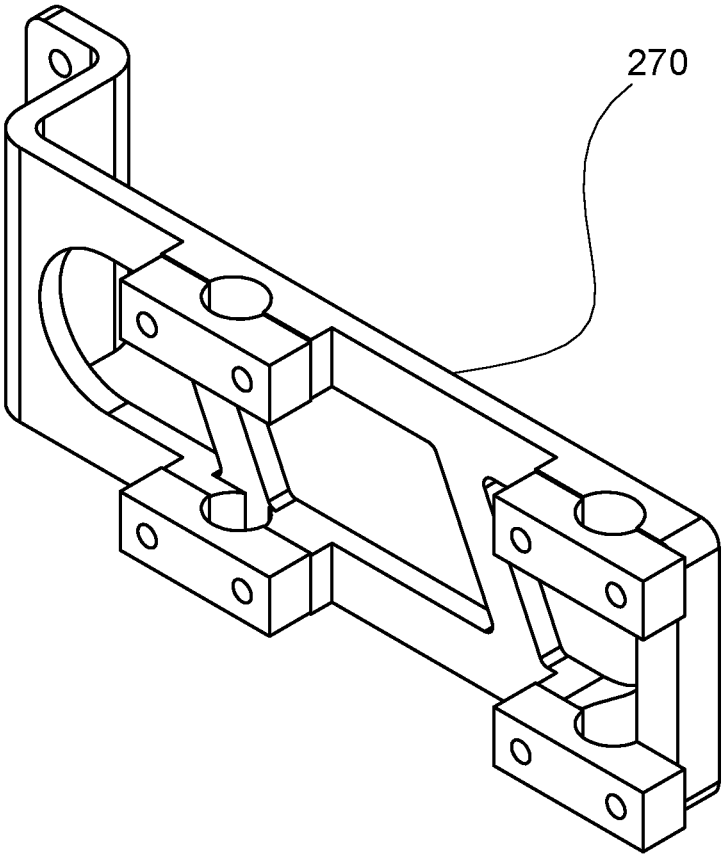

FIG. 72 shows a quiver accessory mount 270 made with fewer components. For example, quiver accessory mount 270 has limited adjustability and is configured to fit a specific quiver.

Figure 73:
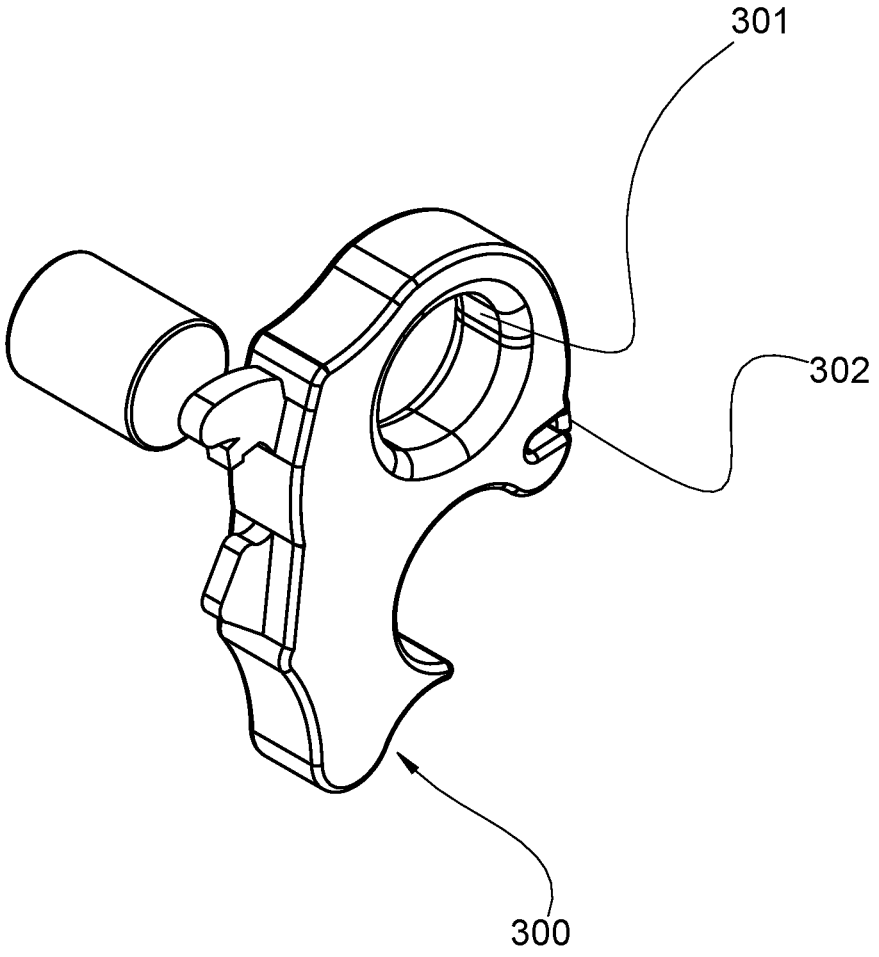
FIGURE 73 (PRIOR ART)
FIG. 73 shows an example of a prior art archery release aid.
Figure 74:
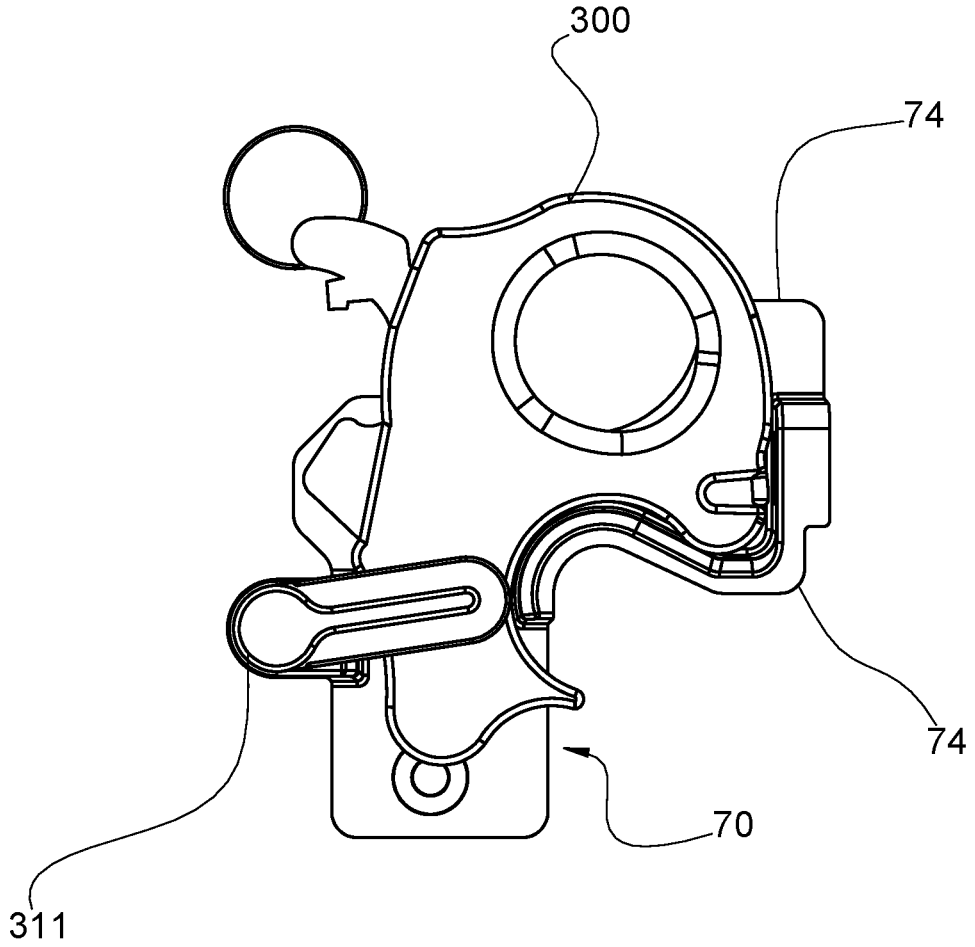
FIG. 74 shows an archery release aid secured in an archery release aid mount.

FIG. 73 shows an example of an archery release aid 300 that has a finger hole 301 and jaws 302. FIG. 74 shows archery release aid 300 secured in archery release aid mount 70, shown in FIG. 13. A region 741 of structure 74 keeps archery release aid 300 from being pushed out of archery release aid mount 70 when force is applied to archery release aid 300 near finger hole 301.

Figure 75:
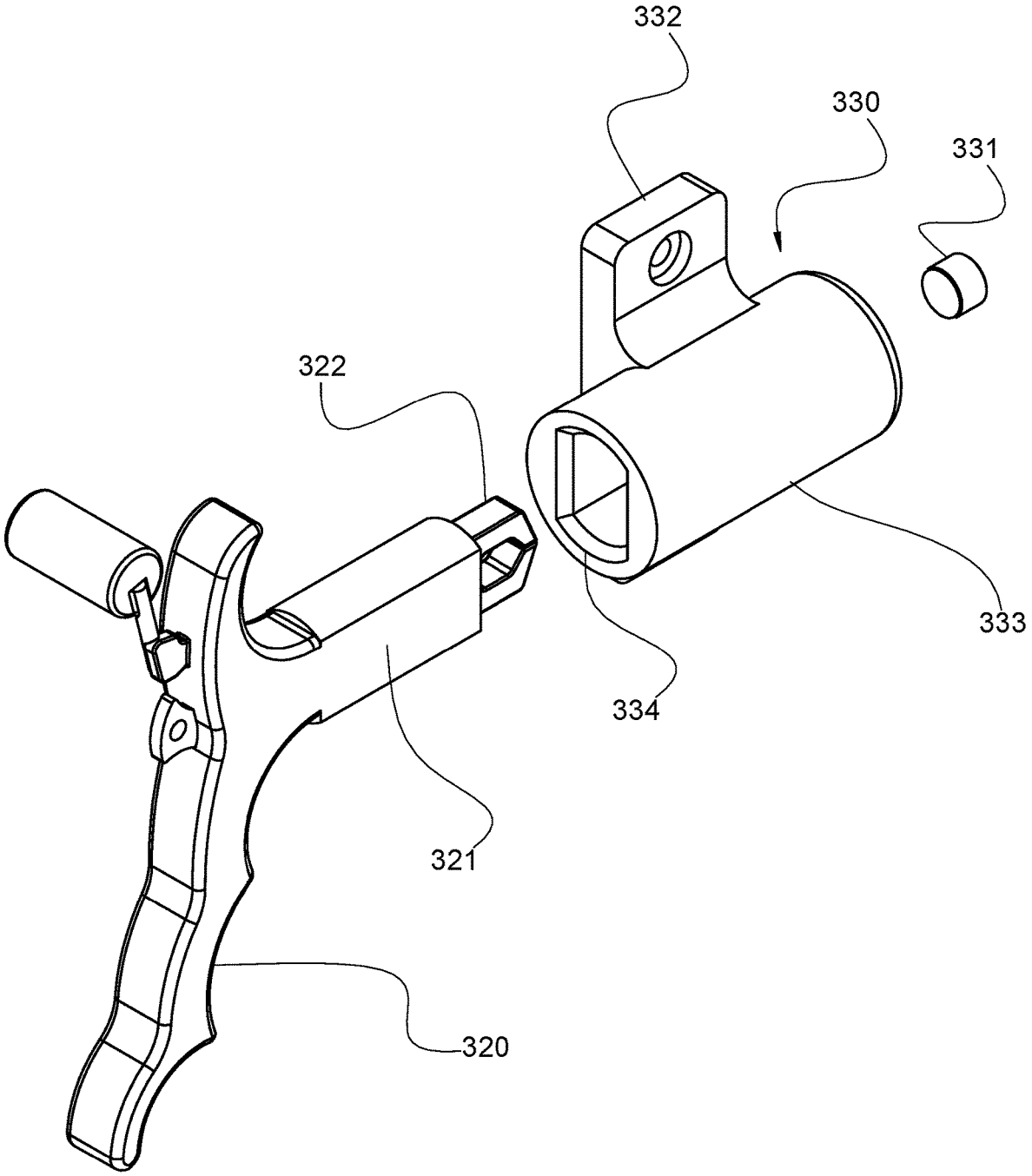
FIG. 75, FIG. 76 and FIG. 77 show an archery release aid mount that includes a mount, a magnet and a cylindrical body.
Figure 76:
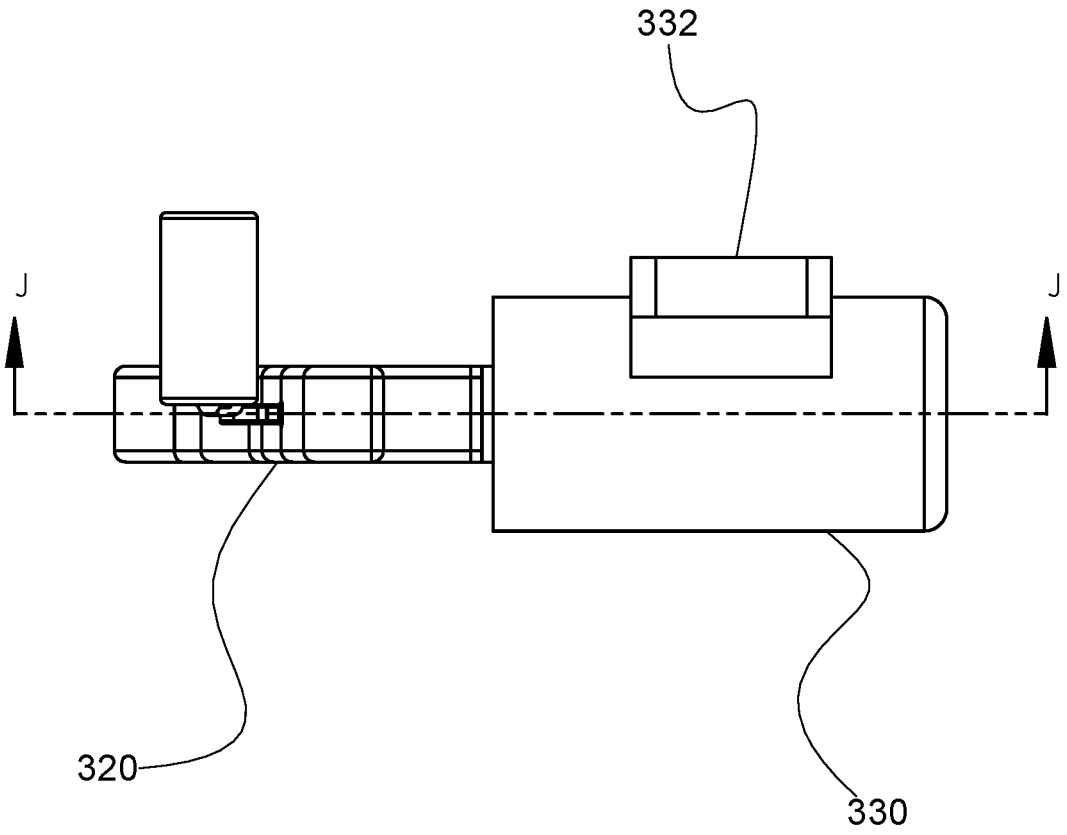
Figure 77:
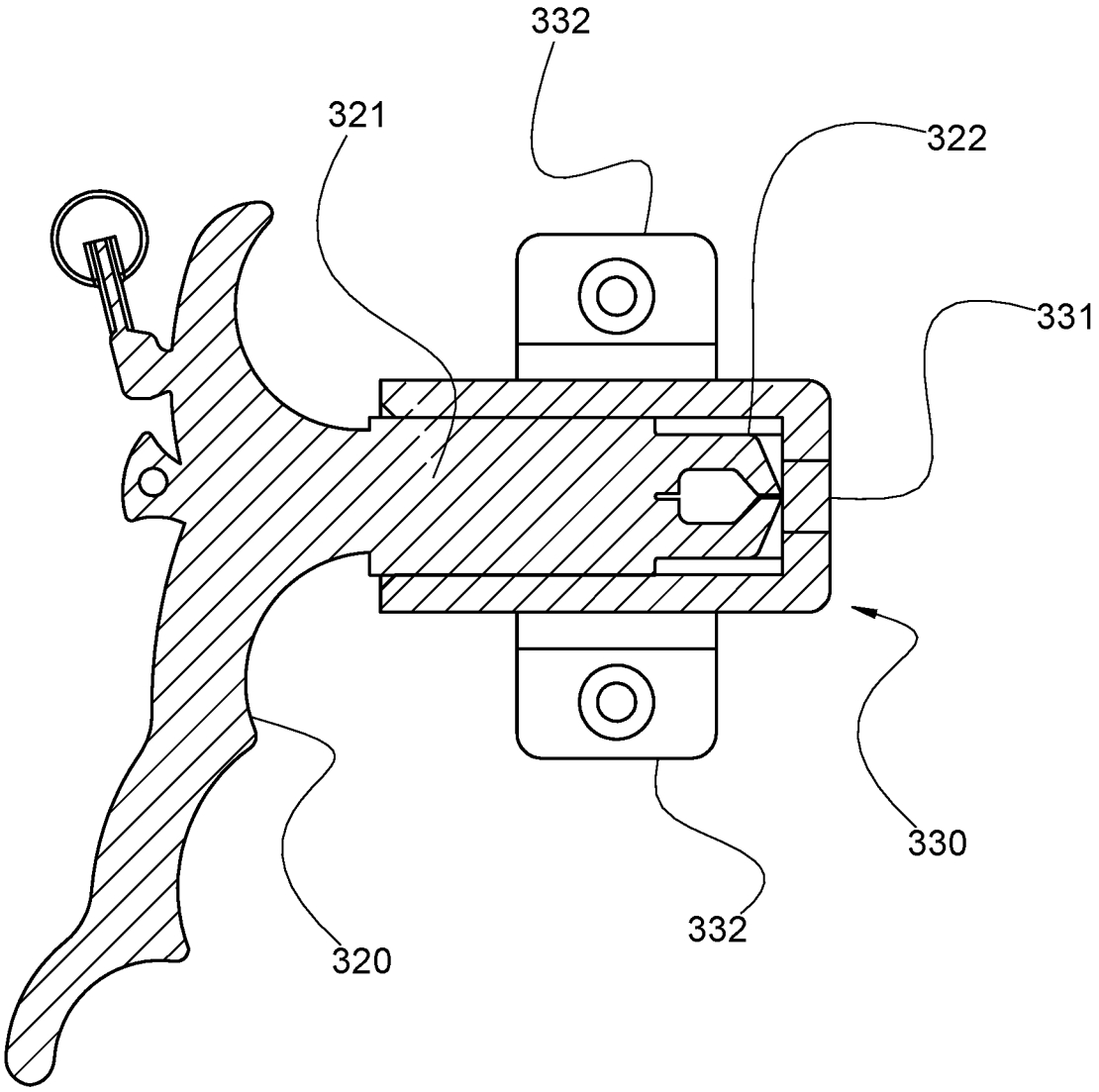
Figure 78:
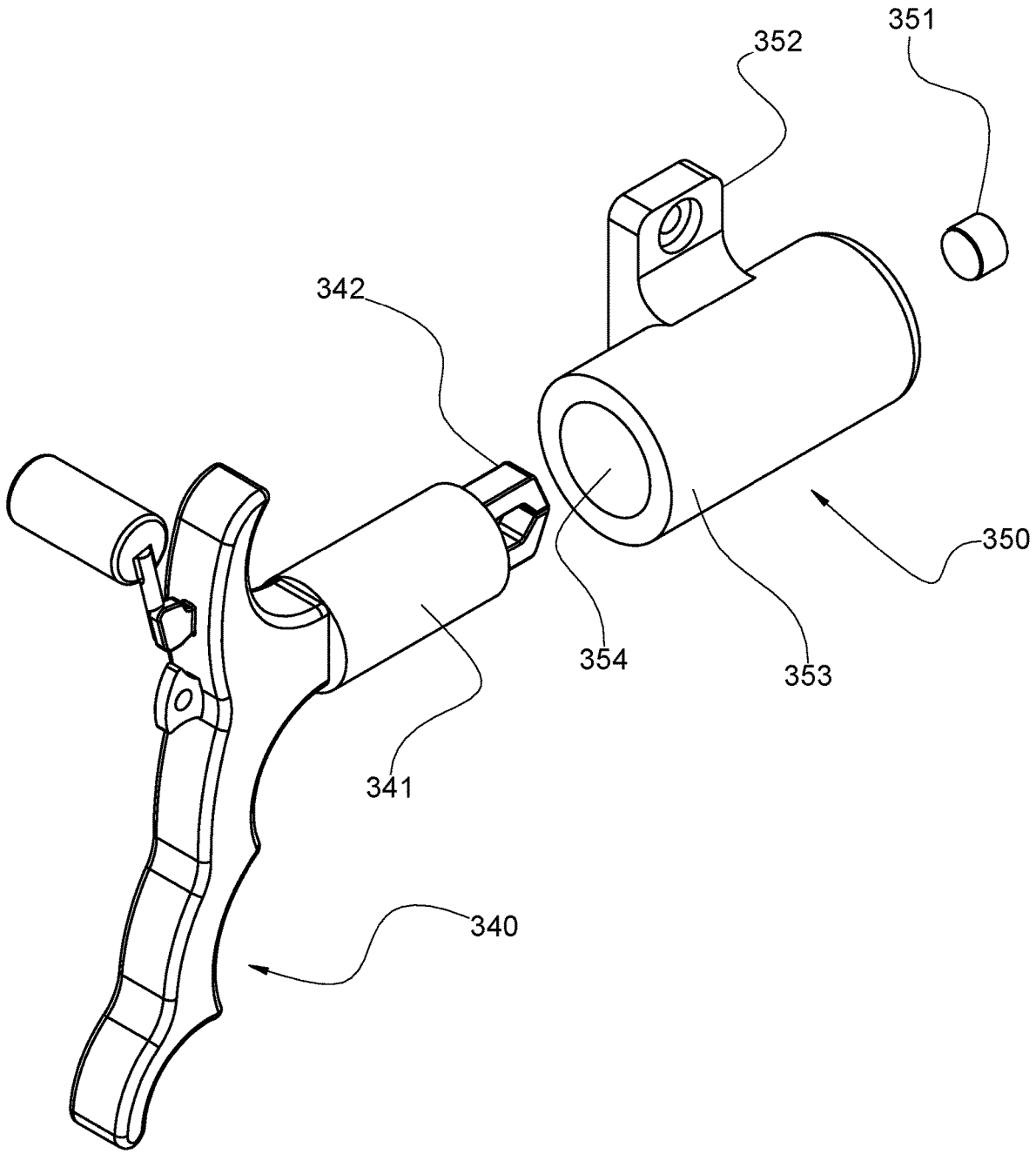
FIG. 78, FIG. 79, FIG. 80, FIG. 81 and FIG. 82 show an archery release aid mount that includes a mount, a magnet and a cylindrical body.
Figure 79:
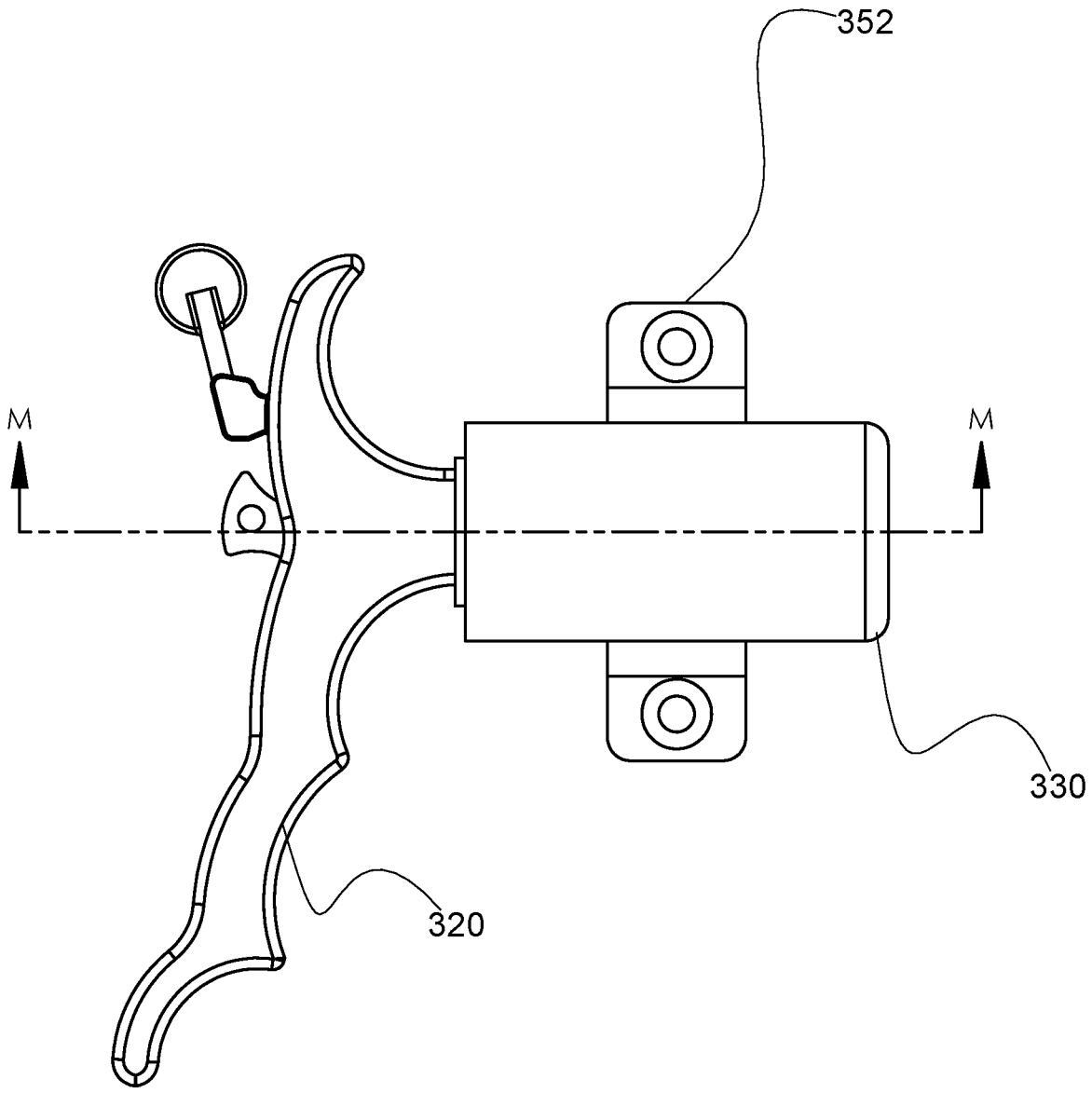
Figure 80:
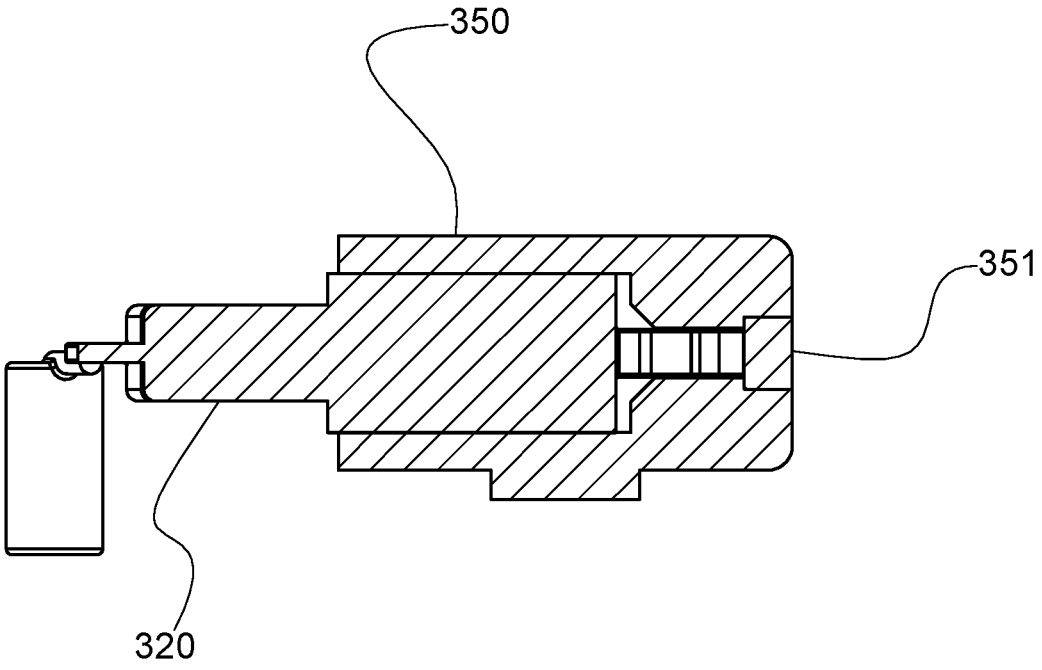
Figure 81:
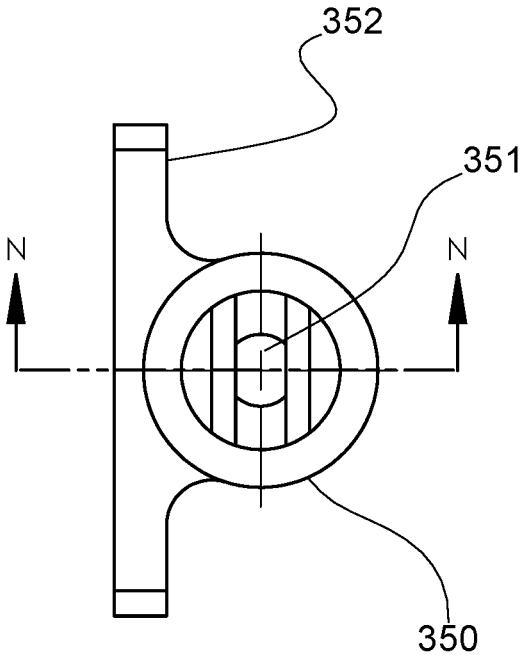
Figure 82:
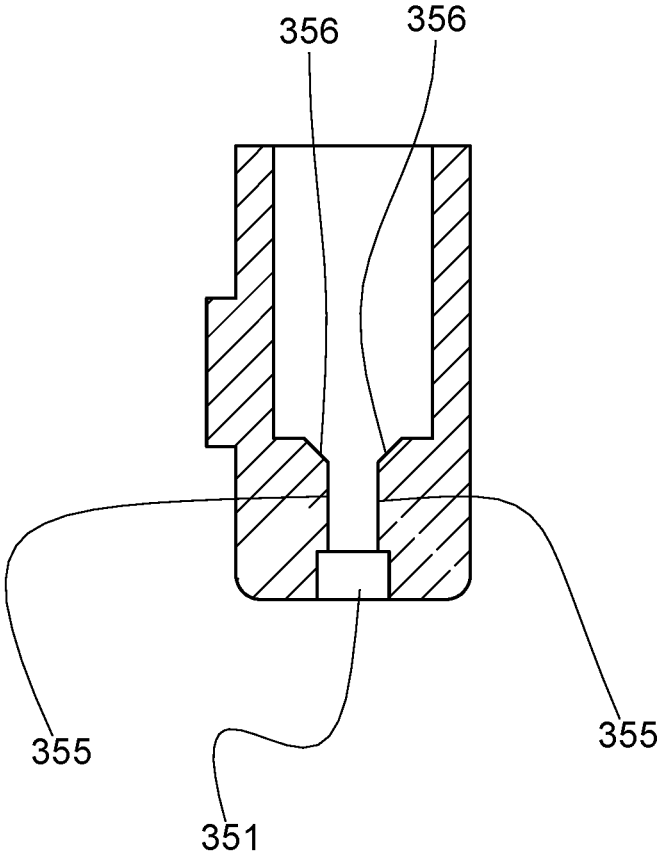

FIG. 75, FIG. 76 and FIG. 77 show an archery release aid mount 330 that includes a mount 332, a magnet 331 and a cylindrical body 333. An opening 334 receives a shaft 321 of an archery release aid 320. Opening 334 within cylindrical body 333 is shaped to generally match the shape of shaft 321 of archery release aid 320 in order to prevent rotation of archery release aid 320 when held by archery release aid mount 330. Opening 334 may additionally have rounded surface to keep archery release aid 320 centered. Magnet 331 attracts jaws 322 of archery release aid 320 to maintain archery release aid 320 within archery release aid mount 330.

FIG. 78, FIG. 79, FIG. 80, FIG. 81 and FIG. 82 show an archery release aid mount 350 that includes a mount 352, a magnet 351, a cylindrical body 353. An opening 354 receives a cylindrical shaped shaft 341 of an archery release aid 340. Opening 354 within cylindrical body 353 is rounded to generally match the shape of shaft 341 of archery release aid 340. In order to prevent rotation of archery release aid 340 when held by archery release aid mount 350, walls 355 near magnet 351 are narrowed to match the shape of jaws 342 of archery release aid 340 and to provide a keying feature preventing rotation. Tapering at locations 356 aid in alignment when placing cylindrical shaped shaft 341 of an archery release aid 340 within opening 354. Magnet 351 attracts jaws 342 of archery release aid 340 to maintain archery release aid 340 within archery release aid mount 350.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

The invention claimed is:

1. An archery release aid mount, comprising:

an attachment mechanism configured to rigidly attach the archery release aid mount to a bow or to rigidly integrate the archery release aid mount as part of the bow; and a mounting mechanism configured to receive an archery release aid, the mounting mechanism including:

a structure shaped to receive and hold an archery release aid, the structure including a hand clearing area where a user can grasp two sides of the archery release aid when the archery release aid is held by the structure, and a securing device that upon the archery release aid mount receiving the archery release aid, holds the archery release aid securely, and that is configured to allow a user to without tools remove the archery release aid from the archery release aid mount when the user wants to use the archery release aid during archery, the securing device including:

a magnet positioned to contact a portion of the archery release aid and hold the archery release aid to the mounting mechanism, and a lever that when in a first position holds the archery release aid securely and that when rotated to a second position to allow removal of the archery release aid from the archery release aid mount.

2. An archery release aid mount as in claim 1, wherein the attachment mechanism attaches to a stabilizer of the bow.

3. An archery release aid mount as in claim 1, wherein the attachment mechanism attaches to a sight of the bow.

4. An archery release aid mount as in claim 1, wherein the attachment mechanism attaches to a riser structure of the bow.

5. An archery release aid mount as in claim 1, wherein the attachment mechanism attaches to a quiver of the bow or is integrated into the design of the quiver of the bow.

6. An archery release aid mount as in claim 1, wherein the attachment mechanism is configured to be attached to the bow using auxiliary or accessory mounting holes of the bow.

7. An archery release aid mount as in claim 1, wherein the attachment mechanism includes clamps that clamp to a cross bar of a removable sight dovetail sight.

8. An archery release aid mount as in claim 1, wherein the attachment mechanism includes clamps that clamp to quiver support shafts of the bow.

9. An archery release aid mount as in claim 1, wherein the attachment mechanism attaches to a sight base that attaches a sight to the bow.

10. An archery release aid mount as in claim 1, wherein the attachment mechanism includes:

support rods;

a plurality of clam shell clamps that clamp to the support rods; and clamps that clamp each clam shell clamp in the plurality of clam shell clamps to a quiver support shaft of the bow.

11. An archery release aid mount as in claim 1, wherein the attachment mechanism includes:

support rods;

a plurality of clam shell clamps that clamp to the support rods; and clamps that clamp each clam shell clamp in the plurality of clam shell clamps to a quiver support shaft of the bow;

wherein positioning of the clam shell clams with respect to the support rods allows variance of a distance from the bow the release aid is mounted.

12. An archery release aid mount as in claim 1, wherein the securing device includes one or more protrusions configured to fit within one or more grooves in the archery release aid.

13. An archery release aid mount as in claim 1, wherein the securing device includes one or more protrusions configured to fit within one or more grooves in the archery release aid, each protrusion including a spherical protrusion configured to align with an indentation in one of the one or more grooves.

14. An archery release aid mount as in claim 1, wherein the structure includes tabs that adjusts locations to accommodate configuration changes to the archery release aid mount.

15. An archery release aid mount, comprising:

an attachment mechanism configured to rigidly attach the archery release aid mount to a bow or to rigidly integrate the archery release aid mount as part of the bow; and a mounting mechanism configured to receive an archery release aid, the mounting mechanism including:

a structure shaped to receive and hold an archery release aid, the structure including a hand clearing area where a user can grasp two sides of the archery release aid when the archery release aid is held by the structure, the structure including a tab that adjusts locations to accommodate configuration changes to the archery release aid mount, and a securing device that upon the archery release aid mount receiving the archery release aid, holds the archery release aid securely, and that is configured to allow a user to without tools remove the archery release aid from the archery release aid mount when the user wants to use the archery release aid during archery, the securing device including:

a magnet positioned to contact a portion of the archery release aid and hold the archery release aid to the mounting mechanism.

16. An archery release aid mount as in claim 15, wherein the securing device includes one or more protrusions configured to fit within one or more grooves in the archery release aid.

17. An archery release aid mount as in claim 15, wherein the securing device includes one or more protrusions configured to fit within one or more grooves in the archery release aid, each protrusion including a spherical protrusion configured to align with an indentation in one of the one or more grooves.

18. An archery release aid mount, comprising:

an attachment mechanism configured to rigidly attach the archery release aid mount to a bow or to rigidly integrate the archery release aid mount as part of the bow; and a mounting mechanism configured to receive an archery release aid, the mounting mechanism including:

a structure shaped to receive and hold an archery release aid, the structure including a hand clearing area where a user can grasp two sides of the archery release aid when the archery release aid is held by the structure, the structure including a tab that adjusts locations to accommodate configuration changes to the archery release aid mount, and a securing device that upon the archery release aid mount receiving the archery release aid, holds the archery release aid securely, and that is configured to allow a user to without tools remove the archery release aid from the archery release aid mount when the user wants to use the archery release aid during archery, the securing device including:

a lever that when in a first position holds the archery release aid securely and that when rotated to a second position to allow removal of the archery release aid from the archery release aid mount.

19. An archery release aid mount as in claim 18, wherein the securing device includes one or more protrusions configured to fit within one or more grooves in the archery release aid.

20. An archery release aid mount as in claim 18, wherein the securing device includes one or more protrusions configured to fit within one or more grooves in the archery release aid, each protrusion including a spherical protrusion configured to align with an indentation in one of the one or more grooves.

* * * * *